US009490527B2

(12) United States Patent
Guan et al.

(10) Patent No.: US 9,490,527 B2
(45) Date of Patent: Nov. 8, 2016

(54) ANTENNA DEVICE AND ANTENNA SYSTEM

(75) Inventors: Ning Guan, Sakura (JP); Hiroiku Tayama, Sakura (JP)

(73) Assignee: FUJIKURA LTD., Tokyo (JP)

( * ) Notice: Subject to any disclaimer, the term of this patent is extended or adjusted under 35 U.S.C. 154(b) by 767 days.

(21) Appl. No.: 13/539,955

(22) Filed: Jul. 2, 2012

(65) Prior Publication Data

US 2012/0268332 A1 Oct. 25, 2012

Related U.S. Application Data

(63) Continuation of application No. PCT/JP2011/050675, filed on Jan. 17, 2011.

(30) Foreign Application Priority Data

Jan. 18, 2010 (JP) ..... 2010-008440
Oct. 5, 2010 (JP) ..... 2010-226081

(51) Int. Cl.

*H01Q 7/00* (2006.01)
*H01Q 21/00* (2006.01)
*H01Q 1/32* (2006.01)
*H01Q 1/24* (2006.01)

(Continued)

(52) U.S. Cl.

CPC ..... *H01Q 1/243* (2013.01); *H01Q 1/325* (2013.01); *H01Q 1/36* (2013.01); *H01Q 1/38* (2013.01); *H01Q 7/00* (2013.01); *H01Q 1/3291* (2013.01); *H01Q 9/285* (2013.01)

(58) Field of Classification Search

CPC ..... H01Q 7/00; H01Q 1/243; H01Q 1/36; H01Q 9/28; H01Q 1/325; H01Q 1/3291

See application file for complete search history.

(56) References Cited

U.S. PATENT DOCUMENTS 6,320,545 B1 11/2001 Nagumo et al.
6,362,784 B1 * 3/2002 Kane et al. ..... 343/700 MS (Continued)

FOREIGN PATENT DOCUMENTS

CN 1148833 C 5/2004
CN 1871743 A 11/2006

(Continued)

OTHER PUBLICATIONS

Antenna Theory: A Review, Balanis, Proc. IEEE vol. 80 No. 1 Jan. 1992.*

(Continued)

*Primary Examiner* — Sue A Purvis
*Assistant Examiner* — Amal Patel
(74) *Attorney, Agent, or Firm* — Sughrue Mion, PLLC

(57) ABSTRACT

An antenna element (115) of an antenna device has first and second root sections (117) and (118) and an intermediate section lying between the first and second root sections (117) and (118). A feed section (114) is provided in the first and second root sections (117) and (118). The first and second root sections (117) and (118) are arranged so as to surround the feed section (114), and are provided in a wind section (113). Tail end linear parts in the wind section (113) extend in respective opposite directions. At least one of the first and second root sections (117) and (118) has a wider width part, which is formed such that a portion that overlaps a feed line connected with the feed section (114) is larger in width than other portions. This makes it possible to realize high radiant gain and improve a VSWR characteristic for each radio wave.

13 Claims, 54 Drawing Sheets

(51) Int. Cl.

| | |
|---|---|
| ***H01Q 1/36*** | (2006.01) |
| ***H01Q 1/38*** | (2006.01) |
| *H01Q 9/28* | (2006.01) |

(56) References Cited

U.S. PATENT DOCUMENTS

| | | | | |
|---|---|---|---|---|
| 7,233,298 | B2 * | 6/2007 | Nagel et al. | 343/895 |
| 2002/0000940 | A1 | 1/2002 | Moren et al. | |
| 2005/0007296 | A1 | 1/2005 | Endo et al. | |
| 2007/0085751 | A1 | 4/2007 | Kai et al. | |
| 2009/0121030 | A1 * | 5/2009 | Kato et al. | 235/492 |
| 2009/0243946 | A1 | 10/2009 | Kagaya et al. | |
| 2010/0283694 | A1 | 11/2010 | Kato | |
| 2010/0302013 | A1 | 12/2010 | Kato et al. | |

FOREIGN PATENT DOCUMENTS

| | | | |
|---|---|---|---|
| CN | 101552374 | A | 10/2009 |
| EP | 1887652 | A1 | 2/2008 |
| JP | 2001-068917 | A | 3/2001 |
| JP | 2002-280817 | A | 9/2002 |
| JP | 2004-112044 | A | 4/2004 |
| JP | 2005-117268 | A | 4/2005 |
| JP | 2005-347798 | A | 12/2005 |
| JP | 2007-116300 | A | 5/2007 |
| JP | 2008-042539 | A | 2/2008 |
| TW | 200812150 | A | 3/2008 |
| WO | 2006/059366 | A | 6/2006 |
| WO | 2009/110382 | A1 | 9/2009 |

OTHER PUBLICATIONS

Office Action issued by Chinese Patent Office in Chinese Application No. 201180005592.0 mailed Aug. 7, 2014.

Office Action issued by the Japanese Patent Office in Japanese Patent Application No. 2011-550034 dated Sep. 10, 2013.

Office Action issued by Japanese Patent Office in Japanese Patent Application No. 2011-550034 mailed Apr. 1, 2014.

J.D. Kraus et al., "Antennas for All Applications" Third Edition, 2002, pp. 178-181.

Communication dated Jan. 6, 2015, issued by the Japanese Patent Office in counterpart Japanese application No. 2011-550034.

Office Action issued by Chinese Patent Office in Chinese Application No. 2011800055920 mailed Dec. 3, 2013.

* cited by examiner

| PLANE | ORDER OF ROTATION | VERTICALLY-POLARIZED WAVE (V) | HORIZONTALLY-POLARIZED WAVE (H) |
|---|---|---|---|
| yx PLANE | x→y→-x→-y→x | Eθ | Eϕ |
| yz PLANE | -y→-z→y→z→-y | Eϕ | Eθ |
| zx PLANE | x→z→-x→-z→x | Eϕ | Eθ |

(a)

(b)

(a)

(b)

ANTENNA DEVICE AND ANTENNA SYSTEM

This application is a Continuation of PCT International Application No. PCT/JP2011/050675 filed in Japan on Jan. 17, 2011, which claims the benefit of Patent Application No. 2010-008440 filed in Japan on Jan. 18, 2010 and Patent Application No. 2010-226081 filed in Japan on Oct. 5, 2010, the entire contents of which are hereby incorporated by reference.

TECHNICAL FIELD

The present invention relates to an antenna device and an antenna system each of which is for use in transmission and reception of radio waves in a VHF broadcast band and a UHF terrestrial digital broadcast band.

BACKGROUND ART

Antennas have been long used as devices for converting a high-frequency current into an electromagnetic ray and an electromagnetic ray into a high-frequency current. The antennas are categorized into subgroups such as linear antennas, planar antennas, and solid antennas, based on their shapes. The linear antennas are further categorized into subgroups such as a dipole antenna, a monopole antenna, and a loop antenna, based on their structures. Out of these linear antennas, the dipole antenna, which is disclosed in for example Non Patent Literature 1, is a linear antenna that has a very simple structure, and is widely used as a base-station antenna etc. to this day.

Meanwhile, a terrestrial digital broadcasting service using a terrestrial UHF band (470 MHz to 770 MHz) started on Dec. 1, 2003 in three major wide areas: Kanto, Kinki and Chukyo regions. As analog broadcasting will be terminated in July 2011, the terrestrial digital broadcasting will be capable of providing not only high-resolution digital television programs with high-quality images and sounds but also two-way programs. The terrestrial digital television broadcasting can be received by a UHF antenna, and allows for watching television programs clearly without flickers even on a television set installed in a running train or a running bus etc. Further, services which allow for receiving and watching moving images, data broadcasting and sound broadcasting etc. on a portable information terminal or the like are expected to be provided.

Note here that, as a receiving antenna for a portable device, generally, a rod-shaped monopole antenna is used. The monopole antenna needs to have only one half (i.e., $\lambda/4$) the length of a dipole antenna, and therefore can be configured to be relatively small. The monopole antenna requires a conductor plate having an infinite area in theory; however, in a portable device, a conductor plate having a very small area is used as a substitute. Such a monopole antenna for a portable device is also called a "rod antenna" or a "whip antenna". According to the rod antenna and the whip antenna, a radiation electric field on a top surface of the conductor plate has the same directivity as that of the dipole antenna.

As an antenna for use in a television receiver or a radio receiver for a small portable device, there has been widely known a rod antenna having an extendable structure. The rod antenna is useful, because it can exert its functions when extended and it becomes compact when retracted.

As an antenna device using the rod antenna, for example, there has been proposed a device in which (i) a feed pin of a planar antenna is constituted by an extendable rod antenna and (ii) electric connection and disconnection between an extraction conductor of the rod antenna and a patch-shaped conductor of the planar antenna enable the antenna device to serve as a circularly polarized wave antenna and a linearly polarized wave antenna.

Further, there has been known a "helical antenna" as another arrangement example of the rod antenna. The helical antenna is formed by spirally winding an antenna line around a rod. Generally, an antenna using a conducting wire longer than a wavelength has a wide useable band. Therefore, the helical antenna can be downsized while keeping its wide-band characteristic by virtue of its winding structure. Further, the helical antenna serves as a flexible antenna which is tough and flexible (has safety), by constituting the rod (core) by a flexible material.

Such antenna devices for portable devices operate in 470 MHz to 770 MHz, and few of them alone can cover all of the channels of the terrestrial digital broadcasting. Further, in order to realize an antenna device for a portable device which antenna device can cover all of the channels, it is necessary to cause the antenna device to include a tuning circuit to tune the antenna device to a receiving frequency by controlling voltages. The same applies to an antenna for movable bodies, which antenna is to be provided in a movable body such as a vehicle.

Further, since antenna devices for portable devices and antenna devices for movable bodies are incapable of obtaining sufficiently-good radiation characteristics in a whole terrestrial digital broadcast band, most of them support only one-segment broadcasting and few of them support all of the 13 segments. This is because, in order for an antenna device to support all of the 13 segments, the antenna device is required to have an SN ratio (signal-to-noise ratio) higher than that of the antenna device which supports only the one-segment broadcasting.

Note here that the terrestrial digital broadcasting is a broadcasting system in which a 6 MHz domain is divided into 13 segments to carry out transmission. On the other hand, the foregoing "one-segment broadcasting" is a service which allows for partial reception of only one segment in the middle of the 13 segments, which one segment alone carries images, sounds and data for mobile phones and mobile terminals. This service started on Apr. 1, 2006 (Sat). Such a one-segment broadcasting service delivers programs that are basically the same as those delivered via 12 segments for usual television receivers. Therefore, users can watch popular programs that they usually watch on television sets installed in their home, even when they are away from home.

Under such circumstances, if an antenna device for terrestrial digital broadcasting is put into practical use, it is possible to mount such an antenna device not only on a mobile phone but also on various types of receivers such as car navigation systems, personal computers and dedicated portable television sets. This allows for reception of high-quality images as compared to one-segment broadcasting.

CITATION LIST

Non Patent Literatures

Non Patent Literature 1

J. D. Kraus and R. J. Marhefka "Antennas For All Applications", Third Edition, (United States), McGraw Hill, 2002, pp. 178-181

SUMMARY OF INVENTION

Technical Problem

As described earlier, out of antenna devices for terrestrial digital broadcasting for use in portable devices, an antenna device for one-segment broadcasting has been put into practical use.

However, an antenna device for portable devices, which is for terrestrial digital broadcasting and covers all of the channels, has not yet come into wide use, and a smaller antenna device with higher receiving sensitivity is desired.

The same applies to an antenna device for VHF broadcasting. A smaller antenna device with higher receiving sensitivity, which antenna device can cover a VHF broadcast band, has not yet come into practical use.

Note here that an extendable rod antenna has the following problem due to its poor flexibility. That is, the rod antenna is prone to be broken at its base upon impact, or is likely to hit against a user or an object. Further, the rod antenna has a complex structure and is expensive to produce.

As to a helical antenna, it is possible to cause the helical antenna to be tough and flexible (have safety) by constituting a rod (core) by a flexible material. Note however that, although the helical antenna is freely bendable at any point, the helical antenna is inferior in for example gain and radiant efficiency. In particular, when the helical antenna is bent on impact, winding pitch of an antenna conducting wires become nonuniform, thereby causing a change in impedance.

On the other hand, a planar antenna has solved such problems in the structures of the foregoing rod antenna and helical antenna.

In view of this, an object of the present invention is to provide a small antenna device capable of being mounted on a portable device etc., which antenna device is capable of expanding a usable band despite of its small size. The present invention achieves expansion of a usable band by realizing high radiant gain and improving a VSWR characteristic for each radio wave in both the case of transmitting/receiving radio wave on a low frequency band side and the case of transmitting/receiving radio wave on a high frequency band side such as those in a VHF broadcast band and a UHF terrestrial digital broadcast band. Another object of the present invention is to provide an antenna device and an antenna system, each of which has the same characteristics as above and is capable of being mounted on a movable body.

Solution to Problem

In order to attain the above objects, an antenna device in accordance with the present invention is an antenna device including an antenna element which has an electrically conductive path continuing from one end part to the other end part and which has a feed section provided in the one and the other end parts of the electrically conductive path, the antenna element having a first root section which includes the one end part of the electrically conductive path, a second root section which includes the other end part of the electrically conductive path, and an intermediate section which lies between the first root section and the second root section, the feed section being provided in the first root section and the second root section, the first root section and the second root section being arranged, in a first region that is part of a region where the electrically conductive path is formed, so as to surround the feed section, in the first region, tail end linear parts of the respective first and second root sections, which tail end linear parts are directly connected with the intermediate section, extending in respective opposite directions, and at least one of the first and second root sections having a wider width part, the wider width part being formed such that a portion that overlaps a feed line connected with the feed section is larger in width than other portions.

The inventors of the subject application have diligently studied, and found out a configuration of an antenna device which is capable of realizing high radiant gain and improving a VSWR characteristic for each radio wave in both the case of transmitting/receiving radio wave on a low frequency band side and the case of transmitting/receiving radio wave on a high frequency band side.

That is, since the feed section is provided in both end parts of the antenna element which has the electrically conductive path continuing from the one end part to the other end part, the antenna device makes it possible to realize high radiant gain as is the case with a loop antenna device having a loop shape.

Further, the antenna element has a first root section which includes the one end part of the electrically conductive path, a second root section which includes the other end part of the electrically conductive path, and an intermediate section which lies between the first root section and the second root section, and is configured such that (i) the feed section is provided in the first root section and the second root section and (ii) the first root section and the second root section are arranged, in the first region that is part of the region where the electrically conductive path is formed, so as to surround the feed section. Further, the antenna element is configured such that (a) in the first region, the tail end linear parts of the respective first and second root sections, which tail end linear parts are directly connected with the intermediate section, extend in the respective opposite directions and (b) at least one of the first and second root sections has a wider width part, the wider width part being formed such that a portion that overlaps the feed line connected with the feed section is larger in width than other portions.

This realizes impedance matching between the antenna element and the feed line in the feed section, thereby reducing a VSWR value, that is, thereby improving a VSWR characteristic, of the antenna element.

As such, it is possible to improve a VSWR characteristic of the antenna element while realizing high radiant gain of the antenna element. This makes it possible to expand a usable band for the antenna element.

Advantageous Effects of Invention

An antenna device of the present invention is configured as above. Therefore, the antenna device of the present invention brings about an effect of being able, when being provided in a portable device or in a personal computer, to expand a usable band by realizing high radiant gain and improving a VSWR characteristic for each radio wave in both the case of transmitting/receiving radio wave on a low frequency band side and the case of transmitting/receiving radio wave on a high frequency band side such as those in a VHF broadcast band and a UHF terrestrial digital broadcast band.

DESCRIPTION OF EMBODIMENTS

The following description discusses, with reference to the drawings, embodiments of the present invention.

Embodiment 1

Figure 1:
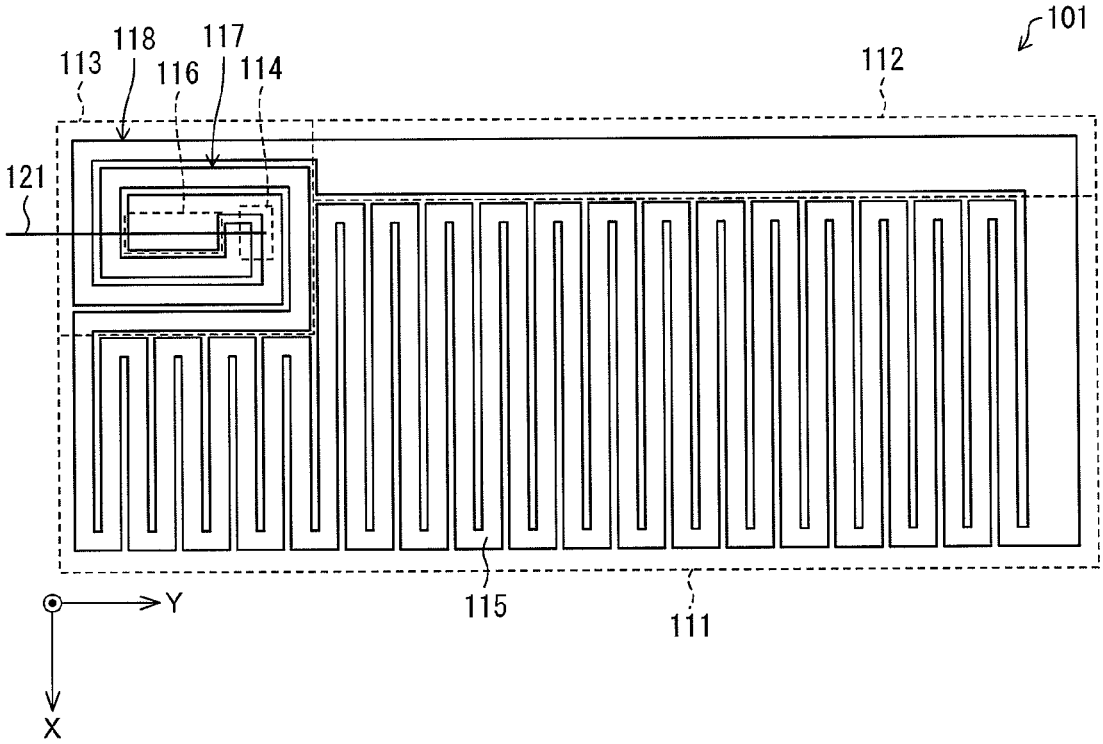
FIG. 1 is a plan view schematically illustrating an antenna device in accordance with Embodiment 1 of the present invention.

FIG. 1 is a plan view schematically illustrating a configuration of an antenna device in accordance with Embodiment 1 of the present invention. As illustrated in FIG. 1, an antenna device 101 includes an antenna element 115. The antenna element 115 is provided for example on a flat surface of a base material.

An antenna element 115 has an electrically conductive path continuing from its one end part to the other end part. In view of the fact that the antenna element 115 has the electrically conductive path thus continuing from its one end part to the other end part, it can be said that the antenna element 115 is provided in a loop manner, like a conventional loop antenna device. Further, the antenna element 115 is provided in a single plane. The antenna element 115 can be made from a material such as a conductive wire or a conductive film.

In the electrically conductive path of the antenna element 115, the one end part is included in a first root section (one root section) 117 and the other end part is included in a second root section (the other root section) 118. A part (first part) of an intermediate section between the first and second root sections 117 and 118 of the electrically conductive path constitutes a first antenna section 111, and the other part (second part) constitutes a second antenna section 112. On the other hand, the first root section 117 and the second root section 118 constitute a wind section 113 (first region). That is, the antenna element 115 includes the two root sections 117 and 118, and the first antenna section 111 and the second antenna section 112 lying between the root sections 117 and 118. In an example shown in FIG. 1, the first antenna section 111 has a meander shape (meander line antenna shape, meander-shaped part), whereas the second antenna section 112 has a linear shape.

The antenna device 101 has the following size: a length in a crosswise direction (i.e., Y axis direction) of a sheet on which FIG. 1 is illustrated is 70 mm; and a length in a lengthwise direction (i.e., X axis direction) of the sheet is 30 mm.

A feed section 114 is provided in the first and second root sections 117 and 118 of the antenna element 115. The feed section 114 is connected with a feed line 121. This allows the antenna element 115 to receive power via the feed line 121.

According to the wind section 113, the first root section 117 of the antenna element 115 is drawn out in a leftward direction (i.e., a negative direction of the Y axis) of the sheet on which FIG. 1 is illustrated, whereas the second root section 118 of the antenna element 115 is drawn out in a rightward direction (i.e., a positive direction of the Y axis) of the sheet on which FIG. 1 is illustrated. That is, the first and second root sections 117 and 118 are drawn out in respective opposite directions.

Note that the direction in which the first root section 117 of the antenna element 115 is drawn out is a direction in which the feed line 121 extends from the feed section 114, i.e., the leftward direction (i.e., the negative direction of the Y axis) of the sheet on which FIG. 1 is illustrated, whereas the direction in which the second root section 118 of the antenna element 115 is drawn out is a direction opposite to the direction in which the feed line 121 extends from the feed section 114 (i.e., in the leftward direction of the sheet).

Specifically, according to the wind section 113, a direction in which the first root section 117 extends from the one end of the antenna element 115 is changed from a direction (i) to a direction (v) in this order: (i) the leftward direction (i.e., the negative direction of the Y axis) of the sheet on which FIG. 1 is illustrated, (ii) an upward direction (i.e., a negative direction of the X axis) of the sheet, (iii) the rightward direction (i.e., the positive direction of the Y axis) of the sheet, (iv) a downward direction (i.e., a positive direction of the X axis) of the sheet, and (v) the leftward direction (i.e., the negative direction of the Y axis, the drawing direction) of the sheet. On the other hand, a direction in which the second root section 118 extends from the other end of the antenna element 115 is changed from a direction (vi) to a direction (x) in this order; (vi) the rightward direction (i.e., the positive direction of the Y axis) of the sheet on which FIG. 1 is illustrated, (vii) the downward direction (i.e., the positive direction of the X axis) of the sheet, (viii) the leftward direction (i.e., the negative direction of the Y axis) of the sheet, (ix) the upward direction (i.e., the negative direction of the X axis) of the sheet, and (x) the rightward direction (i.e., the positive direction of the Y axis, the drawing direction) of the sheet. That is, in the wind section 113, both of the directions in which the respective first and second root sections 117 and 118 extend are rotated by 360 degrees so as to surround the feed section 114. In the present embodiment, since the wind section 113 is arranged so as to surround the feed section 114, the antenna device 101 can realize a radiant gain of up to 4 dBi in a band of 470 MHz to 860 MHz.

The first antenna section 111 of the antenna element 115 is integrated with the first root section 117 and has a meander shape made up of at least one return pattern. A return direction (i.e., the X axis direction in FIG. 1) of the at least one return pattern in the meander shape is perpendicular to the direction in which the first root section 117 of the antenna element 115 is drawn out in the wind section 113.

The second antenna section 112 of the antenna element 115 has a linear shape. The linear shape (antenna section 112) extends in a direction (i.e., the Y axis direction in FIG. 1) parallel to a direction in which the second root section 118 of the antenna element 115 is drawn out in the wind section 113.

That is, according to the antenna element 115 of the antenna device 101, the return direction of the meander shape of the first antenna section 111 is perpendicular to a direction in which the linear shape of the second antenna section 112 extends.

According to the wind section 113, (i) the feed line 121 is provided above the wind section 113 and (ii) the second root section 118 of the antenna element 115 has a line width wider in an area, where the feed line 121 and the second root section 118 that is provided below the feed line 121 overlap each other, than in another area that does not overlap the feed line 121 (see FIG. 1).

This can realize impedance matching in the feed section 114. Note that such a wider line width pattern is hereinafter referred to as an inductance matching pattern (i.e., wider width part) 116.

The reason why the wider line width pattern is thus referred to as the inductance matching pattern (i.e., wider width part) 116 is that the wider line width pattern serves as an inductor having an inductive reactance with respect to a high-frequency current supplied to the antenna device 101, so as to cause a change in input impedance of the antenna device 101. Note, however, that a contribution of the wider line width pattern to the input impedance is not limited only to a contribution caused by inductance. That is, it is also possible to change the input impedance of the antenna device 101 by causing a wider line width pattern to serve as a capacitor having a capacitive reactance.

With such an arrangement of the inductance matching pattern 116, the antenna device 101 is capable of causing a decrease in VSWR of the antenna element 115. This allows expansion of a usable band in which the VSWR value is not greater than a rated value. As such, it is possible to realize a usable band including low and high frequency bands, even in a case of transmitting or receiving radio wave on a low frequency band side or radio wave on a high frequency band side. An arrangement of the inductance matching pattern 116 is later described in detail with reference to FIG. 2.

Figure 2:
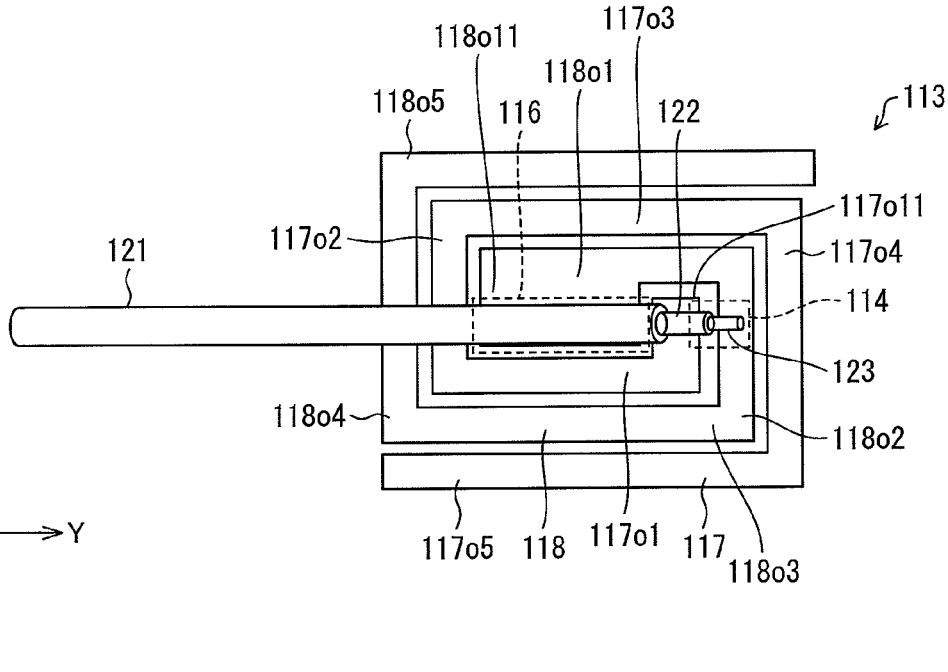
FIG. 2 is an enlarged view illustrating a wind section shown in FIG. 1.

With reference to FIG. 2, the following description will discuss the wind section 113 in more detail. As described earlier, the wind section 113 is made up of the first root section 117 and the second root section 118 of the antenna element 115.

The one root section 117 of the antenna element 115 includes first through third linear parts. The first linear part extends, from the one end part of the antenna element 115, in a leftward direction of a sheet on which FIG. 2 is illustrated (i.e., in the negative direction of the Y axis). The second linear part is connected with the first linear part via a first bending part extending in an upward direction of the sheet (i.e., in the negative direction of the X axis) and extends, from the first bending part, in a rightward direction of the sheet (i.e., in the positive direction of the Y axis). The third linear part is connected with the second linear part via a second bending part extending in a downward direction of the sheet (i.e., in the positive direction of the X axis) and extends, from the second bending part, in a leftward direction of the sheet (i.e., in the negative direction of the Y axis).

This arrangement can also be described as follows. The first root section 117 of the antenna element 115 has first through third linear parts **117*o*1, 117*o*3, and 117*o*5 and first and second bending parts 117*o*2 and 117*o*4. The first linear part 117*o*1 extends, in the leftward direction of the sheet on which FIG. 2 is illustrated (i.e., the negative direction of the Y axis), from the one end part of the antenna element 115. The first bending part 117*o*2 extends in the upward direction of the sheet (i.e., the negative direction of the X axis) from an end part of the first linear part 117*o*1. The second linear part 117*o*3 extends in the rightward direction of the sheet (i.e., the positive direction of the Y axis) from an end part of the first bending part 117*o*2. The second bending part 117*o*4 extends in the downward direction of the sheet (i.e., the positive direction of the X axis) from an end part of the second linear part 117*o*3. The third linear part (i.e., tail end linear part) 117*o*5 extends in the leftward direction of the sheet (i.e., the negative direction of the Y axis) from an end part of the second bending part 117*o*4**.

That is, the first root section 117 of the antenna element 115 is provided in a rectangular spiral shape so that the first through third linear parts **117*o*1, 117*o*3, and 117*o*5, which are connected with each other in this order via the first and second bending parts 117*o*2 and 117*o*4**, are arranged in parallel with each other.

On the other hand, the other root section 118 of the antenna element 115 includes fourth through sixth linear parts. The fourth linear part extends, in the rightward direction of the sheet on which FIG. 2 is illustrated (i.e., the positive direction of the Y axis), from the other end of the antenna element 115. The fifth linear part is connected with the fourth linear part via a third bending part extending in the downward direction of the sheet (i.e., the positive direction of the X axis) and extends in the leftward direction of the sheet (i.e., the negative direction of the Y axis) from the third bending part. The sixth linear part is connected with the fifth linear part via a fourth bending part extending in the upward direction of the sheet (i.e., the negative direction of the X axis) and extends in the rightward direction of the sheet (i.e., the positive direction of the Y axis) from the fourth bending part.

This arrangement can also be described as follows. The second root section 118 of the antenna element 115 has fourth through sixth linear parts 118*o*1, 118*o*3, and 118*o*5 and third and fourth bending parts 118*o*2 and 118*o*4. The fourth linear part 118*o*1 extends, in the rightward direction of the sheet on which FIG. 2 is illustrated (i.e., the positive direction of the Y axis), from the other end of the antenna element 115. The third bending part 118*o*2 extends in the downward direction of the sheet (i.e., the positive direction of the X axis) from an end part of the fourth linear part 118*o*1. The fifth linear part 118*o*3 extends in the leftward direction of the sheet (i.e., the negative direction of the Y axis) from an end part of the third bending part 118*o*2. The fourth bending part 118*o*4 extends in the upward direction of the sheet (i.e., the negative direction of the X axis) from an end part of the fifth linear part 118*o*3. The sixth linear part (i.e., tail end linear part) 118*o*5 extends in the rightward direction of the sheet (i.e., the positive direction of the Y axis) from an end part of the fourth bending part 118*o*4.

That is, the second root section 118 of the antenna element 115 is similarly provided in a rectangular spiral shape so that the fourth through sixth linear parts 118*o*1, 118*o*3, and 118*o*5, which are connected with each other in this order via the third and fourth bending parts 118*o*2 and 118*o*4, are arranged in parallel with each other.

Such arrangements can be said that the first and second root sections 117 and 118 of the antenna element 115 wind each other. On this account, the reference numeral 113 is referred to as a wind section.

The first linear part 117*o*1 of the first root section 117 has a protrusion part 117*o*11 that is located at an end part of the first linear part 117*o*1 and protrudes in a width direction of the first linear part 117*o*1 toward the fourth linear part 118*o*1 of the second root section 118. Similarly, the fourth linear part 118*o*1 of the second root section 118 has a protrusion part 118*o*11 that is located at an end of the fourth linear part 118*o*1 and protrudes in a width direction of the fourth linear part 118*o*1 toward the first linear part 117*o*1 of the first root section 117.

As such, the protrusion parts 117*o*11 and 118*o*11 are provided so as to be adjacent to each other in a Y direction shown in FIG. 2 and their end parts extend in respective opposite directions of an X direction shown in FIG. 2. Further, the first and second root sections 117 and 118 are provided in the respective rectangular spiral shapes whose start parts are the respective protrusion parts 117*o*11 and 118*o*11, i.e., whose centers are the respective protrusion parts 117*o*11 and 118*o*11.

The first root section 117 of the antenna element 115 receives power via the feed section 114 that is provided in an end part of the first root section 117. On the other hand, the second root section 118 of the antenna element 115 receives power via the feed section 114 that is provided not in an end part of the second root section 118 but in a middle part of the third bending part 118*o*2 of the second root section 118.

Specifically, the feed section 114 is provided (i) in the protrusion part 117*o*11 of the first linear part 117*o*1 of the first root section 117 and (ii) in the middle part of the third bending part 118*o*2 of the second root section 118 which middle part is adjacent to the protrusion part 117*o*11 in the Y direction. The arrangement allows the feed line 121 to (i) extend in a crosswise direction of the sheet on which FIG. 2 is illustrated and to (ii) be connected with the feed section 114, i.e., to be connected with the first and second root sections 117 and 118.

When the feed line 121 is connected with the feed section 114, outer and inner electric conductors 122 and 123 of a coaxial cable serving as the feed line 121 supply power to the first and second root sections 117 and 118 of the antenna element 115 (i.e., the first protrusion part 117*o*11 of the first linear section 117*o*1 and the middle part of the third bending part 118*o*2), respectively. There is provided, above the protrusion part 118*o*11 of the fourth linear part 118*o*1, a sheathed part of the coaxial cable serving as the feed line 121. The sheathed part (i) is sheathed in an insulating jacket (i.e., a part where the outer electric conductor 122 is not exposed) and (ii) is adjacent to an exposed part where the outer electric conductor 122 is exposed.

The power is fed via the feed line 121 as follows. Specifically, in the feed section 114, (i) a signal, having a frequency which falls within a predetermined frequency band, is applied to the second root section 118 of the antenna element 115 via the inner electric conductor 123 of the coaxial cable serving as the feed line 121, and (ii) an earth electric potential is applied to the first root section 117 of the antenna element 115 via the outer electric conductor 122 of the coaxial cable.

In a case where the power is thus supplied between the first and second root sections 117 and 118 of the antenna element 115 in the feed section 114, it is necessary to carry out the impedance matching between feed line 121 and the feed section 114 so as to set a VSWR characteristic to a sufficiently good value.

In view of such a circumstance, the fourth linear part 118*o*1 of the second root section 118 of the antenna element 115 has the protrusion part 118*o*11 that (i) is located at an end part of the fourth linear part 118*o*1 and (ii) protrudes in the width direction of the fourth linear part 118*o*1 (in a lengthwise direction of the sheet on which FIG. 2 is illustrated, i.e., the X direction). The protrusion part 118*o*11 constitutes the foregoing inductance matching pattern 116 in the linear part 118*o*1. The inductance matching pattern 116 serves as an inductor for the impedance matching between the feed line 121 and the feed section 114. That is, the protrusion part 118*o*11 is provided in the linear part 118*o*1 of the second root section 118, and the feed line 121 is provided above the protrusion part 118*o*11. Further, a portion of the fourth linear part 118*o*1, in which portion (i) the feed line 121 and the fourth linear part 118*o*1 lying below the feed line 121 overlap each other and (ii) the protrusion part 118*o*11 is provided, serves as a wider width part having a line width wider than that of another portion that does not overlap the feed line 121. Note that it is necessary that the wider width part have a line width wider than that of a narrowest part of the intermediate section of the antenna element 115. That is, the "another portion that does not overlap the feed line 121" means a portion where its line width is narrowest in the intermediate section of the antenna element 115. Note also that it is preferable that the line width of the wider width part is at least 1.2 times as wide as a diameter of the feed line 121, but is not greater than 4.5 times as wide as the diameter of the feed line 121.

The first and second root sections 117 and 118 of the antenna element 115 are thus drawn out in the respective opposite directions, surround the feed section 114, and are connected with the first and second antenna sections 111 and 112 shown in FIG. 1, respectively.

With such an arrangement, the first and second root sections 117 and 118 of the antenna element 115 can be provided within a relatively small rectangular region. On this account, the arrangement contributes to compactness of a region in the vicinity of the feed section 114.

Note that modified examples corresponding to the constituents are, in some cases, shown in other drawings with reference to which descriptions are made below. The modified examples are given reference signs (reference numerals) which are obtained by adding alphabetical letters such as "a", "b", "c", and so on to the reference signs given to the corresponding constituents. This concurrently clarifies relationships between the modified examples and the corresponding constituents and suggests that the modified examples are derived from the corresponding constituents.

Modified Example 1

Figure 3:
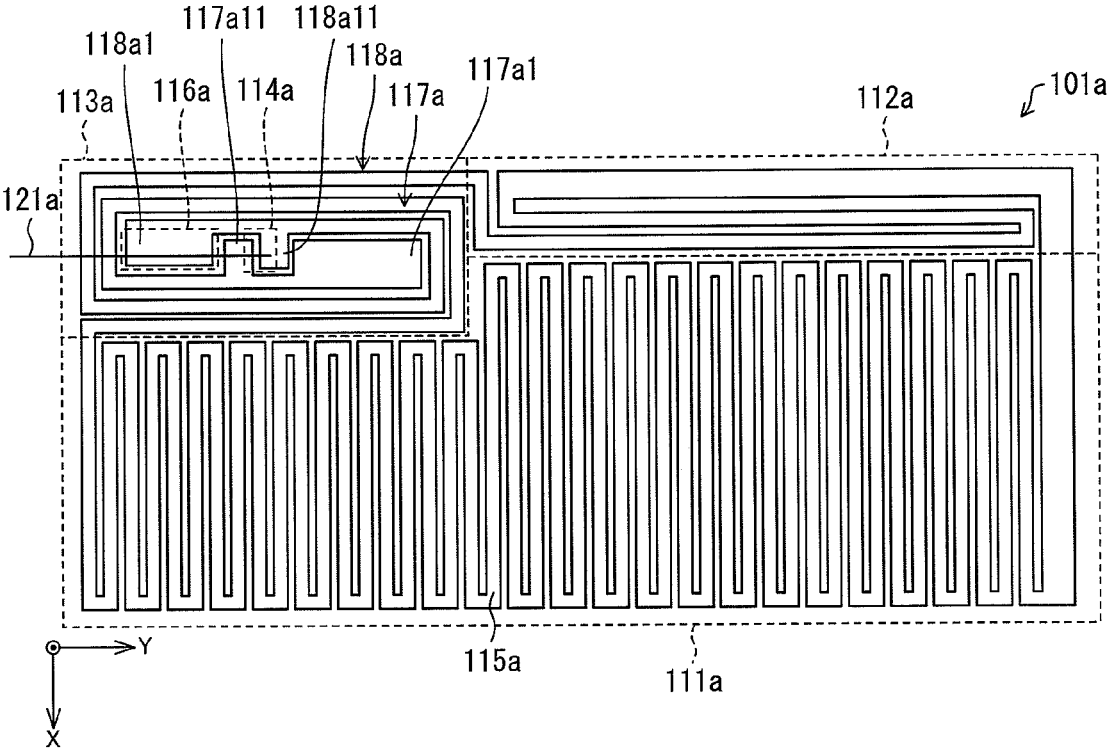
FIG. 3 is a plan view schematically illustrating a modified example of the antenna device in accordance with Embodiment 1 of the present invention.

FIG. 3 illustrates an antenna device 101*a*, which is a modified example of the antenna device 101.

According also to an antenna element 115*a*, a part of an intermediate section constitutes a first antenna section 111*a* and the other part of the intermediate section constitutes a second antenna section 112*a*, while two root sections 117*a* and 118*a* of the antenna element 115*a* constitute a wind section (first region) 113*a*.

The part of the intermediate section of the antenna element 115*a* has, in the first antenna section 111*a*, a meander shape made up of at least one return pattern. A return direction of the at least one return pattern in the meander shape is perpendicular to a direction in which the first root section 117*a* of the antenna element 115*a* is drawn out in the wind section 113*a*.

The other part of the intermediate section of the antenna element 115*a* also has a meander shape in the second antenna section 112*a*. The meander shape extends in parallel with a direction in which the second root section 118*a* of the antenna element 115*a* is drawn out in the wind section 113*a*.

One root section of the antenna element 115*a* has first through third linear parts. The first linear part extends, from one end part of the antenna element 115*a*, in a leftward direction of a sheet on which FIG. 3 is illustrated (i.e., in the negative direction of the Y axis). The second linear part is connected with the first linear part via a first bending part extending in an upward direction of the sheet (i.e., in the negative direction of the X axis) and extends, from the first bending part, in a rightward direction of the sheet (i.e., in the positive direction of the Y axis). The third linear part is connected with the second linear part via a second bending part extending in a downward direction of the sheet (i.e., in the positive direction of the X axis) and extends, from the second bending part, in the leftward direction of the sheet (i.e., in the negative direction of the Y axis).

This arrangement can also be described as follows. The first root section 117*a* of the antenna element 115*a* has a first linear part 117*a*1, a second linear part and a third linear part, and first and second bending parts. The first linear part 117*a*1 extends, in the leftward direction of the sheet on which FIG. 3 is illustrated (i.e., the negative direction of the Y axis), from the one end part of the antenna element 115*a*. The first bending part extends in the upward direction of the sheet (i.e., the negative direction of the X axis) from an end part of the first linear part 117*a*1. The second linear part extends in the rightward direction of the sheet (i.e., the positive direction of the Y axis) from an end part of the first bending part. The second bending part extends in the downward direction of the sheet (i.e., the positive direction of the X axis) from an end part of the second linear part. The third linear part (tail end linear part) extends in the leftward direction of the sheet (i.e., the negative direction of the Y axis) from an end part of the second bending part.

On the other hand, the other root section of the antenna element 115*a* has fourth through sixth linear parts. The fourth linear part extends, from the other end part of the antenna element 115*a*, in the rightward direction of the sheet on which FIG. 3 is illustrated (i.e., in the positive direction of the Y axis). The fifth linear part is connected with the fourth linear part via a third bending part extending in the downward direction of the sheet (i.e., in the positive direction of the X axis) and extends, from the third bending part, in the leftward direction of the sheet (i.e., in the negative direction of the Y axis). The sixth linear part is connected with the fifth linear part via a fourth bending part extending in the upward direction of the sheet (i.e., in the negative direction of the X axis) and extends, from the fourth bending part, in the rightward direction of the sheet (i.e., in the positive direction of the Y axis).

This arrangement can also be described as follows. The second root section 118*a* of the antenna element 115*a* has a fourth linear part 118*a*1, a fifth linear part and a sixth linear part, and third and fourth bending parts. The fourth linear part 118*a*1 extends, in the rightward direction of the sheet on which FIG. 3 is illustrated (i.e., the positive direction of the Y axis), from the other end part of the antenna element 115*a*. The third bending part extends in the downward direction of the sheet (i.e., the positive direction of the X axis) from an end part of the fourth linear part 118*a*1. The fifth linear part extends in the leftward direction of the sheet (i.e., the negative direction of the Y axis) from an end part of the third bending part. The fourth bending part extends in the upward direction of the sheet (i.e., the negative direction of the X axis) from an end part of the fifth linear part. The sixth linear part (tail end linear part) extends in the rightward direction of the sheet (i.e., the positive direction of the Y axis) from an end part of the fourth bending part.

The first root section 117*a* of the antenna element 115*a* receives power via a feed section 114*a*, which is provided in a middle part of the first linear part 117*a*1 of the first root section 117*a*. The second root section 118*a* of the antenna element 115*a* receives power also via the feed section 114*a*, which is provided in a middle part of the fourth linear part 118*a*1 of the second root section 118*a*.

In particular, in the feed section 114*a*, the first linear part 117*a*1 of the first root section 117*a* of the antenna element 115*a* has, in the middle part thereof, a protrusion part 117*a*11 which protrudes in a width direction of the first linear part 117*a*1 (in a lengthwise direction of the sheet on which FIG. 3 is illustrated, the X axis direction, the direction toward the fourth linear part 118*a*1). Further, the fourth linear part 118*a*1 of the second root section 118*a* of the antenna element 115*a* also has, in the middle part thereof, a protrusion part 118*a*11 which protrudes in the width direction of the fourth linear part 118*a*1 (in the lengthwise direction of the sheet, the X axis direction, the direction toward the first linear part 117*a*1). Further, the protrusion parts 117*a*11 and 118*a*11 of the respective two root sections 117*a* and 118*a* are arranged so as to adjacent to each other in the crosswise direction of the sheet on which FIG. 3 is illustrated (i.e., the Y axis direction, the direction in which the feed line 121*a* extends).

Such an arrangement allows the feed line 121*a* to (a) extend in the crosswise direction of the sheet on which FIG. 3 is illustrated (i.e., the Y axis direction) and to (b) be connected with the feed section 114.

It should be noted that, according to an example shown FIG. 3, a sheathed part, of the feed line 121*a*, which is sheathed in an insulating jacket is provided in the fourth linear part 118*a*1 of the second root section 118*a*. A portion of the fourth linear part 118*a*1, in which portion the sheathed part is provided, is caused to serve as a wider width part. This wider width part constitutes an inductance matching pattern 116*a*.

Modified Example 2

Figure 4:
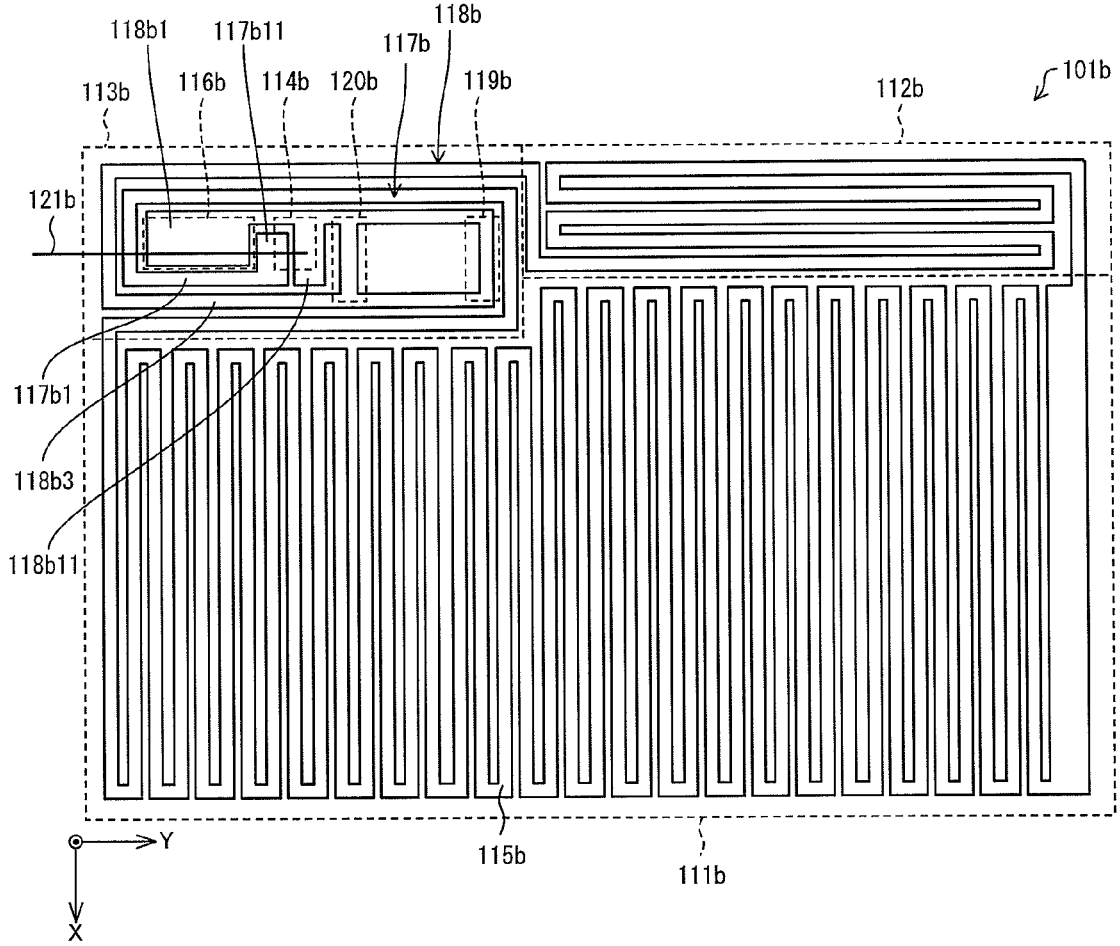
FIG. 4 is a plan view schematically illustrating a modified example of the antenna device in accordance with Embodiment 1 of the present invention.

FIG. 4 illustrates an antenna device 101*b*, which is a modified example of the antenna device 101.

According to an antenna element 115*b*, a part of an intermediate section of the antenna element 115*b* constitutes a first antenna section 111*b* and the other part of the intermediate section constitutes a second antenna section 112*b*, while two root sections 117*b* and 118*b* of the antenna element 115*b* constitute a wind section (first region) 113*b*. The first antenna section 111*b* has a meander shape, and the second antenna section 112*b* also has a meander shape.

One root section of the antenna element 115*b* has first through third linear parts. The first linear part extends, from one end part of the antenna element 115*b*, in a leftward direction of a sheet on which FIG. 4 is illustrated (i.e., in the negative direction of the Y axis). The second linear part is connected with the first linear part via a first bending part extending in an upward direction of the sheet (i.e., in the negative direction of the X axis) and extends, from the first bending part, in a rightward direction of the sheet (i.e., in the positive direction of the Y axis). The third linear part is connected with the second linear part via a second bending part extending in a downward direction of the sheet (i.e., in the positive direction of the X axis) and extends, from the second bending part, in the leftward direction of the sheet (i.e., in the negative direction of the Y axis).

This arrangement can also be described as follows. The first root section 117*b* of the antenna element 115*b* has a first linear part 117*b*1, a second linear part and a third linear part, and first and second bending part. The first linear part 117*b*1 extends, in the leftward direction of the sheet on which FIG. 4 is illustrated (i.e., the negative direction of the Y axis), from the one end of the antenna element 115*b*. The first bending part extends in the upward direction of the sheet (i.e., the negative direction of the X axis) from an end part of the first linear part 117*b*1. The second linear part extends in the rightward direction of the sheet (i.e., the positive direction of the Y axis) from an end part of the first bending part. The second bending part extends in the downward direction of the sheet (i.e., the positive direction of the X axis) from an end part of the second linear part. The third linear part (tail end linear part) extends in the leftward direction of the sheet (i.e., the negative direction of the Y axis) from an end part of the second bending part.

On the other hand, the other root section of the antenna element 115*b* has fourth through sixth linear parts. The fourth linear part extends, from the other end of the antenna element 115*b*, in the rightward direction of the sheet on which FIG. 4 is illustrated (i.e., in the positive direction of the Y axis). The fifth linear part is connected with the fourth linear part via a third bending part 119*b* extending in the downward direction of the sheet (i.e., in the positive direction of the X axis) and extends, from the third bending part, in the leftward direction of the sheet (i.e., in the negative direction of the Y axis). The sixth linear part is connected with the fifth linear part via a fourth bending part extending in the upward direction of the sheet (i.e., in the negative direction of the X axis) and extends, from the fourth bending part, in the rightward direction of the sheet (i.e., in the positive direction of the Y axis).

This arrangement can also be described as follows. The second root section 118*b* of the antenna element 115*b* has a fourth linear part 118*b*1, a fifth linear part 118*b*3 and a sixth linear part and a third bending part 119*b* and a fourth bending part. The fourth linear part 118*b*1 extends, in the rightward direction of the sheet on which FIG. 4 is illustrated (i.e., the positive direction of the Y axis), from the other end part of the antenna element 115*b*. The third bending part 119*b* extends in the downward direction of the sheet (i.e., the positive direction of the X axis) from an end part of the fourth linear part 118*b*1. The fifth linear part 118*b*3 extends in the leftward direction of the sheet (i.e., the negative direction of the Y axis) from an end part of the third bending part 119*b*. The fourth bending part extends in the upward direction of the sheet (i.e., the negative direction of the X axis) from an end part of the fifth linear part 118*b*3. The sixth linear part (tail end linear part) extends in the rightward direction of the sheet (i.e., the positive direction of the Y axis) from an end part of the fourth bending part.

The second root section 118*b* of the antenna element 115*b* further has a seventh linear part 120*b* which extends in the lengthwise direction of the sheet on which FIG. 4 is illustrated (i.e., the X axis direction). The seventh linear part 120*b* is connected to a portion, in the vicinity of a middle part, of each of the fourth and fifth linear parts 118*b*1 and 118*b*3.

As described above, in the second root section 118*b* of the antenna element 115*b*, the fourth linear part 118*b*1 and the fifth linear part 118*b*3 are connected to each other via both the third bending part 119*b* and the seventh linear part 120*b* (see FIG. 4). In this way, the number of current paths in the second root section 118*b* of the antenna element 115*b* is increased, thereby the number of resonance points is increased. This achieves an antenna device 101*b* which expands a usable band.

The first root section 117*b* of the antenna element 115*b* receives power via a feed section 114*b* that is provided in an end part of the first root section 117*b*. On the other hand, the second root section 118*b* of the antenna element 115*b* receives power via the feed section 114*b* which is provided not in an end part of the second root section 118*b* but in a middle part of the first linear part of the second root section 118*b*.

In particular, in the feed section 114*b*, the first root section 117*b* of the antenna element 115*b* has a protrusion part 117*b*11 that is located at the end part of the first linear part 117*b* and protrudes in the width direction of the first linear part 117*b*1 (i.e., the lengthwise direction in FIG. 4, the direction toward the fourth linear part 118*b*1). Further, the second root section 118*b* of the antenna element 115*b* has a protrusion part 118*b*11 that is located in the middle part of the fourth linear part 118*b*1 and protrudes in the width direction of the fourth linear part 118*b*1 (the lengthwise direction in FIG. 4, the direction toward the linear part 117*b*1).

Further, the protrusion parts 117*b*11 and 118*b*11 of the respective two root sections 117*b* and 118*b* are arranged so as to be adjacent to each other in the crosswise direction of the sheet on which FIG. 4 is illustrated (i.e., the direction in which the feed line 121*b* extends). This allows the feed line 121*b* to (i) extend in the crosswise direction of the sheet and to (ii) be connected with the feed section 114*b*.

It should be noted that, according to an example shown in FIG. 4, a sheathed part, of the feed line 121*b*, which is sheathed in an insulating jacket is provided in the fourth linear part 118*a*1 of the second root section 118*b*. A portion of the fourth linear part 118*a*1, in which portion the sheathed part is provided, is caused to serve as a wider width part. This wider width part constitutes an inductance matching pattern 116*b*.

Modified Example 3

Figure 5:
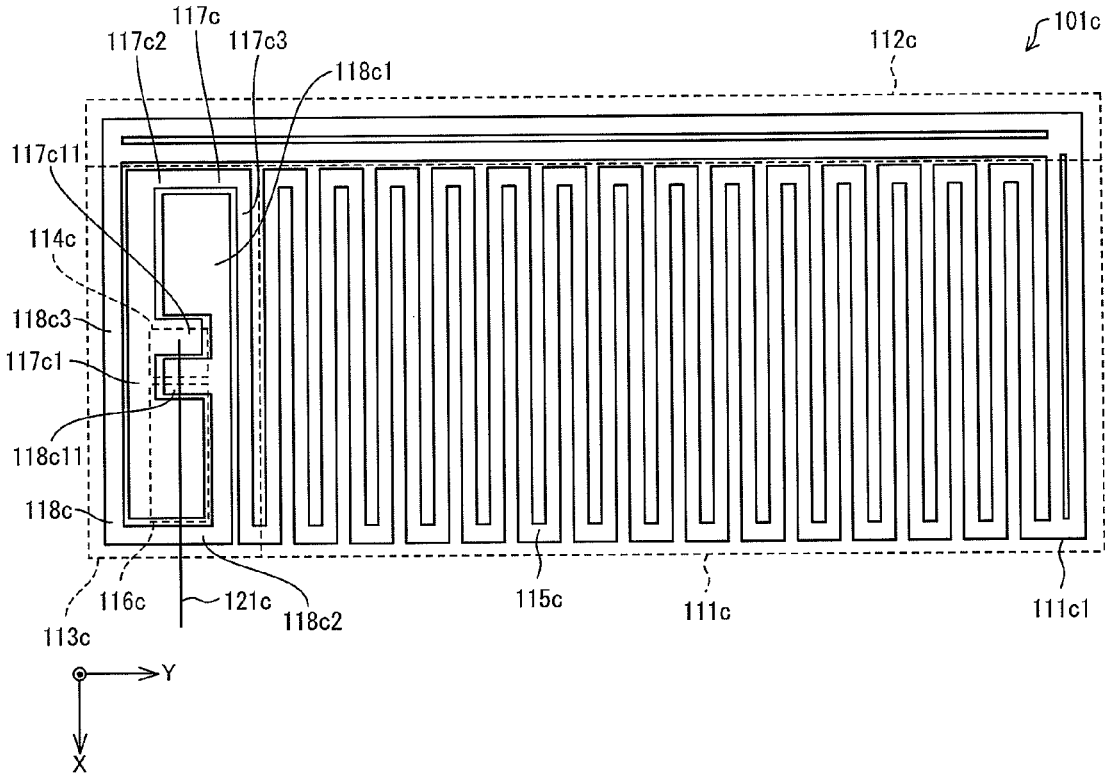
FIG. 5 is a plan view schematically illustrating a modified example of the antenna device in accordance with Embodiment 1 of the present invention.

FIG. 5 illustrates an antenna device 101*c*, which is a modified example of the antenna device 101.

A first antenna section 111*c* has a meander shape, and a second antenna section 112*c* has a linear shape.

In particular, the second antenna section 112*c* is constituted by two adjacent straight paths, in which one end parts of the respective two straight paths are connected to each other and the other end parts of the respective two straight paths are connected to each other. That is, the two straight paths are connected in parallel to each other.

Further, the first antenna section 111*c* has two straight paths 111*c*1, which are connected to the two straight paths constituting the second antenna section 112*c*. The two straight paths 111*c*1 of the first antenna section 111*c* are also connected such that one end parts of the respective two straight paths 111*c*1 are connected to each other and the other end parts of the respective two straight paths 111*c*1 are connected to each other. That is, the two straight paths 111*c*1 are connected in parallel to each other.

According to a wind section (first region) 113*c*, a first root section 117*c* of the antenna element 115*c* is drawn out in a downward direction of a sheet on which FIG. 5 is illustrated (i.e., positive direction of the X axis), and a second root section 118*c* of the antenna element 115*c* is drawn out in an upward direction of the sheet (i.e., negative direction of the X axis). That is, the two root sections 117*c* and 118*c* are drawn out in respective opposite directions.

Further, the two root sections 117*c* and 118*c* of the antenna element 115*c* are drawn out in the following directions. That is, the first root section 117*c* of the antenna element 115*c* is drawn out in a direction in which a feed line 121*c* extends, i.e., the same direction as the downward direction of the sheet on which FIG. 5 is illustrated (i.e., the positive direction of the X axis), and the second root section 118*c* of the antenna element 115*c* is drawn out in a direction that is opposite to the direction in which the feed line 121*c* extends (i.e., the downward direction of the sheet on which FIG. 5 is illustrated, the positive direction of the X axis).

Specifically, according to the wind section 113*c*, a direction in which the first root section 117*c* extends is changed from a direction (i) to a direction (iii) in this order: (i) an upward direction (i.e., the negative direction of the X axis) of the sheet on which FIG. 5 is illustrated, (ii) a rightward direction (i.e., the positive direction of the Y axis) of the sheet and (iii) a downward direction (i.e., the positive direction of the X axis, the drawing direction) of the sheet. On the other hand, a direction in which the second root section 118 extends is changed from a direction (iv) to a direction (vi) in this order: (iv) the downward direction (i.e. the positive direction of the X axis) of the sheet, (v) the leftward direction (i.e., the negative direction of the Y axis) of the sheet, and (vi) the upward direction (i.e., the negative direction of the X axis, the drawing direction) of the sheet.

That is, according to the wind section 113*c*, both of the directions in which the respective two root sections 117*c* and 118*c* extend are rotated by 180 degrees so as to surround a feed section 114*c*. With such an arrangement in which the feed section 114*c* is surrounded, the antenna device 101*c* can realize a radiant gain of at least 1 dBi in a band of 470 MHz to 860 MHz.

In particular, the first root section 117*c* of the antenna element 115*c* has a first linear part 117*c*1, a first bending part 117*c*2 and a second linear part 117*c*3. The first linear part 117*c*1 extends, from one end part of the antenna element 115*c*, in an upward direction of the sheet on which FIG. 5 is illustrated (i.e., the negative direction of the X axis). The first bending part 117*c*2 extends, from an end part of the first linear part 117*c*1, in a rightward direction of the sheet (i.e., the positive direction of the Y axis). The second linear part (tail end linear part) 117*c*3 extends, from an end part of the first bending part 117*c*2, in a downward direction of the sheet (i.e., the positive direction of the X axis).

That is, the first root section 117*c* of the antenna element 115*c* is arranged so as to be bent in a square U shape so that the first linear part 117*c*1 and the second linear part 117*c*3, which are adjacent to each other via the first bending part 117*c*2, are parallel to each other.

On the other hand, the second root section 118*c* of the antenna element 115*c* has a third linear part 118*c*1, a second bending part 118*c*2 and a fourth linear part 118*c*3. The third linear part 118*c*1 extends, from the other end part of the antenna element 115*c*, in the downward direction of the sheet on which FIG. 5 is illustrated (i.e., the positive direction of the X axis). The second bending part 118*c*2 extends, from an end part of the third linear part 118*c*1, in the leftward direction of the sheet (i.e., the negative direction of the Y axis). The fourth linear part (tail end linear part) 118*c*3 extends, from an end part of the second bending part 118*c*2, in the upward direction of the sheet (i.e., the negative direction of the X axis).

That is, the second root section 118*c* of the antenna element 115*c* is also arranged so as to be bent in a square U shape so that the third linear part 118*c*1 and the fourth linear part 118*c*3, which are adjacent to each other via the second bending part 118*c*2, are parallel to each other.

The first root section 117*c* of the antenna element 115*c* receive power via the feed section 114*c* that is provided in a middle part of the first linear part 117*c*1 of the first root section 117*c*. The second root section 118*c* of the antenna element 115*c* receives power also via the feed section 114*c* that is provided in a middle part of the third linear part 118*c*1 of the second root section 118*c*.

In particular, in the feed section 114*c*, the first root section 117*c* of the antenna element 115*c* has a protrusion part 117*c*11 that is located in the middle part of the first linear part 117*c*1 and protrudes in a width direction of the first linear part 117*c*1 (in a crosswise direction of the sheet on which FIG. 5 is illustrated, the Y axis direction, the direction toward the third linear part 118*c*1). Further, the second root section 118*c* of the antenna element 115*c* has a protrusion part 118*c*11 that is located in the middle part of the third linear part 118*c*1 and protrudes in a width direction of the third linear part 118*c*1 (in the crosswise direction of the sheet on which FIG. 5 is illustrated, the Y axis direction, the direction toward the first linear part 117*c*1). The protrusion parts 117*c*11 and 118*c*11 of the respective two root sections 117*c* and 118*c* are arranged so as to be adjacent to each other in the lengthwise direction of the sheet on which FIG. 5 is illustrated (i.e., the direction in which the feed line 121*c* extends). Such an arrangement allows the feed line 121*c* to (i) extend in the lengthwise direction of the sheet on which FIG. 5 is illustrated (i.e., the X axis direction) and to (ii) be connected with the feed section 114*c*.

It should be noted that, according to an example shown in FIG. 5, a sheathed part, of the feed line 121*c*, which is sheathed in an insulating jacket is provided in the first linear part 117*c*1 of the first root section 117*c*. A portion of the first linear part 117*c*1, in which portion the sheathed part is provided, is caused to serve as a wider width part. This wider width part constitutes an inductance matching pattern 116*c*.

Modified Example 4

Figure 6:
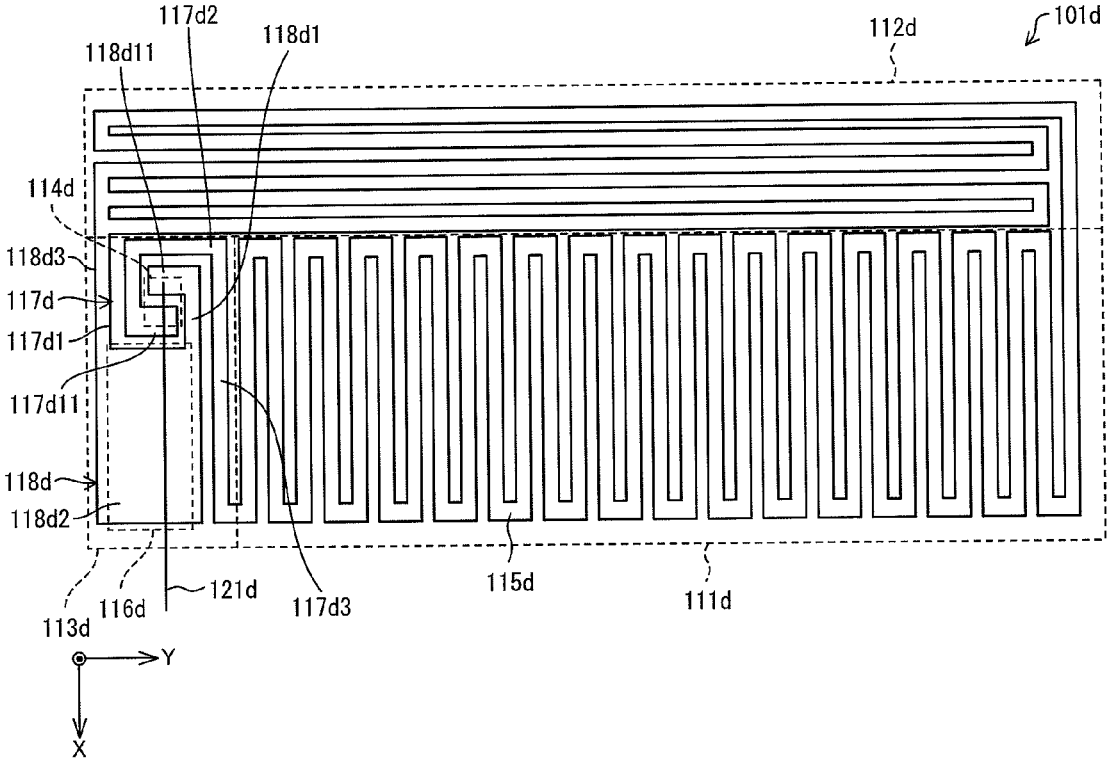
FIG. 6 is a plan view schematically illustrating a modified example of the antenna device in accordance with Embodiment 1 of the present invention.

FIG. 6 illustrates an antenna device 101*d*, which is a modified example of the antenna device 101.

According also to an antenna element 115*d*, a part of an intermediate section of the antenna element 115*d* constitutes a first antenna section 111*d* and the other part of the intermediate section constitutes a second antenna section 112*d*, while two root sections 117*d* and 118*d* of the antenna element 115*d* constitute a wind section (first region) 113*d*. The first antenna section 111*d* has a meander shape, and the second antenna section 112*d* also has a meander shape.

One root section of the antenna element 115*d* has first and second linear parts. The first linear part extends, from one end part of the antenna element 115*d*, in an upward direction of a sheet on which FIG. 6 is illustrated (i.e., the negative direction of the X axis). The second linear part is connected with the first linear part via a first bending part extending in a rightward direction of the sheet (i.e., in the positive direction of the Y axis) and extends, from the first bending part, in a downward direction of the sheet (i.e., in the positive direction of the X axis).

This arrangement can also be described as follows. The first root section 117*d* of the antenna element 115*d* has first and second linear parts 117*d*1 and 117*d*3 and a first bending part 117*d*2. The first linear part 117*d*1 extends, in the upward direction of the sheet on which FIG. 6 is illustrated (i.e., the negative direction of the X axis), from one end part of the antenna element 115*d*. The first bending part 117*d*2 extends, in the rightward direction of the sheet (i.e., the positive direction of the Y axis), from an end part of the first linear part 117*d*1. The second linear part (tail end linear part) 117*d*3 extends in the downward direction of the sheet (i.e., the positive direction of the X axis) from an end part of the first bending part 117*d*2.

On the other hand, the other root section of the antenna element 115*d* has third and fourth linear parts. The third linear part extends, from the other end part of the antenna element 115*d*, in the downward direction of the sheet on which FIG. 6 is illustrated (i.e., the positive direction of the X axis). The fourth linear part is connected with the third linear part via a second bending part extending in the leftward direction of the sheet (i.e., in the negative direction of the Y axis) and extends, from the second bending part, in the upward direction of the sheet (i.e., in the negative direction of the X axis).

This arrangement can also be described as follows. The second root section 118*d* of the antenna element 115*d* has third and fourth linear parts 118*d*1 and 118*d*3, and a second bending part 118*d*2. The third linear part 118*d*1 extends, in the downward direction of the sheet on which FIG. 6 is illustrated (i.e., the positive direction of the X axis), from the other end part of the antenna element 115*d*. The second bending part 118*d*2 extends in the leftward direction of the sheet (i.e., the negative direction of the Y axis) from an end part of the third linear part 118*d*1. The fourth linear part (tail end linear part) 118*d*3 extends in the upward direction of the sheet (i.e., the negative direction of the X axis) from an end part of the second bending part 118*d*2.

The first root section 117*d* of the antenna element 115*d* receives power via a feed section 114*d* that is provided in an end part of the first root section 117*d*. The second root section 118*d* of the antenna element 115*d* receives power also via the feed section 114*d* that is provided in an end part of the second root section 118*d*.

In particular, in the feed section 114*d*, the first root section 117*d* of the antenna element 115*d* has a protrusion part 117*d*11 that is located in the first linear part 117*d*1 and protrudes in a width direction of the first linear part 117*d*1 (i.e., in a crosswise direction of the sheet on which FIG. 6 is illustrated, the Y axis direction, the direction toward the third linear part 118*d*1). Further, the second root section 118*d* of the antenna element 115*d* also has a protrusion part 118*d*11 that is located in the third linear part 118*d*1 and protrudes in the width direction of the third linear part 118*d*1 (i.e., in the crosswise direction of the sheet on which FIG. 6 is illustrated, the Y axis direction, the direction toward the first linear part 117*d*1). The protrusion parts 117*d*11 and 118*d*11 of the respective two root sections 117*d* and 118*d* are arranged so as to be adjacent to each other in the lengthwise direction of the sheet on which FIG. 6 is illustrated (i.e., the X axis direction, the direction in which a feed line 121*d* extends). Such an arrangement allows the feed line 121*d* to (i) extend in the lengthwise direction of the sheet on which FIG. 6 is illustrated (i.e., the X axis direction) and to (ii) be connected with the feed section 114*d*.

Further, the second bending part 118*d*2 of the second root section 118*d* of the antenna element 115*d* is caused to serve as a wider width part. This wider width part constitutes an inductance matching pattern 116*d*. Such an arrangement makes it possible to reduce the length of the second root section 118 of the antenna element 115*d* as compared to that shown in FIG. 5, and thus possible to provide the second root section 118 in a relatively small region. That is, such an arrangement contributes to compactness of the wind section 113*d*.

(Radiation Directivity and VSWR Characteristic)

The following description discusses a radiation directivity and a VSWR characteristic of an antenna device in accordance with Embodiment 1 of the present invention.

The following are outlines of the steps of measuring radiation directivities and VSWR characteristics.

(1) Measure a VSWR of an antenna with a cable.

(2) Measure radiant power of the antenna with a cable.

(3) Calculate a radiation characteristic of the antenna with a cable.

(4) If necessary, measure a VSWR of an antenna with no cable.

(5) Measure a loss for a cable.

(6) Calculate a radiation characteristic of the antenna with no cable.

The following are mathematical formulae used in the measuring steps and variables in these formulae.

[Math. 1]

$$D_m^C = \frac{1-|\Gamma_s|^2}{1-|\Gamma_m^C|^2}\frac{P_m^C}{P_s}D_s,\ |\Gamma_m^C| = \frac{VSWR^C-1}{VSWR^C+1}$$

$$D_m^A = \frac{1}{\alpha}\frac{1-|\Gamma_s|^2}{1-|\Gamma_m^A|^2}\frac{P_m^C}{P_s}D_s,\ |\Gamma_m^A| = \frac{VSWR^A-1}{VSWR^A+1},\ \alpha = 10^{\left(\frac{\alpha_{dB}}{10}\right)}$$

[Math. 2]

$VSWR^C$: VSWR of antenna with cable $VSWR^A$: VSWR of antenna with no cable $\alpha_{dB}$: Loss dB for cable (≥0)

$D_m^C$: Directivity gain of antenna with cable $D_m^A$: Directivity gain of antenna with no cable $D_s$: Gain of normal antenna $P_m^C$: Radiant power of antenna with cable $P_s$: Radiant power of normal antenna $\Gamma_m^C$: Amplitude reflection coefficient of antenna with cable $\Gamma_m^A$: Amplitude reflection coefficient of antenna with no cable $\Gamma_s$: Reflection coefficient of normal antenna $\alpha$: Power loss for cable (≤1)

The following description discusses, by taking as an example the antenna device 101*a* of Modified example 1 shown in FIG. 3, the radiation directivity and VSWR characteristic of the antenna device in accordance with Embodiment 1 of the present invention.

As is clear from illustration, an xy plane, a yz plane and a zx plane are configured for the antenna device 101*a* shown in FIG. 3.

Figures 7, 8:
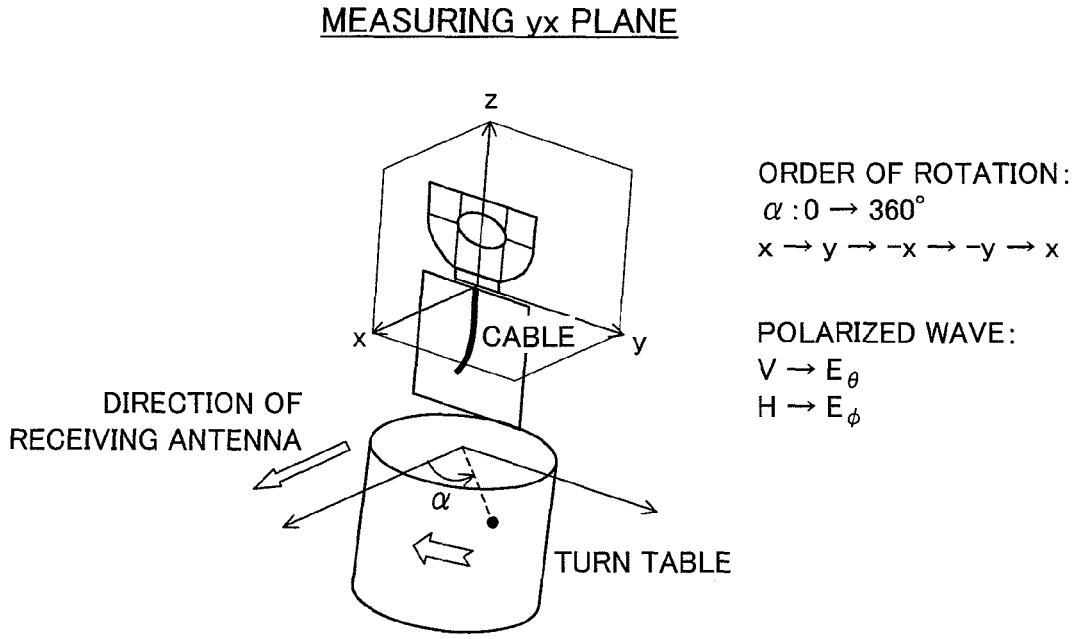
FIG. 7 is a view for describing how to measure radiation directivity of an antenna.
FIG. 8 is a view for describing how to measure radiation directivity of an antenna.

For example, as illustrated in FIGS. 7 and 8, in a case of the xy plane, the radiant power of an antenna may be measured (the foregoing step (2)) in such a manner that a rotation angle α of a turn table is changed from 0 degrees to 360 degrees so that a measuring receiving antenna placed on the turn table faces in a positive direction of the X axis, a positive direction of the Y axis, a negative direction of the X axis, a negative direction of the Y axis, and the positive direction of the X axis, in this order. It should be noted that the antenna device 101*a* is placed in a position that is pointed at by the arrow of the "DIRECTION OF RECEIVING ANTENNA" shown in FIG. 8 at a predetermined distance (e.g., 3 m).

While the rotation angle α is being changed, a vertically-polarized wave V and a horizontally-polarized wave H indicative of the radiant power of the antenna are measured, and a radiation characteristic in each direction in which the receiving antenna faces is calculated from the measurement results.

Figure 9:
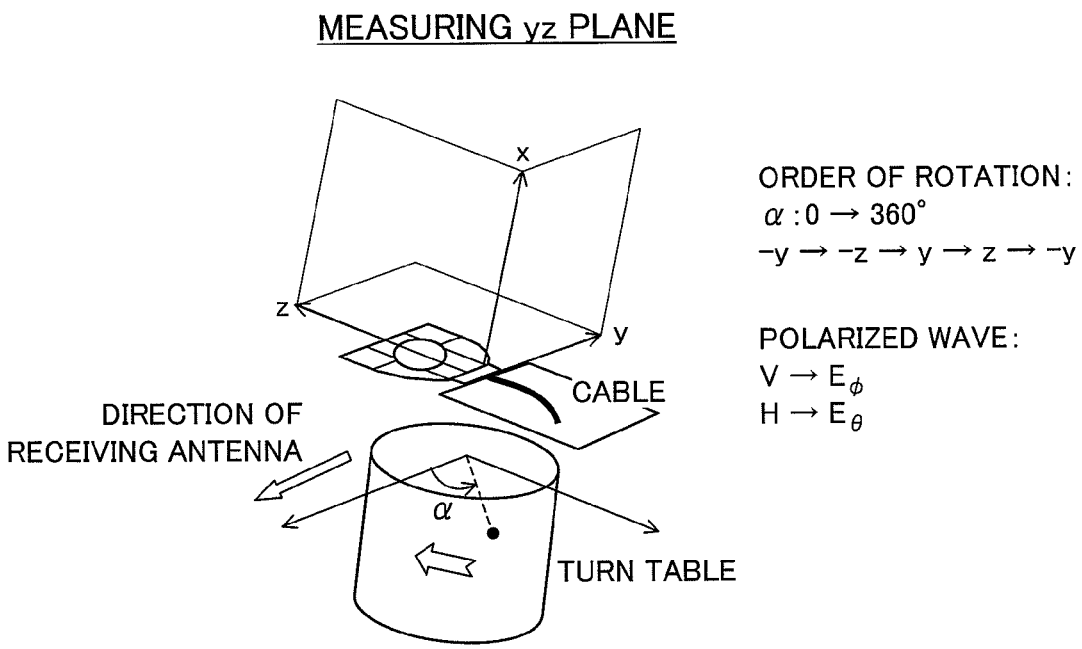
FIG. 9 is a view for describing how to measure radiation directivity of an antenna.
Figure 10:
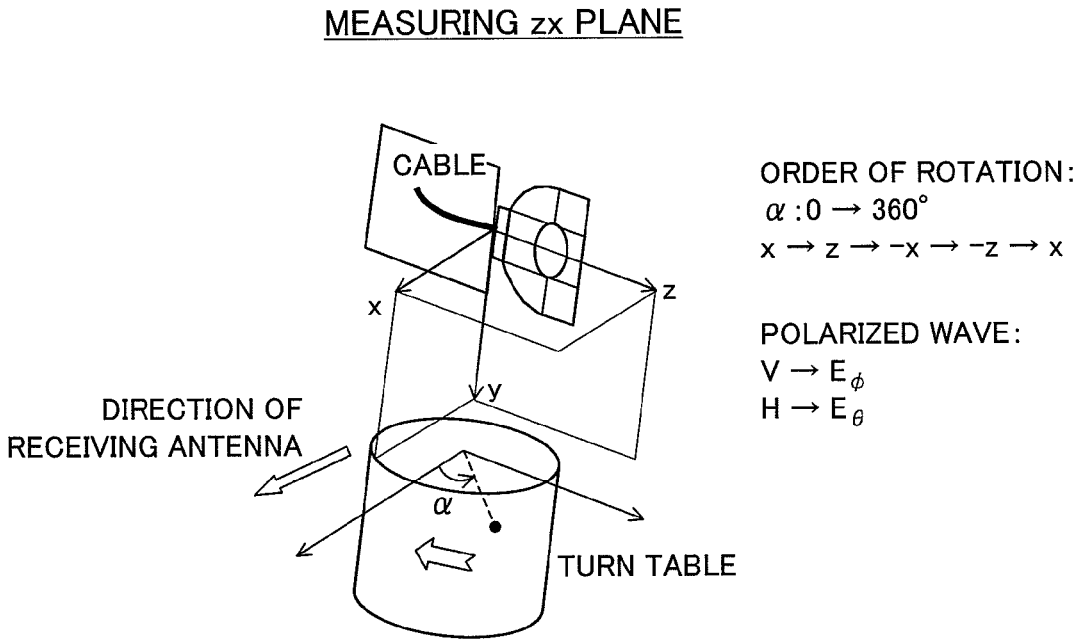
FIG. 10 is a view for describing how to measure radiation directivity of an antenna.

As illustrated in FIGS. 7, 9 and 10, the radiation characteristic in the yz plane and the zx plane are measured in the same manner as above.

Figure 11:
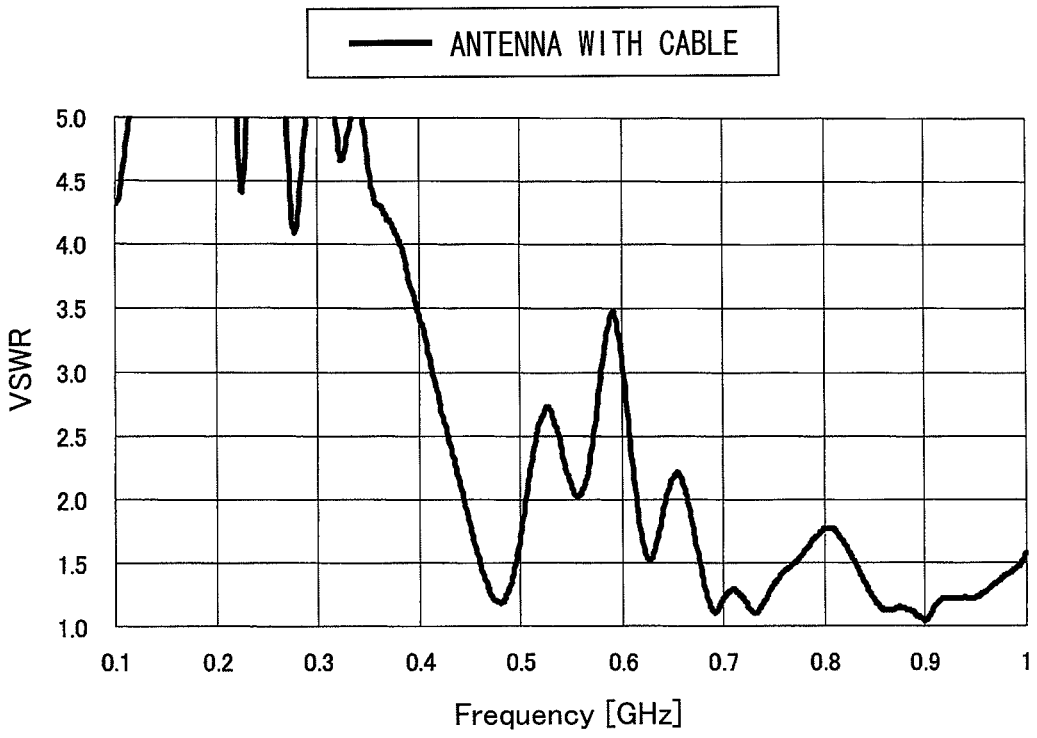
FIG. 11 is a graph illustrating a VSWR characteristic of the antenna device shown in FIG. 3.
Figure 12:
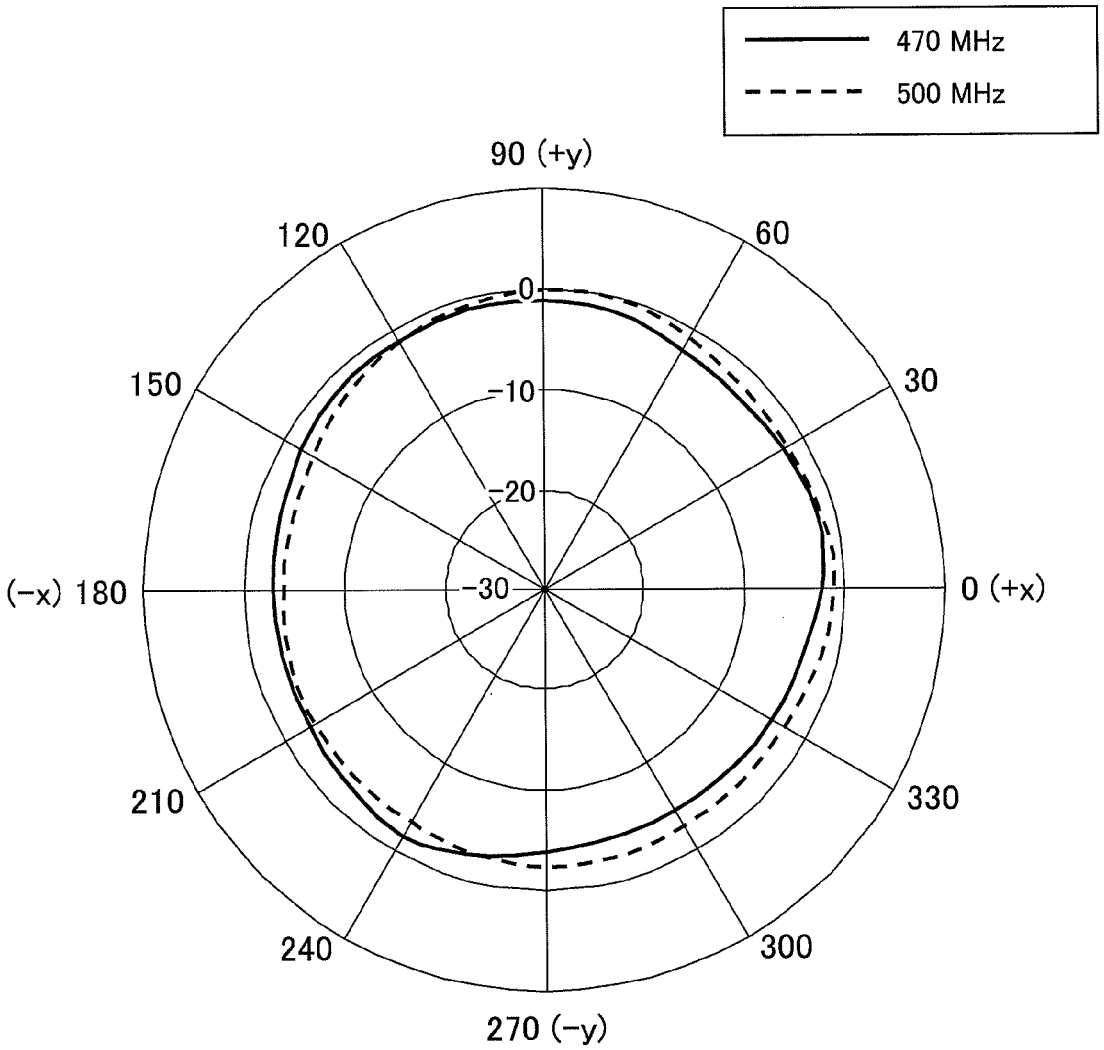
FIG. 12 is a graph illustrating a radiation pattern of the antenna device shown in FIG. 3.

FIG. 11 is a graph illustrating the VSWR characteristic of the antenna device 101*a* shown in FIG. 3. FIG. 12 is a graph illustrating radiation patterns in a 470 MHz band and in a 500 MHz band, respectively, of the antenna device 101*a* shown in FIG. 3. It should be noted that FIG. 12 illustrates an in-yx-plane radiation pattern.

As is clear from FIG. 11, it is possible to prevent the VSWR from being greater than 3.5 in a band of 500 MHz or greater, out of the terrestrial digital television band (470 MHz to 900 MHz).

Further, as is clear from FIG. 12, a non-directivity radiation characteristic is achieved in both the 470 MHz band and 500 MHz band.

Embodiment 2

The following description discusses Embodiment 2 of the present invention. The present embodiment is different from the antenna devices 101 to 101*d* of Embodiment 1 in that one of or a plurality of short-circuit material(s) (short-circuit section(s)) for causing a short-circuit is/are provided in the meander shape (meander-shaped part) of the first antenna section (111 to 111*d*) and/or in the meander shape of the second antenna section (112 to 112*d*). It should be noted that the short-circuit material is not limited to an independently provided member, and therefore may be for example made, concurrently with the electrically conductive path constituting the antenna element, from the same material as that of the electrically conductive path.

Figure 13:
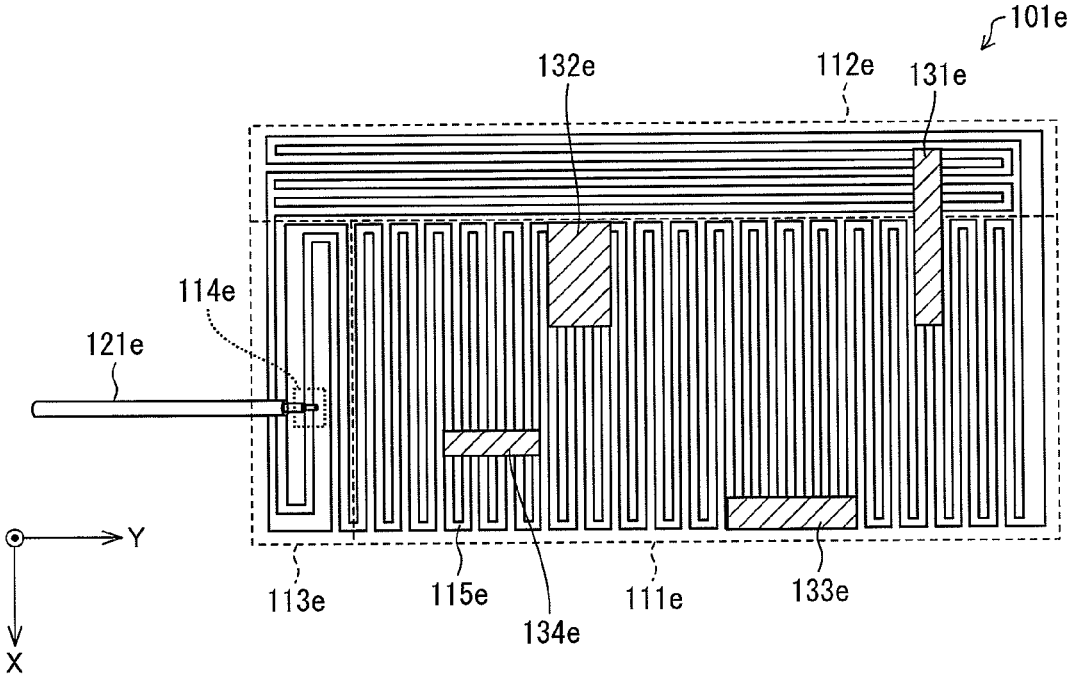
FIG. 13 is a plan view schematically illustrating a configuration of an example for comparison with an antenna device in accordance with Embodiment 2 of the present invention.
Figure 14:
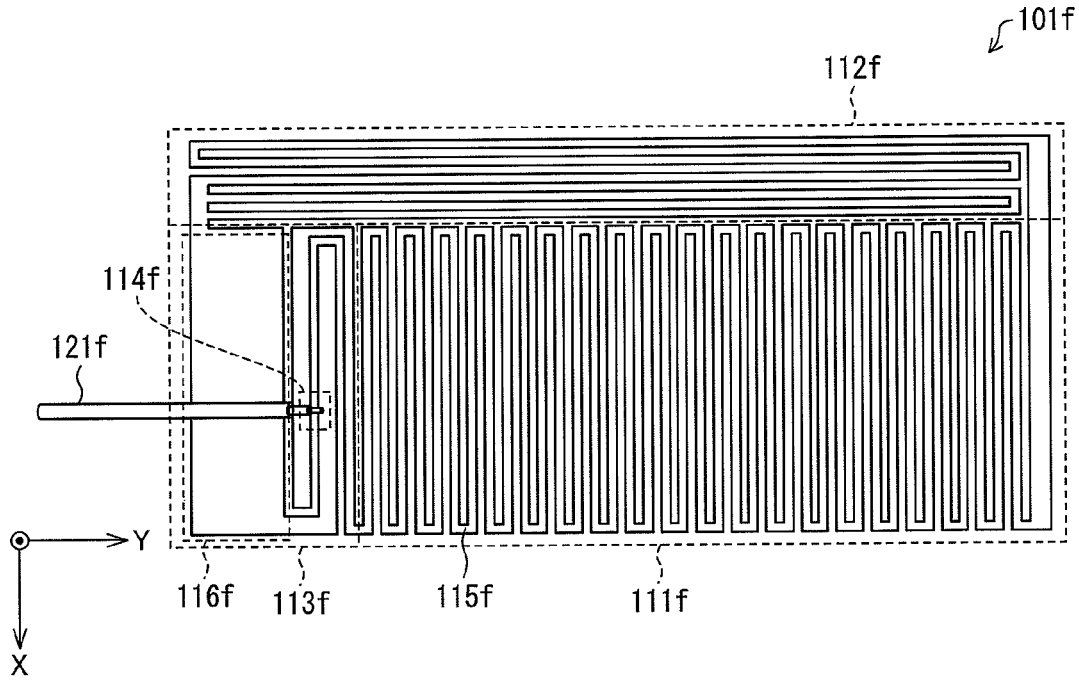
FIG. 14 is a plan view schematically illustrating a configuration of an example for comparison with the antenna device in accordance with Embodiment 2 of the present invention.
Figure 15:
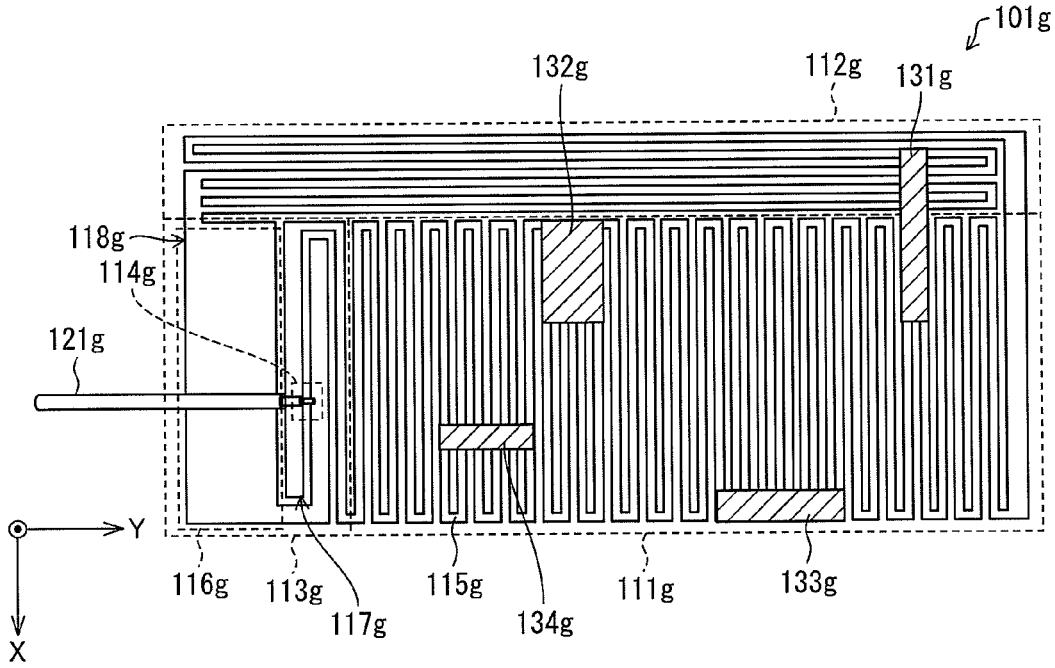
FIG. 15 is a plan view schematically illustrating a configuration of the antenna device in accordance with Embodiment 2 of the present invention.

FIGS. 13 to 15 are views for describing Embodiment 2 of the present invention. FIG. 13 illustrates an example of an antenna device in accordance with Embodiment 2 of the present invention, from which an inductance matching pattern has been removed. FIG. 14 illustrates an example of the antenna device in accordance with Embodiment 2 of the present invention, from which short-circuit materials have been removed. FIG. 15 is a plan view schematically illustrating a configuration of the antenna device in accordance with Embodiment 2 of the present invention. It should be noted that the reference sign 116*f* in FIG. 14 and the reference sign 116*g* in FIG. 15 each indicate an inductance matching pattern.

As illustrated in FIG. 15, according to an antenna device 101*g* in accordance with Embodiment 2 of the present invention, a part of an intermediate section of an antenna element 115*g* constitutes a first antenna section 111*g* and the other part of the intermediate section constitutes a second antenna section 112*g*, while two root sections 117*g* and 118*g* of the antenna element 115*g* constitute a wind section (first region) 113*g*.

The part of the intermediate section of the antenna element 115*g* has, in the first antenna section 111*g*, a meander shape made up of at least one return pattern. A return direction of the at least one return pattern in the meander shape is parallel to the direction in which the first root section 117*g* of the antenna element 115*g* is drawn out in the wind section 113*g*.

The other part of the intermediate section of the antenna element 115*g* also has a meander shape in the second antenna section 112*g*. A return direction of the return pattern in the meaner shape is perpendicular to a direction in which the second root section 118*g* of the antenna element 115*g* is drawn out in the wind section 113*g*.

In the meander shape of the first antenna section 111*g*, there are provided short-circuit materials 131*g*, 132*g*, 133*g* and 134*g*. Further, in the meander shape of the second antenna section 112*g*, the short-circuit material 131*g* is provided.

A position and a portion in which such short-circuit materials 131*g* to 134*g* are to be provided are determined in the following manner.

That is, a position and a portion in which the short-circuit materials 131*g* to 134*g* are to be provided are determined so that (i) the number of resonance points in the antenna element 115*g* is increased and (ii) the VSWR characteristics of the two root sections 117*g* and 118*g* of the antenna element 115*g* in a feed section 114*g* become stable.

This makes it possible to improve a non-directivity radiation characteristic for each radio wave in both cases where the antenna element 115*g* transmits/receives radio wave in a VHF band side and where the antenna element 115*g* transmits/receives radio wave in a UHF band side.

According to an example shown in FIG. 15, the short-circuit materials 131*g* to 134*g* are provided both in the meander shape of the first antenna section 111*g* and in the meander shape of the second antenna section 112*g*. Note however that, needless to say, the short-circuit materials 131*g* to 134*g* may be provided only in the meander shape of the first antenna section 111*g* or only in the meander shape of the second antenna section 112*g*.

That is, a position and a portion in which the short-circuit materials 131*g* to 134*g* are to be provided are not limited as long as (i) the number of resonance points in the antenna element 115*g* is increased and (ii) the VSWR characteristics of the two root sections of the antenna element 115*g* in the feed section 114*g* become stable.

It should be noted that the short-circuit materials 131*g* to 134*g* are the ones that cause short-circuits in the antenna element 115*g*, and can be made from for example a conductive material such as metal. Such short-circuit materials 131*g* to 134*g* are in direct contact with the antenna element 115*g* to thereby cause a short circuit in the antenna element 115*g*.

(Radiation Directivity and VSWR Characteristic)

Figure 16:
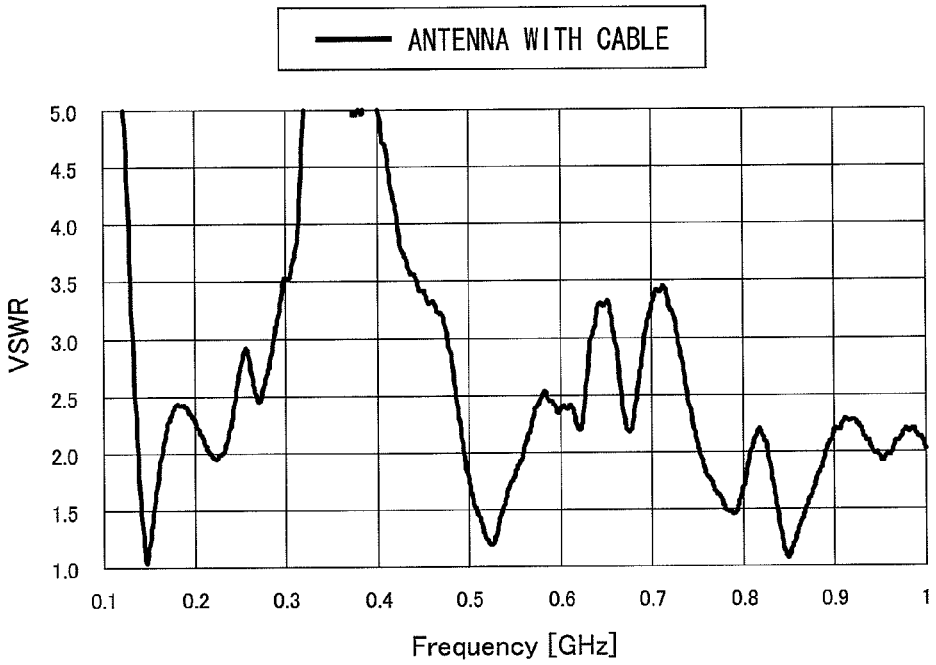
FIG. 16 is a graph illustrating a VSWR characteristic of the antenna device shown in FIG. 15.
Figure 17:
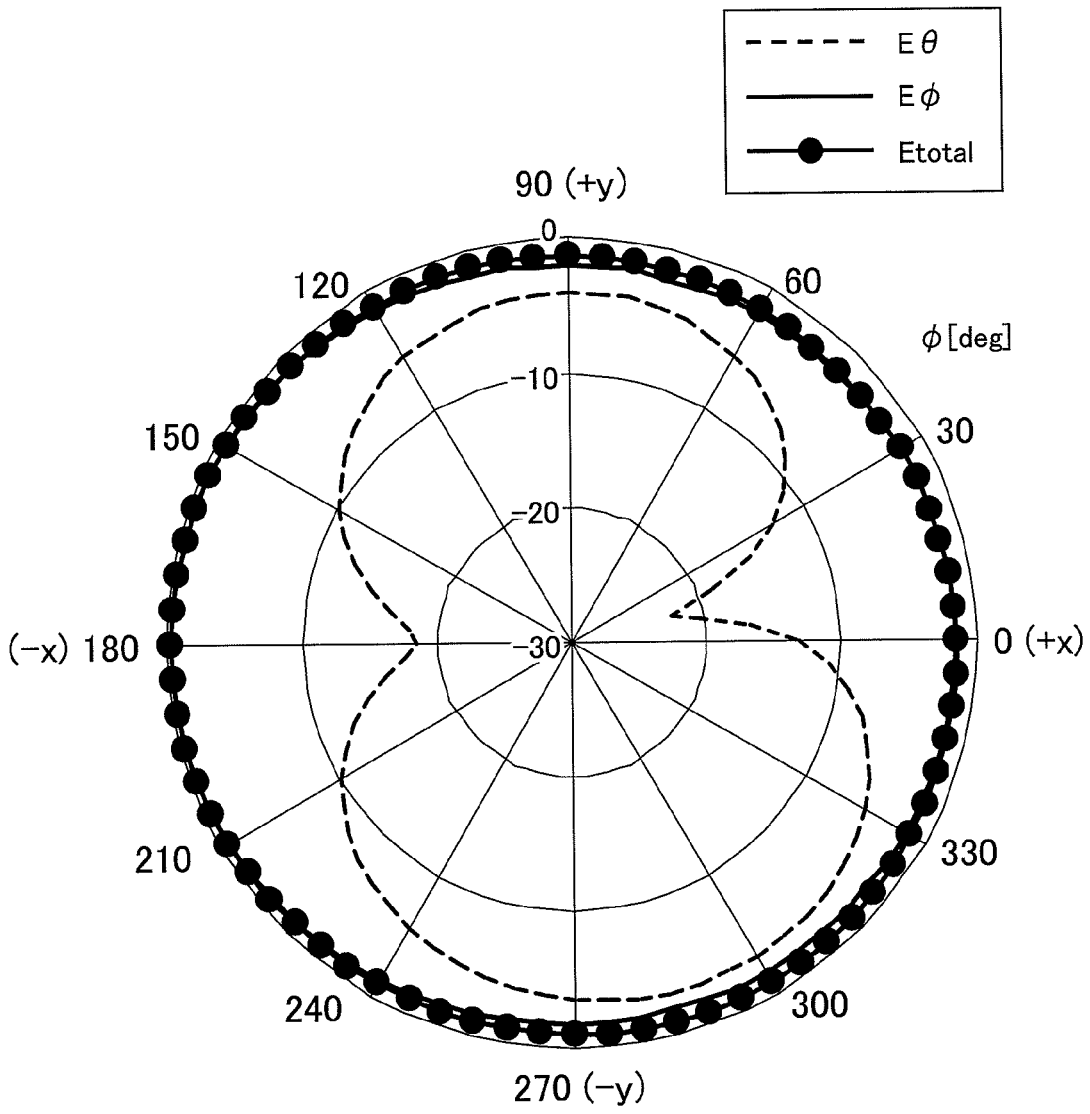
FIG. 17 is a graph illustrating a radiation pattern of the antenna device shown in FIG. 15.

FIG. 16 is a graph illustrating a VSWR characteristic of the antenna device 101*g* shown in FIG. 15. FIG. 17 is a graph illustrating an in-xy-plane radiation pattern in the 550 MHz band of the antenna device 101*g* shown in FIG. 15.

As is clear from FIG. 16, it is possible to prevent the VSWR from being greater than 3.5 in a band of 500 MHz or greater, i.e., in the terrestrial digital television band (470 MHz to 900 MHz).

Further, as is clear from FIG. 17, a non-directivity radiation characteristic is achieved in a 550 MHz band.

(Presence of Inductance Matching Pattern)

Figure 18:
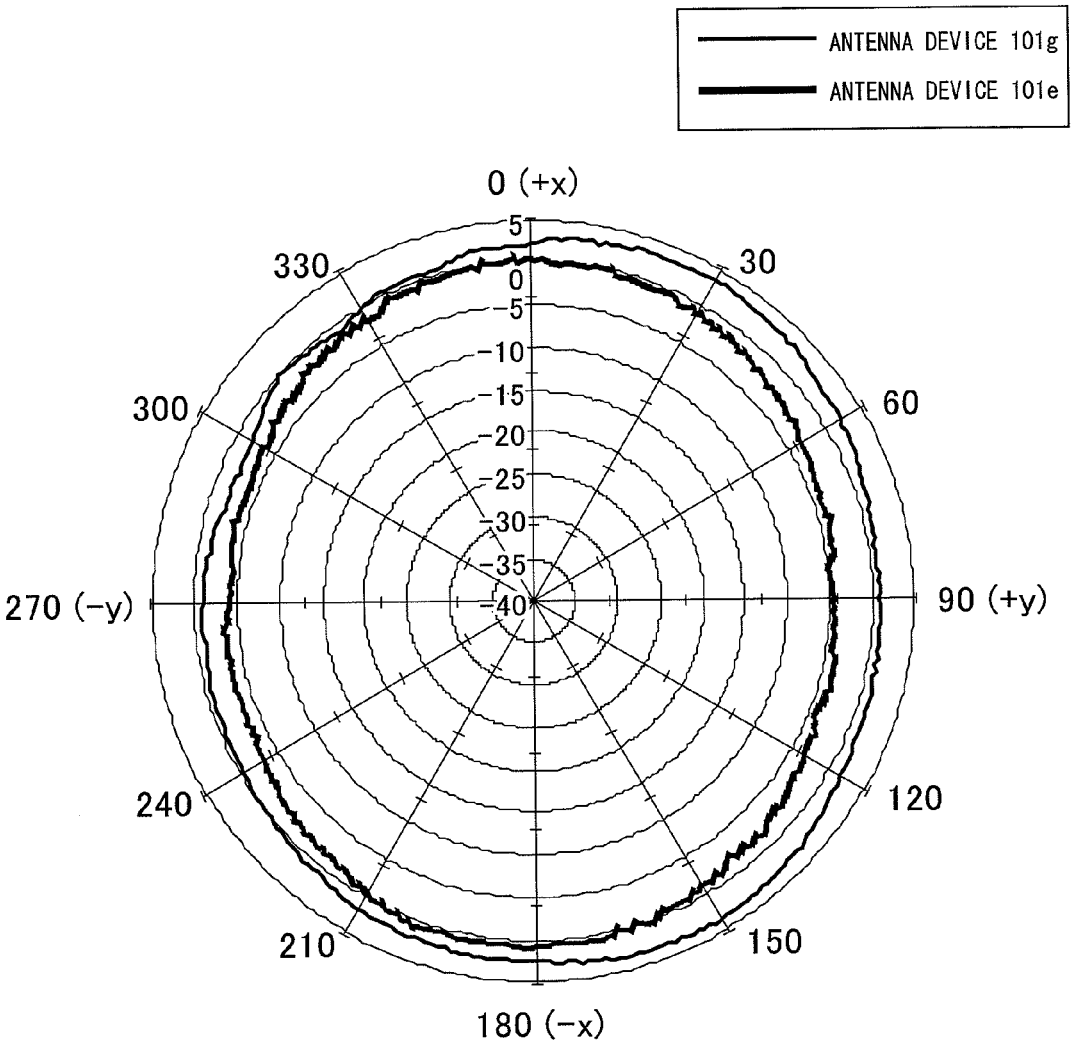
FIG. 18 is a graph illustrating radiation patterns of the antenna device shown in FIG. 13 and of the antenna device shown in FIG. 15.

FIG. 18 is a graph illustrating (i) an in-xy-plane radiation pattern in a 750 MHz band of an antenna device 101*e* shown in FIG. 13 and (ii) an in-xy-plane radiation pattern in a 800 MHz band of the antenna device 101*g* shown in FIG. 15.

As is clear from FIG. 18, providing the inductance matching pattern 116*g* improves a non-directivity radiation characteristic.

(Presence of Short-Circuit Material, and Arrangement of Return Direction of Meander Shape)

Figure 19:
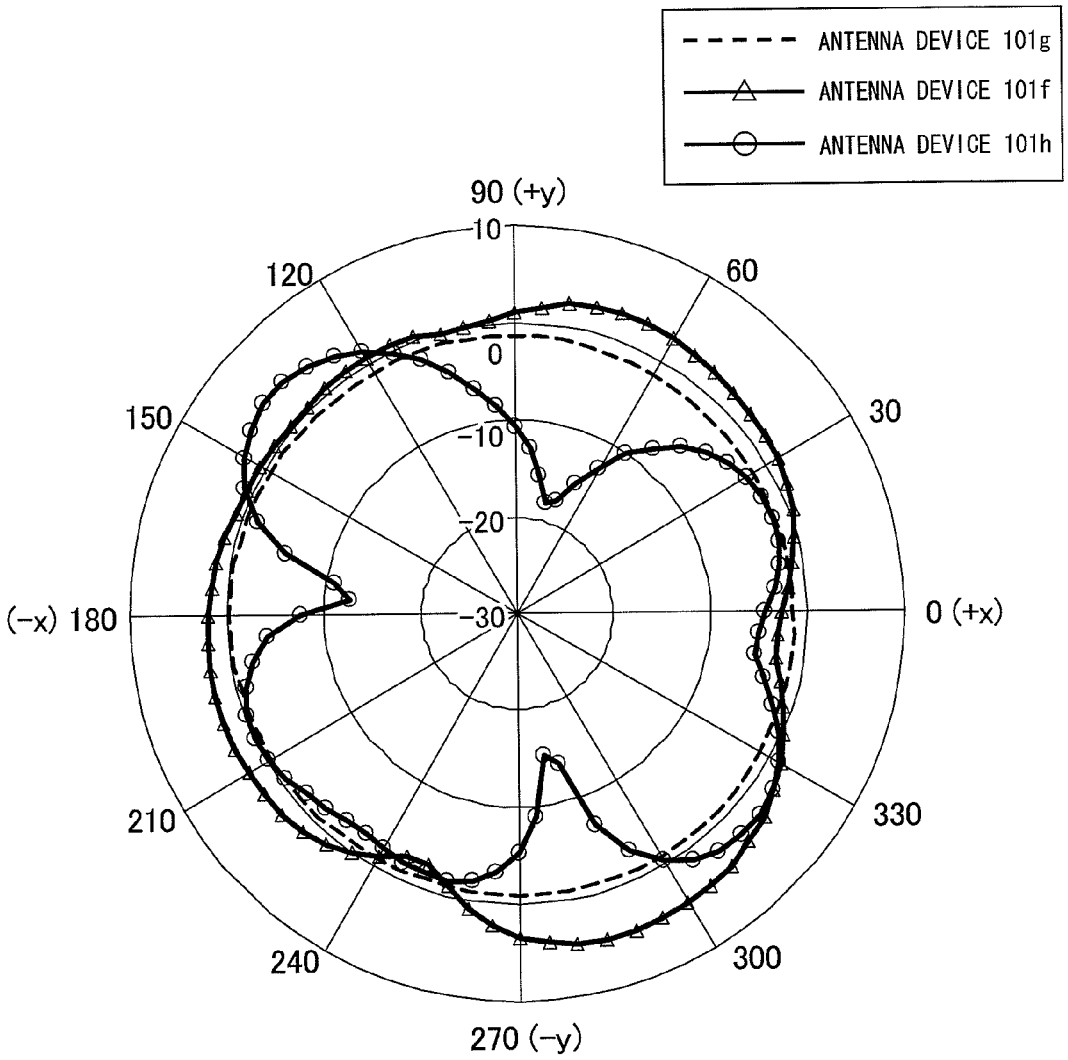
FIG. 19 is a graph illustrating radiation patterns of the antenna device shown in FIG. 14, of the antenna device shown in FIG. 15, and of the antenna device shown in FIG. 20.
Figure 20:
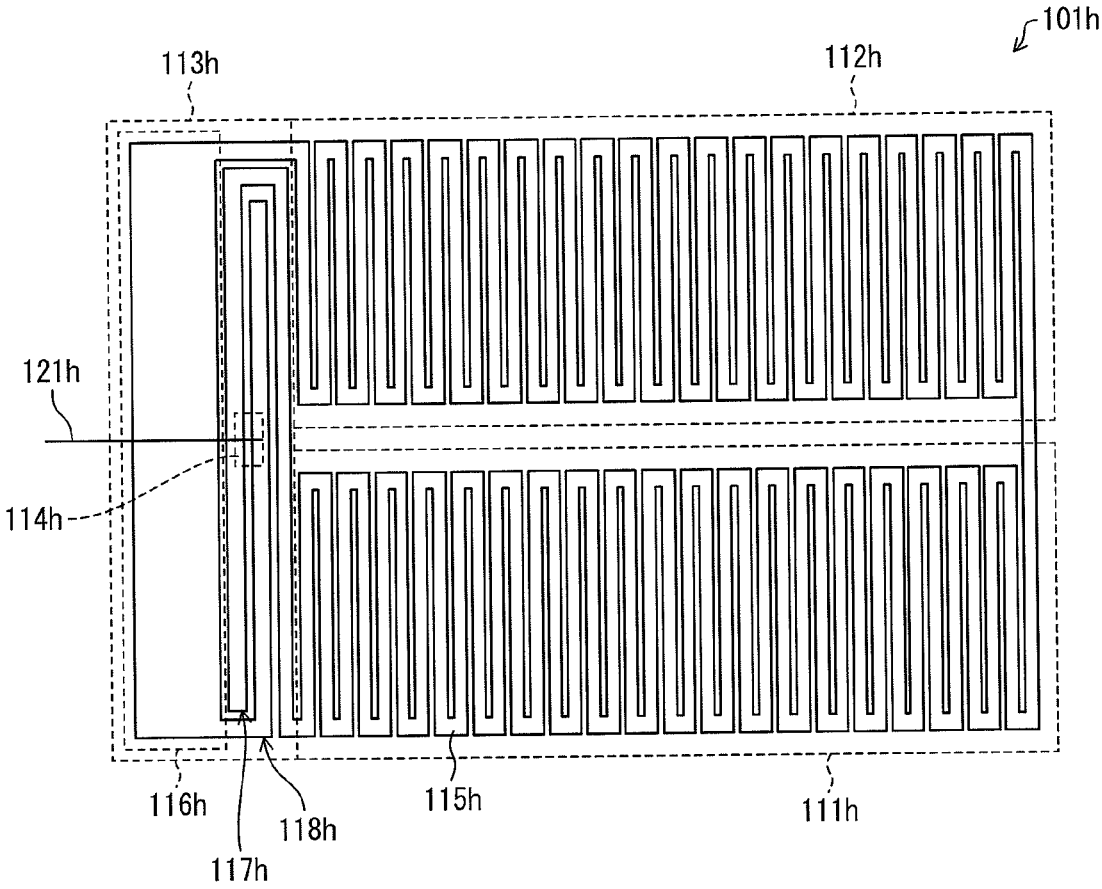
FIG. 20 is a plan view schematically illustrating a configuration of an example for comparison with the antenna device in accordance with Embodiment 2 of the present invention.

FIG. 19 is a graph illustrating (i) an in-xy-plane radiation pattern in a 700 MHz band of an antenna device 101*f* shown in FIG. 14, (ii) an in-xy-plane radiation pattern in the 700 MHz band of the antenna device 101*g* shown in FIG. 15, and (iii) an in-xy-plane radiation pattern in the 700 MHz band of an antenna device 101*h* shown in FIG. 20.

According to an example shown in FIG. 20, a part of an intermediate section of an antenna element 115*h* has, in a first antenna section 111*h*, a meander shape in which a return direction of a return pattern in the meander shape is in parallel to a direction in which a first root section 117*h* of an antenna element 115*h* is drawn out in a wind section 113*h*.

Further, the other part of the intermediate section of the antenna element 115*h* has, in a second antenna section 112*h*, a meander shape in which a return direction of a return pattern in the meander shape is in parallel to a direction in which a second root section 118*h* of the antenna element 115*h* is drawn out in the wind section 113*h*.

That is, the antenna device 101*h* is configured such that the return direction in the meander shape of the first antenna section 111*h* and the return direction in the meander shape of the second antenna section 112*h* are in parallel to each other.

As illustrated in FIG. 19, the comparison between the radiation pattern of the antenna device 101*f* shown in FIG. 14 and the radiation pattern of the antenna device 101*g* shown in FIG. 15 shows that providing the short-circuit materials 131*g* to 134*g* achieves a stable non-directivity radiation characteristic.

Further, comparison between the radiation pattern of the antenna device 101*f* shown in FIG. 14 and the radiation pattern of the antenna device 101*h* shown in FIG. 20 shows that, by arranging the return direction in the meander shape of the first antenna section 111*f* and the return direction in the meander shape of the second antenna section 112*f* such that these return directions are perpendicular to each other, a stable non-directivity radiation characteristic is achieved.

Embodiment 3

The following description discusses Embodiment 3 of the present invention. As described earlier, if an antenna device for terrestrial digital broadcasting is put into practical use, the antenna device will be mounted on terminals for receiving terrestrial digital broadcasting, i.e., on various types of receivers such as mobile phones, personal computers, car navigation systems and in-vehicle television receivers.

Meanwhile, an antenna device is susceptible to the surrounding environment. Therefore, how the antenna device is mounted in such a position is important.

In particular, if an antenna device is mounted on a conductor material made of a metal plate etc., the antenna device is inevitably affected by the conductor material. That is, in a case where the antenna device is to be mounted on a conductor material, the antenna device needs to be designed in view of the effect of the conductor material, unlike a case where the antenna device alone is present in a vacuum free space.

In view of this, according to Embodiment 3 of the present invention, the antenna device is configured on the assumption that it is to be affected by the conductor material when mounted on the conductor material. That is, by employing a short-circuit material (short-circuit section) and determining a position and a portion to which the short-circuit material is to be provided, the number of resonance points in the antenna element is increased and thus the VSWR is reduced. This allows expansion of a usable band, even in a case where the antenna device is mounted on a conductor material. It should be noted that, as described earlier, the short-circuit material is not limited to an independently provided member. Therefore, for example, the short-circuit material may be made, concurrently with the electrically conductive path constituting an antenna element, from the same material as that of the electrically conductive path. Alternatively, the short-circuit material may be formed so as to be integral with the electrically conductive path.

Figure 21:
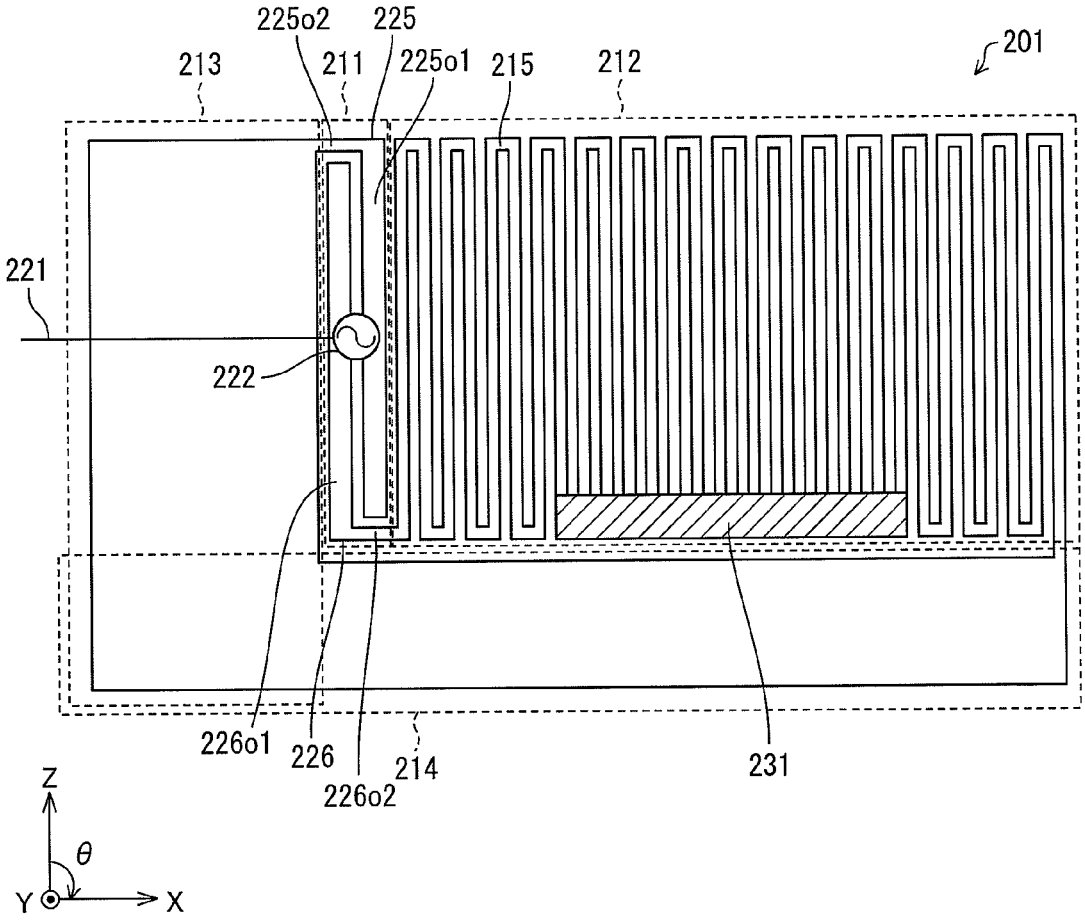
FIG. 21 is a plan view schematically illustrating a configuration of an antenna device in accordance with Embodiment 3 of the present invention.

FIG. 21 is a plan view schematically illustrating a configuration of an antenna device in accordance with Embodiment 3 of the present invention. As illustrated in FIG. 21, an antenna device 201 includes an antenna element 215.

The antenna element 215 has an electrically conductive path continuing from its one end part to the other end part, and is a single path. In view of the fact that the antenna element 215 has the electrically conductive path continuing from its one end part to the other end part, it can be said that the antenna element 215 is provided in a loop manner. The antenna element 215 is provided in a single plane, and made from for example a conductive wire or a conductive film.

According to the antenna element 215, a part of the antenna element 215 which part extends from one end part by a predetermined length (i.e., a part corresponding to the following wind section 211) and a part of the antenna element 215 which part extends from the other end part by a predetermined length (i.e., a part corresponding to the following wind section 211) serve as a first root section 225 and a second root section 226, respectively. A part of the antenna element 215 which part is other than the two root sections 225 and 226 serves as an intermediate section.

A part of the intermediate section constitutes an antenna section 212 which has a meander shape (meander-shaped part), and the other part of the intermediate section constitutes a first wider width part 213 and a second wider width part 214. The two root sections 225 and 226 constitute the wind section 211. The first wider width part 213 and the second wider width part 214 share part of them.

The antenna device 201 has the following size: a length in a crosswise direction (i.e., X axis direction) of a sheet on which FIG. 21 is illustrated is 92 mm; and a length in a lengthwise direction (i.e., Z axis direction) of the sheet is 52 mm.

In the wind section 211, a feed section 222 is provided in the two root sections 225 and 226 of the antenna element 215. Each of the two root sections 225 and 226 receives power via a feed line 221 connected with the feed section 222. The first root section 225 of the antenna element 215 is drawn out in a leftward direction of the sheet on which FIG. 21 is illustrated (i.e., the negative direction of the X axis), and the second root section 226 is drawn out in a rightward direction of the sheet (i.e., the positive direction of the X axis). That is, the first root section 225 and the second root section 226 are drawn out in respective opposite directions.

Further, the first root section 225 of the antenna element 215 is drawn out in a direction in which the feed line 221 extends, i.e., the same direction as the leftward direction of the sheet on which FIG. 21 is illustrated (i.e., the negative direction of the X axis), and the second root section 226 of the antenna element 215 is drawn out in a direction opposite to the direction in which the feed line 211 extends.

Specifically, according to the wind section 211, a direction in which the first root section 225 extends from the one end part of the antenna element 215 is changed from a direction (i) to a direction (ii): (i) the upward direction of the sheet on which FIG. 21 is illustrated (i.e., the positive direction of the Z axis) and (ii) the leftward direction of the sheet (i.e., the negative direction of the X axis, the drawing direction). That is, the first root section 225 has (i) a first linear part **225*o*1 extending in the upward direction and (ii) a first bending part 225*o*2 (tail end linear part) extending in the leftward direction from an end part of the first linear part 225*o*1**.

Further, a direction in which the other root section extends from the other end part of the antenna element 215 is changed from a direction (i) to a direction (ii): (i) the downward direction (i.e., the negative direction of the Z axis) and (ii) the rightward direction (i.e., the positive direction of the X axis, the drawing direction). That is, the second root section 226 has (i) a second linear part **226*o*1 extending in the downward direction and (ii) a second bending part 226*o*2 (tail end linear part) extending in the rightward direction from an end part of the second linear part 226*o*1**.

As described above, in the wind section 211, both of the directions in which the respective two root sections 225 and 226 extend are rotated by 90 degrees so as to surround the feed section 114.

Further, a part of the intermediate section of the antenna element 215 has, in the antenna section 212, a meander shape made up of at least one return pattern. A return direction (Z axis direction) of the return pattern in the meander shape is perpendicular to a direction in which the second root section 226 of the antenna element 215 is drawn out in the wind section 211, i.e., perpendicular to the direction of the second bending part **226*o*2** (tail end linear part).

Further, the first wider width part 213, which lies below the feed line 221 and overlaps the feed line 211, has a line width (the length in the X axis direction) wider than a line width of a part that constitutes the wind section 211 and the antenna section 212 of the antenna element 215. This makes it possible to achieve impedance matching between the feed section 222 and the feed line 221.

As is the case with the first wider width part 213, a line width of the second wider width part 214 is wider than the line width of the part that constitutes the wind section 211 and the antenna section 212 of the antenna element 215.

Unlike the case of FIG. 21, in a case where the feed line 221 extends in the negative direction of the Z axis from the feed section 222, the second wider width part 214 plays a role of the first wider width part 213 that is shown in FIG. 21. That is, it can be said that the line width (the length in the Z axis direction) of the second wider width part 214, which lies below the feed line 221 and overlaps the feed line 221, is wider than the line width of the part that constitutes the wind section 211 and the antenna section 212 of the antenna element 215.

Further, in the meander shape of the antenna section 212, there is provided a short-circuit material 231. The following description discusses a role of the short-circuit material 231 with reference to FIG. 22.

(Role of Short-Circuit Material 231)

Figure 22:
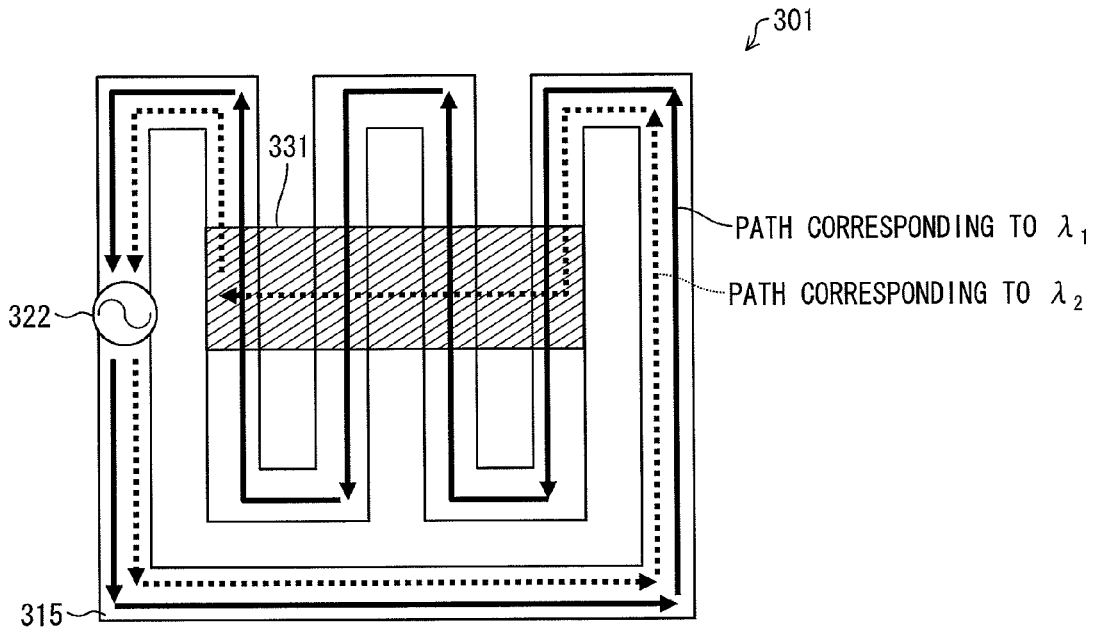
FIG. 22 is a view schematically illustrating how a short-circuit material is provided in an antenna element having a meander shape so as to form a plurality of electrically conductive paths in the antenna element.

FIG. 22 is a view schematically illustrating a state in which a short-circuit material 331 is provided in an antenna element 315 having a meander shape, thereby a plurality of electrically conductive paths are formed in the antenna element 315.

As illustrated in FIG. 22, an antenna device 301 includes the antenna element 315 which is a single path. The antenna element 315 has a meander shape. That is, the antenna element 315 is meandered. A feed section 322 of the antenna element 315 is connected with a feed line.

The short-circuit material 331 short-circuits for example two different points in the meandered antenna element 315. According to an example shown in FIG. 22, a short circuit is caused between two linear parts extending in respective upward and downward directions, which two linear parts are located in both end parts of the short-circuit material 331. This causes a first path (first electrically conductive path) and a second path (second electrically conductive path) to be formed. The first path corresponds to a first wavelength λ1 and is plotted in solid line, and the second path corresponds to a second wavelength λ2 and is plotted in dotted line.

As described above, according to the antenna device 301, the short-circuit material 331 is provided to the meandered antenna element 315 so as to short-circuit a plurality of different points, to thereby increase the number of electrically conductive paths having different lengths. This makes it possible to increase the number of resonance frequencies of the antenna device 301, and thus possible to improve the VSWR characteristic of the antenna device 301 in a usable band.

It should be noted here that, as described earlier, when an antenna device is mounted on a conductor material, the antenna device may deteriorate in VSWR characteristic (increase in a VSWR value) in a usable band due to an effect of the conductor material. The usable band is for example 470 MHz to 770 MHz in a case of an antenna for terrestrial digital broadcasting in Japan, 470 MHz to 860 MHz in a case of an antenna for terrestrial digital broadcasting in North America, and 470 MHz to 890 MHz in a case of an antenna for terrestrial digital broadcasting in Europe.

In such a case, as described with reference to the antenna device 301 shown in FIG. 22, it is possible to suppress a deterioration in VSWR characteristic (increase in VSWR value) in the usable band by providing the short-circuit material 331 to the meandered antenna element 315 so as to short-circuit a plurality of different points. That is, in view of the effect of the conductor material, where in the antenna element 315 the short-circuit material 331 is to be provided so as to cause a short circuit is determined under a condition where there is a dummy conductor material near the antenna element 315. This increases the number of electrically conductive paths having different lengths, and thus increases the number of resonance frequencies of the antenna device 301. As a result, it is possible to suppress a deterioration in VSWR characteristic (increase in VSWR value) in the usable band which deterioration is caused by an effect of a conductor material, even when the antenna device 301 is mounted on the conductor material.

According to the antenna device 201 shown in FIG. 21, the short-circuit material 231 which serves as the foregoing short-circuit material 331 is provided in the meandered antenna section 212. A position and a portion in which the short-circuit material 231 is to be provided are determined for example in the following manner.

Where to provide the short-circuit material 231 is determined so that, under a condition where the antenna element 215 is provided on a metal plate via a dielectric material, a VSWR value in each frequency in the usable band becomes less than a VSWR value obtained in a case where no short-circuit material 231 is provided. It is more preferable that where to provide the short-circuit material 231 be determined so that, under a condition where the antenna element 215 is provided on a metal plate via a dielectric material, the VSWR value in each frequency in the usable band becomes not more than 3.5.

More specifically, the short-circuit material 231 is temporarily placed on the antenna element 215 which is provided via a dielectric material on a dummy metal plate, and then the short-circuit material 231 is moved while the VSWR value in the usable band is being monitored. If a position is found in which the VSWR value in each frequency in the usable band is less than the VSWR value obtained in the case where no short-circuit material is provided, then the short-circuit material 231 is fixed to that position. On the other hand, if no position is found in which the VSWR value in each frequency in the usable band is less than the VSWR value obtained in the case where no short-circuit material is provided, then the short-circuit material 231 is replaced with another short-circuit material 231 having a different shape or a different size and then the above trial is repeated.

The short-circuit material 231 is the one that causes a short circuit between predetermined points in the antenna element 215, and can be made for example from a conductive material such as metal. The short-circuit material 231 for example makes direct contact with the antenna element 215 to thereby cause a short circuit in the antenna element 215.

The following description discusses the results of experiments for examining how the presence of the short-circuit material 231 is related to VSWR characteristics.

(Effect of Presence of Short-Circuit Material)

Figure 23:
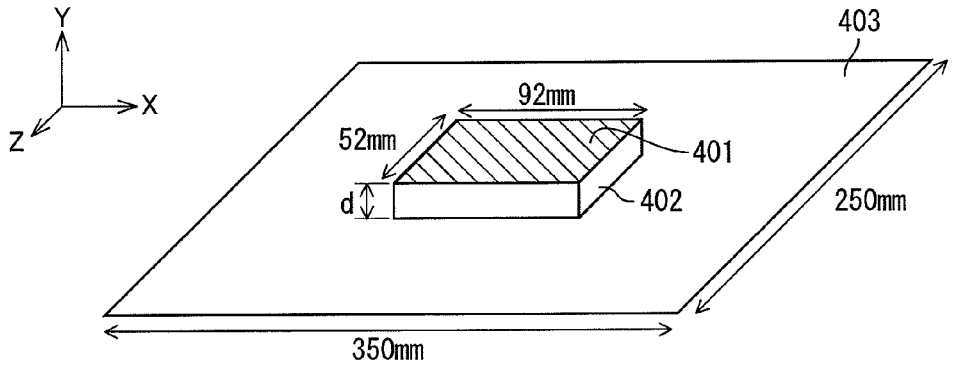
FIG. 23 is a view schematically describing how measurements are carried out in experiments for showing the effects of an antenna device of the present invention.

In this experiment, an antenna device 401 was mounted via a dielectric layer 402 on a metal plate 403 which is 350 mm×250 mm in size and which serves as a conductor material (see FIG. 23). The dielectric layer 402 will be described later. It should be noted that, provided that the antenna device 401 is approximately 100 mm×50 mm in size, it is possible to achieve substantially the same characteristics as in the case where the antenna device 401 is mounted on a conductor material 350 mm×250 mm in size even when the antenna device 401 is mounted on a conductor material such as a hood of a vehicle.

Figure 24:
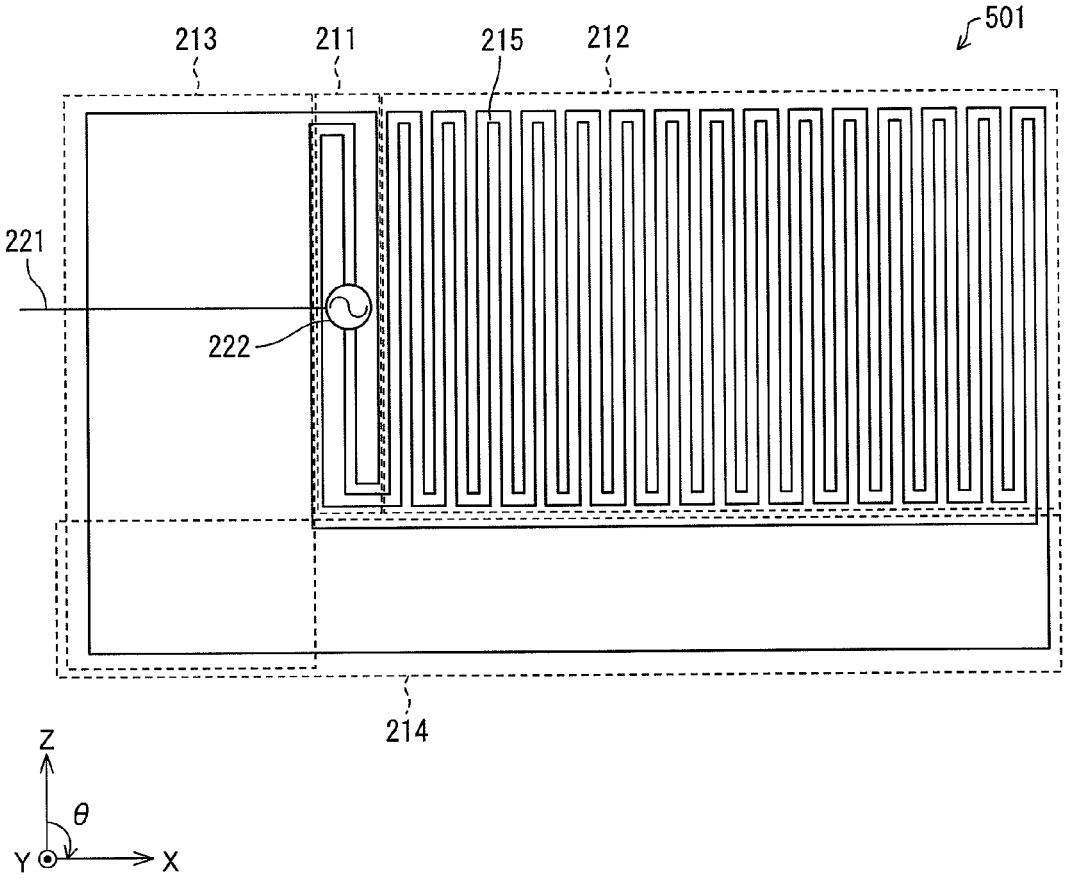
FIG. 24 is a plan view schematically illustrating a configuration of an example for comparison with the antenna device in accordance with Embodiment 3 of the present invention.

The antenna device 201 shown in FIG. 21 and an antenna device 501 shown in FIG. 24 were each used as the antenna device 401. The VSWR characteristic of each of these antenna devices was measured. Note that the antenna device 501 shown in FIG. 24 has the same configuration as that of the antenna device 201 shown in FIG. 21 except that the short-circuit material 231 provided in the antenna device 201 shown in FIG. 21 is not provided in the antenna device 501.

Figure 25:
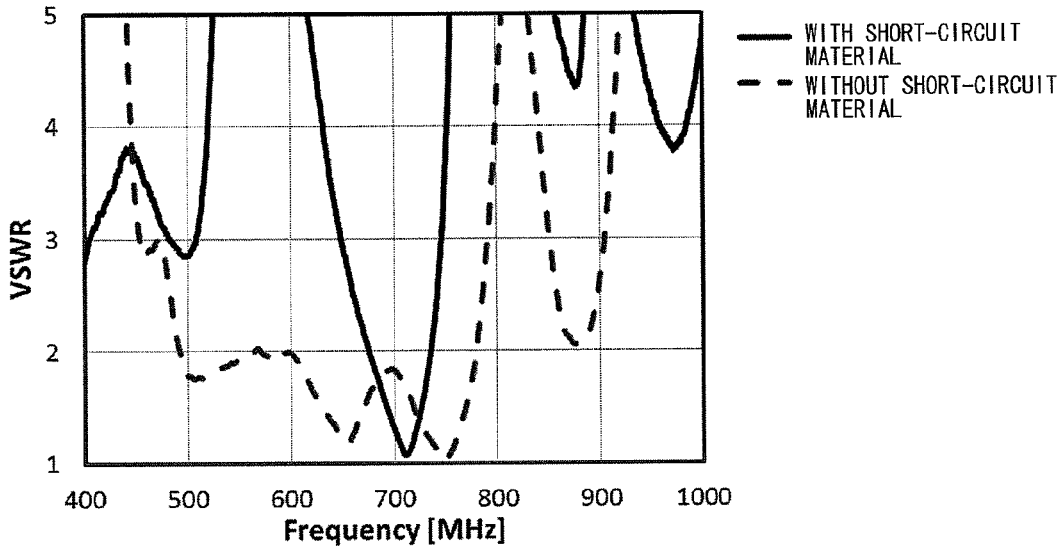
FIG. 25 is a graph illustrating VSWR characteristics of the antenna device shown in FIG. 21 and of the antenna device shown in FIG. 24.

FIG. 25 is a graph illustrating the results of measurement of the VSWR characteristics of the antenna device 201 and of the antenna device 501. In FIG. 25, a graph indicated by "WITH SHORT-CIRCUIT MATERIAL" represents the result of measurement of the antenna device 201, and a graph indicated by "WITHOUT SHORT-CIRCUIT MATERIAL" represents the result of measurement of the antenna device 501. It should be noted that, during the measurement, the thickness d of the dielectric layer 402 was 5 mm and the specific inductive capacity $\in r$ of the dielectric layer 402 was 1.

As is clear from the experimental results shown in FIG. 25, it is possible to prevent the VSWR from being greater than 3.5 in a band of not more than 800 MHz, i.e., in the terrestrial digital television band (470 MHz to 770 MHz), by providing the short-circuit material 231 to the antenna device 201 so as to cause a short-circuit.

(Effect of Thickness of Dielectric Material)

The inventors have found that, by providing the dielectric layer 402 between the antenna device 401 and the metal plate 403 serving as a conductor material, it is possible to achieve an antenna device having a practical VSWR characteristic even when a distance between the antenna device 401 and the conductor material (metal plate 403) is reduced to approximately several millimeters (see FIG. 23). In this case, it is preferable to set the specific inductive capacity $\in r$ of the dielectric layer 402 to be not less than 1 but not greater than 10. This is because the specific inductive capacity $\in r$ of greater than 10 makes a radiant efficiency reduction unignorable.

Figure 26:
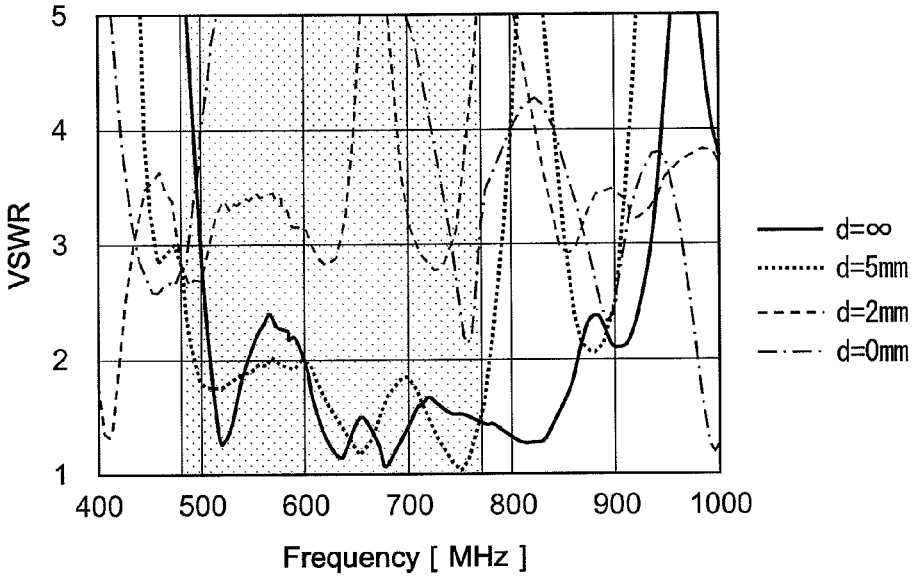
FIG. 26 is a graph illustrating VSWR characteristics of the antenna device shown in FIG. 21, which VSWR characteristics were measured while the thickness of a dielectric material was being changed.

FIG. 26 illustrates the result, for each thickness d of the dielectric layer 402, obtained by measuring the VSWR characteristic of the antenna device 401 while changing the thickness d. Note here that the antenna device 401 used here is the antenna device 201 shown in FIG. 21.

Further, the thickness d was changed to the following four thicknesses: d=Infinite (∞), d=5 mm, d=2 mm, and d=0 mm. Note that d=Infinite means that the distance between the antenna device 201 and the metal plate 403 is infinite, i.e., no metal plate 403 is present. Further, d=0 mm means that the antenna device 201 is mounted so as to be in direct contact with the metal plate 403.

It is clear from FIG. 26 that, when d=Infinite or d=5 mm, it is possible to prevent the VSWR from being greater than 3.5 in a band of 470 MHz to 770 MHz. Further, even when d=2 mm, it is possible to prevent the VSWR from being greater than 3.5 in the band of 470 MHz to 770 MHz except for a band in the vicinity of 670 MHz. This implies the following.

When d=Infinite, that is, when the antenna device 201 is not mounted on the metal plate 403, the antenna device 201 is not affected by the metal plate 402. In other words, when the distance between the antenna device 201 and the metal plate 403 is gradually reduced from infinite, the antenna device 201 should become affected by the metal plate 403 more strongly as it approaches the metal plate 403.

That is, the results in FIG. 26 show that, by causing the thickness d of the dielectric layer 402 between the antenna device 201 and the metal plate 403 to be equal to or greater than 5 mm, i.e., by causing the distance between the antenna device 201 and the metal plate 403 to be equal to or greater than 5 mm, it is possible to prevent the VSWR from being greater than 3.5 in the band of 470 MHz to 770 MHz. Further, the results show that, by causing the distance between the antenna device 201 and the metal plate 403 to be equal to or greater than 2 mm, it is possible to prevent the VSWR from being greater than 3.5 in the band of 470 MHz to 770 MHz, except for some band(s).

Figure 27:
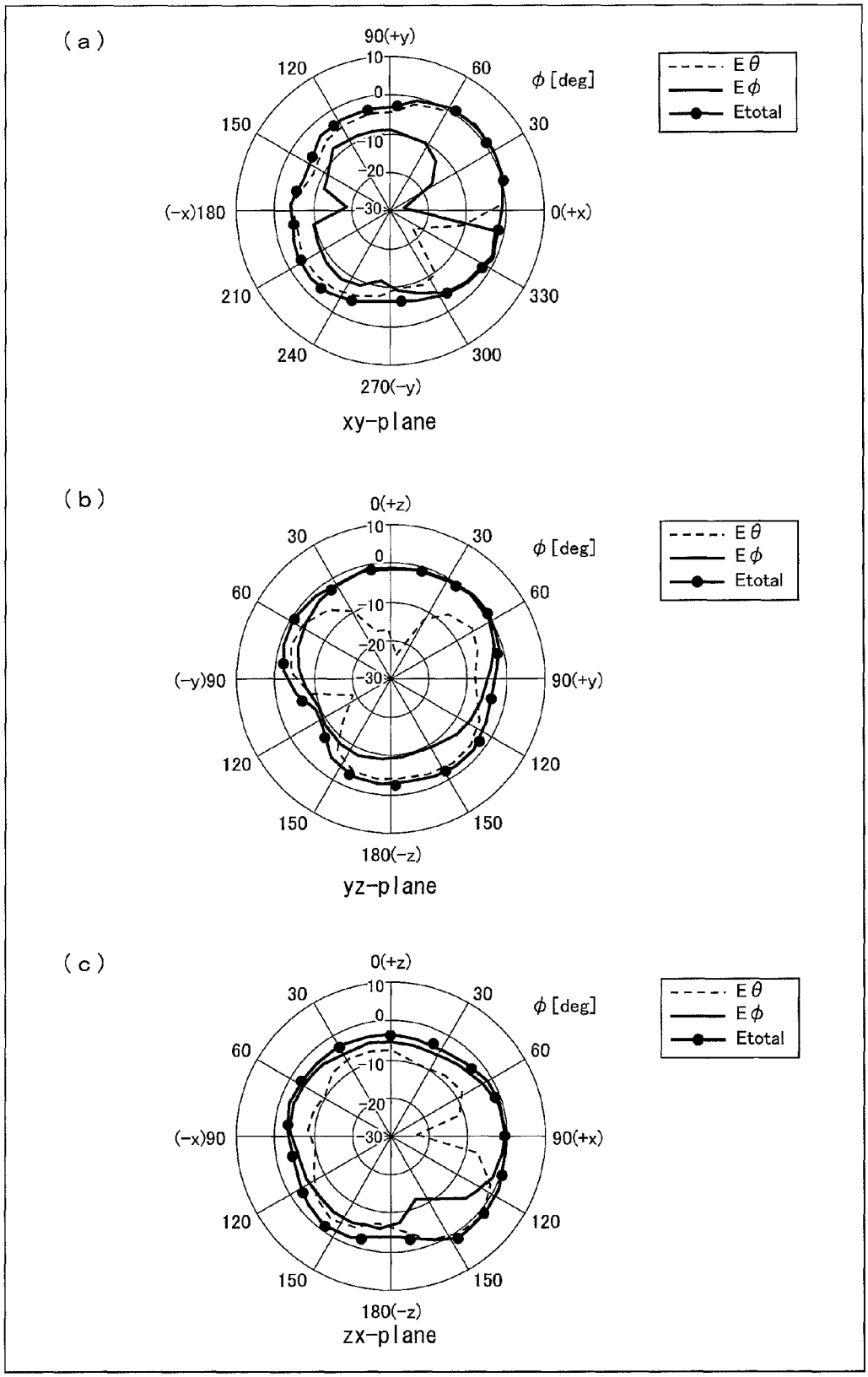
FIG. 27 shows graphs illustrating radiation patterns of the antenna device shown in FIG. 21. (a) of FIG. 27 illustrates an in-xy-plane radiation pattern. (b) of FIG. 27 illustrates an in-yz-plane radiation pattern. (c) of FIG. 27 illustrates an in-zx-plane radiation pattern.

FIG. 27 shows graphs each illustrating radiation patterns in a 550 MHz band of the antenna device 201 shown in FIG. 21. (*a*) of FIG. 27 illustrates an in-xy-plane radiation pattern. (*b*) of FIG. 27 illustrates an in-yz-plane radiation pattern. (*c*) of FIG. 27 illustrates an in-zx-plane radiation pattern. Note here that the thickness d of the dielectric layer 402 was 5 mm and the specific inductive capacity ∈r of the dielectric layer 402 was 1.

It is clear from FIG. 27 that a non-directivity radiation characteristic is achieved in all the in-xy-plane radiation pattern, the in-yz-plane radiation pattern, and the in-zx-plane radiation pattern.

Modified Example

Figure 28:
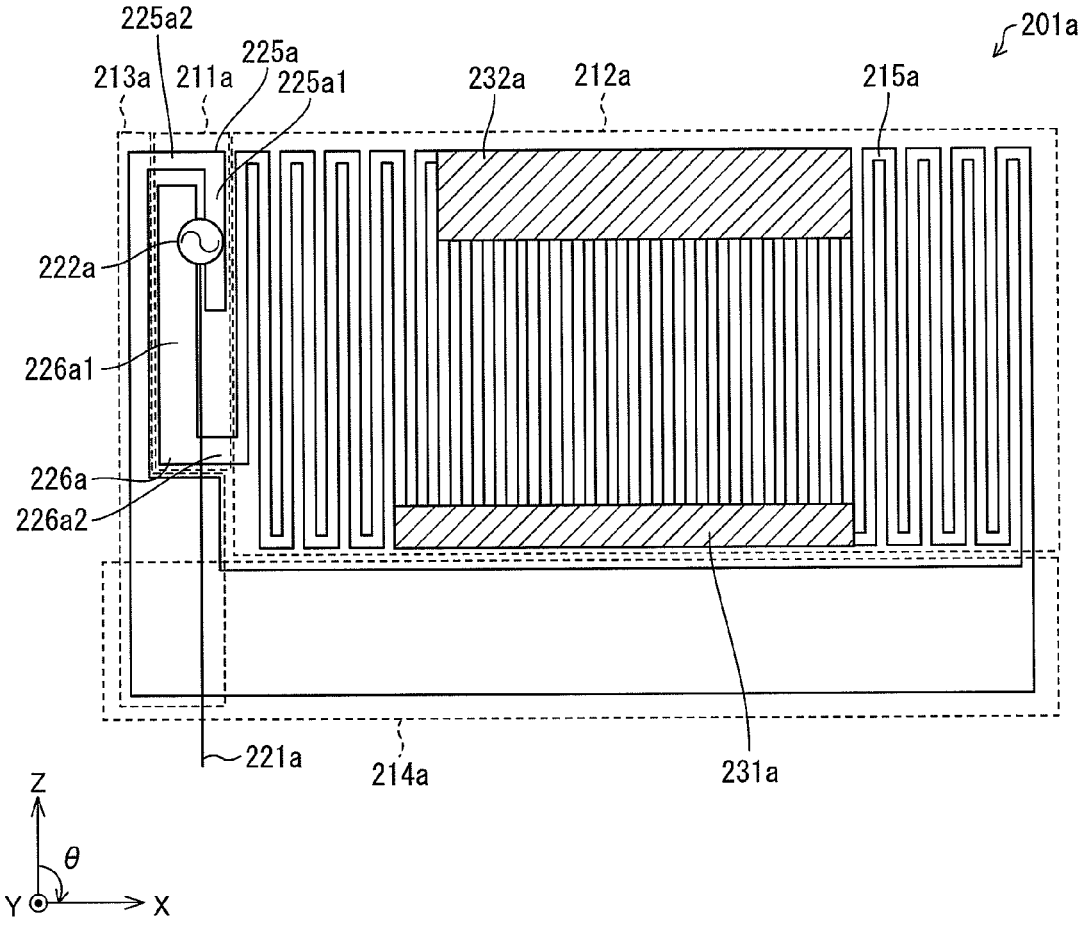
FIG. 28 is a plan view schematically illustrating a configuration of a modified example of the antenna device in accordance with Embodiment 3 of the present invention.

FIG. 28 illustrates an antenna device 201*a*, which is a modified example of the antenna device 201. The following description discusses in detail differences between the modified example and Embodiment 3. Descriptions for the same parts are omitted here.

The antenna device 201*a* has the following size: a length in a crosswise direction of a sheet on which FIG. 28 is illustrated (i.e., X axis direction) is 83 mm; and a length in a lengthwise direction of the sheet (i.e., Z axis direction) is 56 mm.

In a wind section 211*a*, a feed section 222*a* is provided in two root sections 225*a* and 226*a* of an antenna element 215*a*. Each of the two root sections 225*a* and 226*a* receives power via a feed line 221*a* connected with the feed section 222*a*.

The first root section 225*a* has a first linear part 225*a*1 and a first bending part 225*a*2 (tail end linear part), which correspond to the first linear part 225*o*1 and the first bending part 225*o*2 of the first root section 225 shown in FIG. 21, respectively. Similarly, the second root section 226*a* has a second linear part 226*a*1 and a second bending part 226*a*2 (tail end linear part), which correspond to the second linear part 226*o*1 and the second bending part 226*o*2 of the second root section 226 shown in FIG. 21, respectively.

The feed line 221*a* extends in the negative direction of the Z axis in the sheet on which FIG. 28 is illustrated, which direction is different from the direction in which the feed line 221 of Embodiment 1 extends.

Accordingly, a direction in which each of the two root sections 225*a* and 226*a* of the antenna element 215*a* is drawn out is perpendicular to the direction in which the feed line 221 extends.

Further, a line width (the length in the X axis direction) of a portion of a first wider width part 213*a*, which portion lies below the feed line 221*a* and overlaps the feed line 221*a*, is wider than a line width of a part that constitutes the wind section 211*a* and the antenna section 212*a* of the antenna element 215*a*.

The feed line 221*a* may extend in the negative direction of the X axis from the feed line 222*a*, which direction is different from that shown in FIG. 28.

Further, a short-circuit material 231*a* and a short-circuit material 232*a* are provided in a meander shape of the antenna section 212*a*. The roles of the short-circuit materials 231*a* and 232*a* are the same as that of the short-circuit material 231 of Embodiment 3.

Next, the inventors have conducted an experiment to find out to what degree the VSWR characteristic is improved by virtue of the presence of the short-circuit materials 231*a* and 232*a*. The following description discusses the results of the experiment.

(Effect of Presence of Short-Circuit Material)

In the same manner as in Embodiment 3, the inventors mounted an antenna device 401 via a dielectric layer 402 on a metal plate 403 which is 350 mm×250 mm in size (see FIG. 23).

Figure 29:
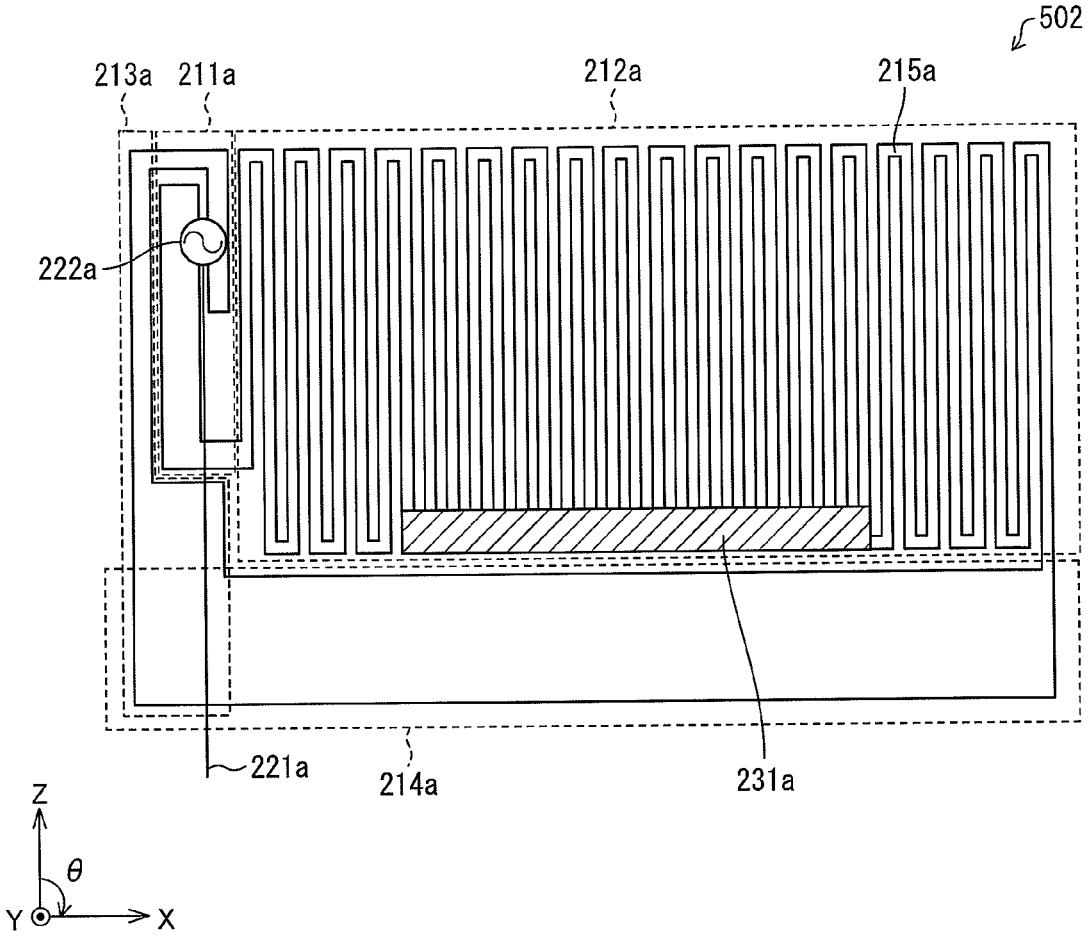
FIG. 29 is a plan view schematically illustrating a configuration of an example for comparison with the modified example of the antenna device in accordance with Embodiment 3 of the present invention.
Figure 30:
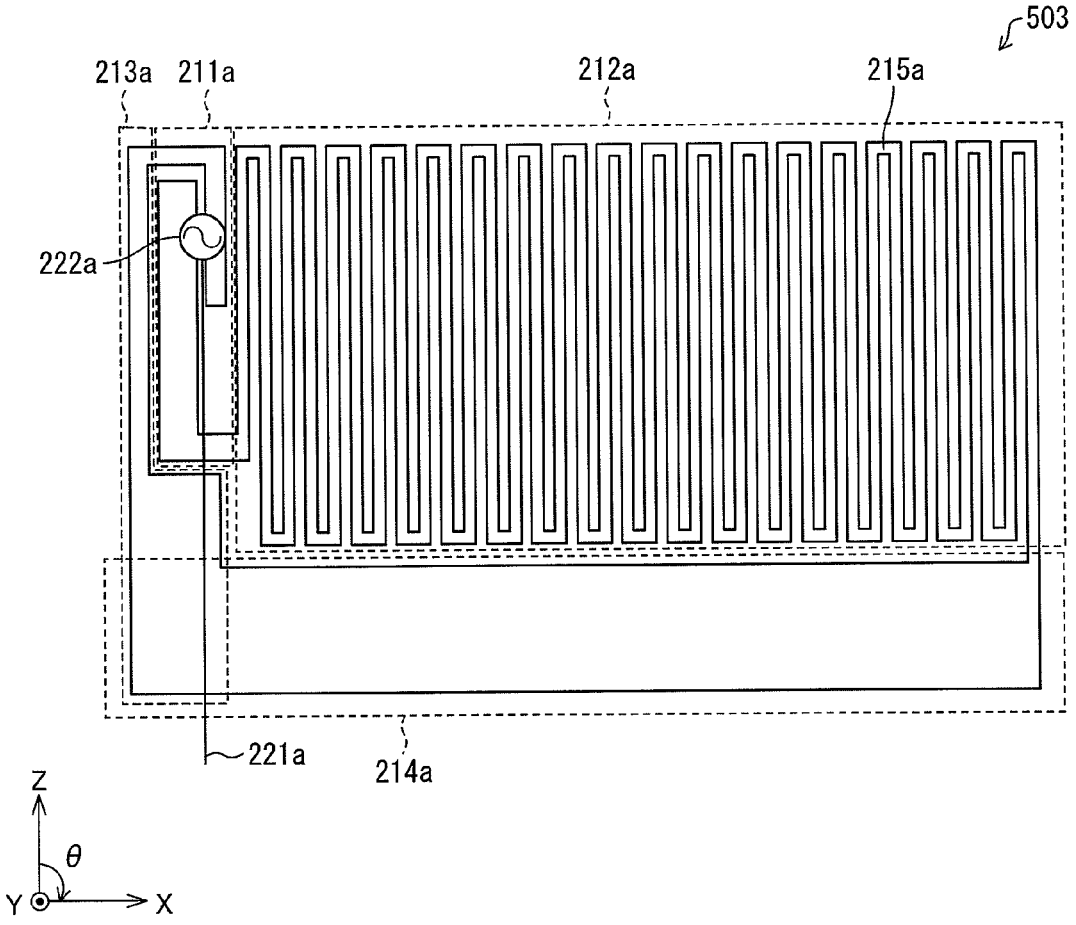
FIG. 30 is a plan view schematically illustrating a configuration of an example for comparison with the modified example of the antenna device in accordance with Embodiment 3 of the present invention.

The antenna device 201*a* shown in FIG. 28, an antenna device 502 shown in FIG. 29 and an antenna device 503 shown in FIG. 30 were each used as the antenna device 401. The VSWR characteristic of each of these antenna devices was measured. The antenna device 502 shown in FIG. 29 has the same configuration as that of the antenna device 201*a* shown in FIG. 28, except that the short-circuit material 232*a* shown in FIG. 28 is not provided in the meander-shaped part of the antenna section 212*a*. Further, the antenna device 503 shown in FIG. 30 has the same configuration as that of the antenna device 201*a* shown in FIG. 28, except that neither the short-circuit material 231*a* nor the short-circuit material 232*a* shown in FIG. 28 is provided in the meander-shaped part of the antenna section 212*a*.

Figure 31:
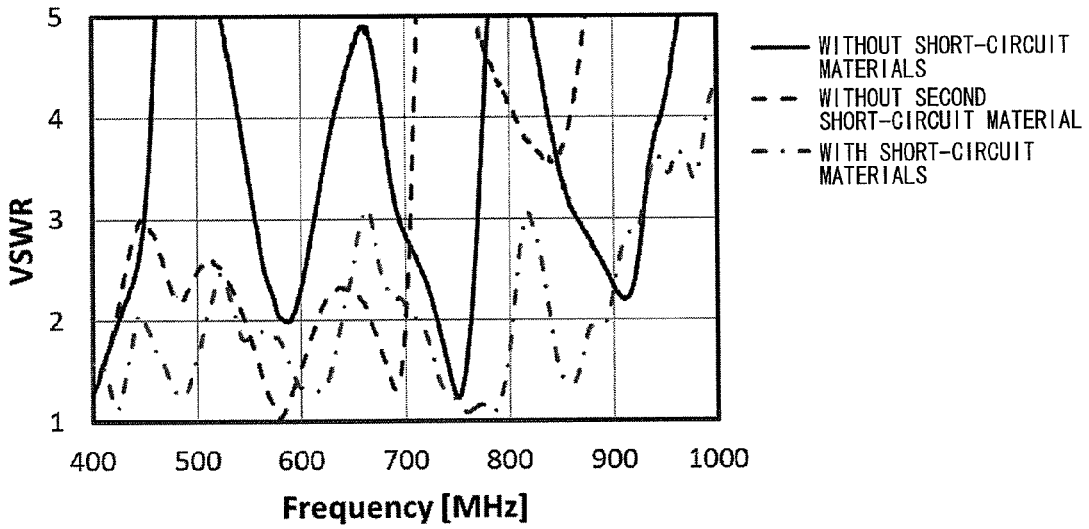
FIG. 31 is a graph illustrating VSWR characteristics of the antenna device shown in FIG. 28, of the antenna device shown in FIG. 29, and of the antenna device shown in FIG. 30.

FIG. 31 illustrates results obtained by measuring the VSWR characteristics of the antenna device 201*a*, the antenna device 502 and the antenna device 503. In FIG. 31, a graph indicated by the "WITH SHORT-CIRCUIT MATERIALS" represents the result for the antenna device 201*a*, a graph indicated by the "WITHOUT SHORT-CIRCUIT MATERIALS" represents the result for the antenna device 503, and a graph indicated by the "WITHOUT SECOND SHORT-CIRCUIT MATERIAL" represents the result for the antenna device 502. It should be noted that, during the measurement, the thickness d of the dielectric layer 402 was 5 mm and the specific inductive capacity ∈r of the dielectric layer 402 was 1.

As is clear from FIG. 31, first, it is possible to prevent the VSWR from being greater than 3.5 in a low-frequency band, out of the terrestrial digital television band (470 MHz to 770 MHz), by providing the short-circuit material 231*a* to thereby cause a short circuit.

Further, it is clear from FIG. 31 that it is possible to prevent the VSWR from being greater than 3.5 also in a high-frequency band, out of the terrestrial digital television band (470 MHz to 770 MHz), by further providing the short-circuit material 232*a* to thereby cause a short circuit.

(Effects of Thickness of Dielectric Material)

Figure 32:
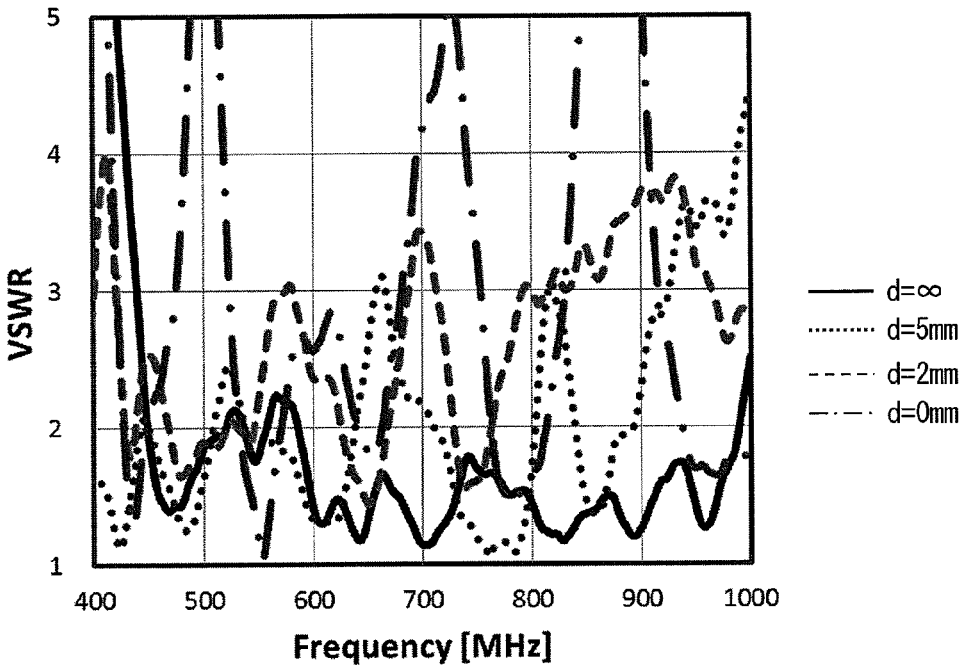
FIG. 32 is a graph illustrating VSWR characteristics of the antenna device shown in FIG. 28, which VSWR characteristics were measured while the thickness of a dielectric material was being changed.

FIG. 32 illustrates the results obtained by measuring the VSWR characteristic of the antenna device 401. The VSWR was measured while the thickness d of the dielectric layer 402 was changed. Note here that the antenna device 401 used here is the antenna device 201*a* shown in FIG. 28.

Further, the thickness d was changed to the following four thicknesses: d=Infinite (∞), d=5 mm, d=2 mm, and d=0 mm.

It is clear from FIG. 32 that, when d=Infinite or d=5 mm, it is possible to prevent the VSWR from being greater than 3.1 in a band of 420 MHz to 920 MHz.

Further, it is clear from FIG. 32 that, when d=Infinite, d=5 mm, or d=2 mm, it is possible to prevent the VSWR from being greater than 3.5 in a band of 420 MHz to 870 MHz.

These results show that, by causing the distance between the antenna device 201*a* and the metal plate 403 to be equal to or larger than 2 mm, it is possible to prevent the VSWR from being greater than 3.5 in a band of 420 MHz to 870 MHz.

Figure 33:
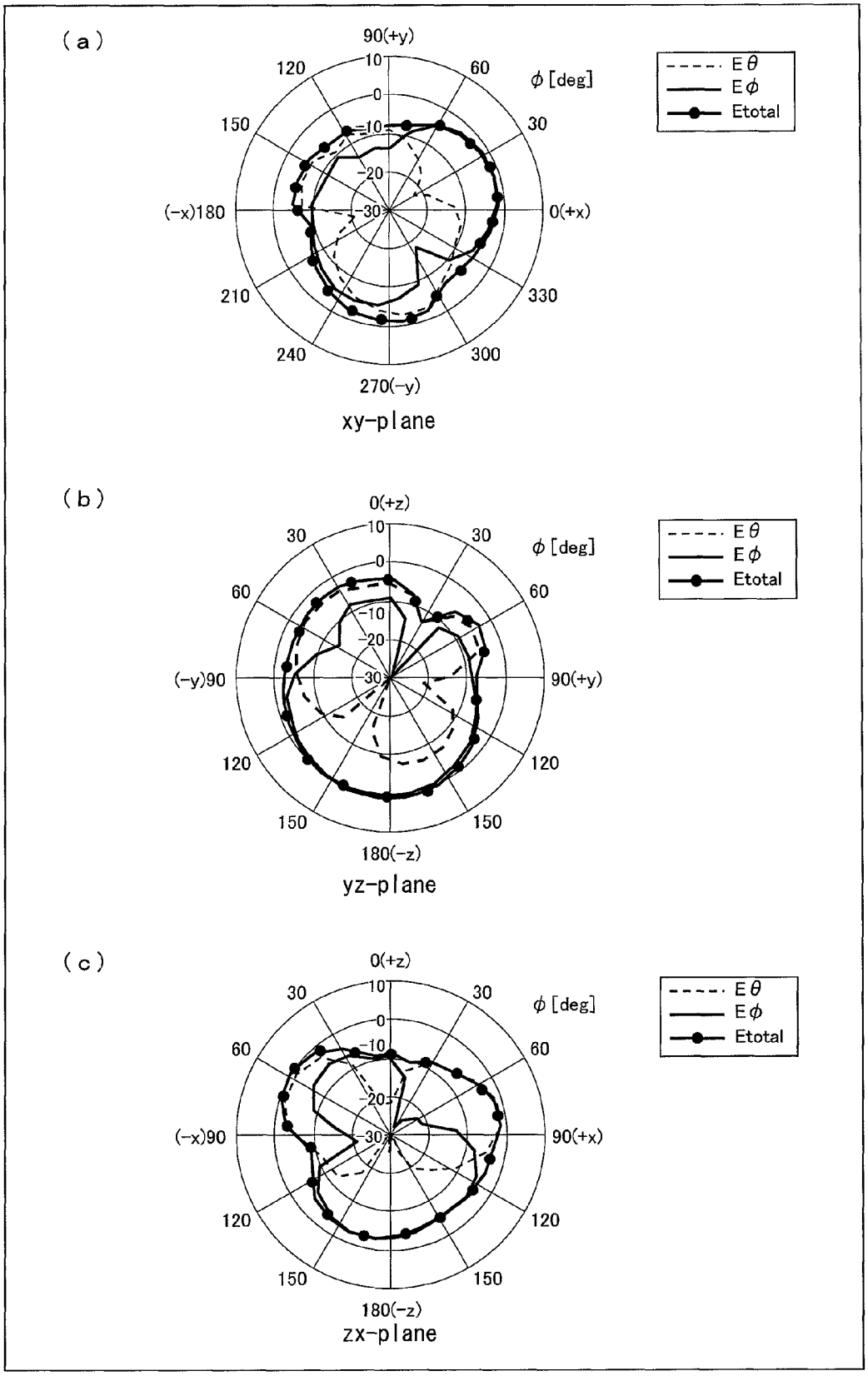
FIG. 33 shows graphs illustrating radiation patterns of the antenna device shown in FIG. 28. (a) of FIG. 33 illustrates an in-xy-plane radiation pattern. (b) of FIG. 33 illustrates an in-yz-plane radiation pattern. (c) of FIG. 33 illustrates an in-zx-plane radiation pattern.

FIG. 33 shows graphs illustrating radiation patterns in a 550 MHz band of the antenna device 201*a* shown in FIG. 28. (*a*) of FIG. 33 illustrates an in-xy-plane radiation pattern. (*b*) of FIG. 33 illustrates an in-yz-plane radiation pattern. (*c*) of FIG. 33 illustrates an in-zx-plane radiation pattern. Note here that the thickness d of the dielectric layer 402 was 5 mm and the specific inductive capacity Er of the dielectric layer 402 was 1.

It is clear from FIG. 33 that a non-directivity radiation characteristic is achieved in all the in-xy-plane radiation pattern, in-yz-plane radiation pattern, and in-zx-plane radiation pattern.

(Specific Examples of where to Mount Antenna Device)

As described earlier, if an antenna device for terrestrial digital broadcasting is put into practical use, the antenna device can be mounted on receiving terminals, i.e., various types of receivers such as mobile phones, car navigation systems, personal computers, and dedicated portable television receivers.

In particular, in a case where such an antenna device is to be mounted on a car, the antenna device of the present invention is remarkably advantageous. The reason is that, in a case where an antenna device is to be mounted on a car 601, the antenna device is necessarily mounted on a conductor material (metal plate) such as for example a rooftop 611, a bumper 615, a rear wing 613, a door 614, a side mirror 615, a trunk 616 or a hood 617 (see FIG. 34).

According to the antenna device of the present invention, it is possible to mount an antenna device in such positions by taking into consideration the effect of a conductor material.

Embodiment 4

The following description discusses a further embodiment of the present invention with reference to the drawings.

Figure 34:
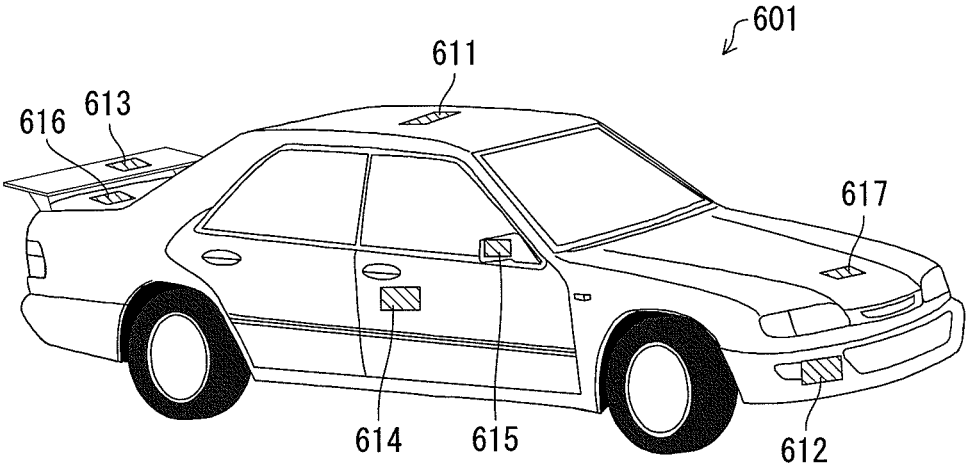
FIG. 34 is a view schematically illustrating specific examples of where in a vehicle an antenna device of the present invention is to be mounted.

Each of the antenna devices described in the foregoing embodiments can be provided outside a vehicle, i.e., on an outer surface of a body of a vehicle (see for example FIG. 34). Further, each of the antenna devices described in the foregoing embodiments can be provided inside a vehicle (see FIGS. 35 to 39). Note that each antenna device illustrated in FIGS. 35 to 39 is given a reference sign 701. The antenna device 701 represents any of the antenna devices described in the foregoing embodiments. Further, the antenna device 701 is provided on a body of a vehicle to form an antenna system for a vehicle.

Figure 35:
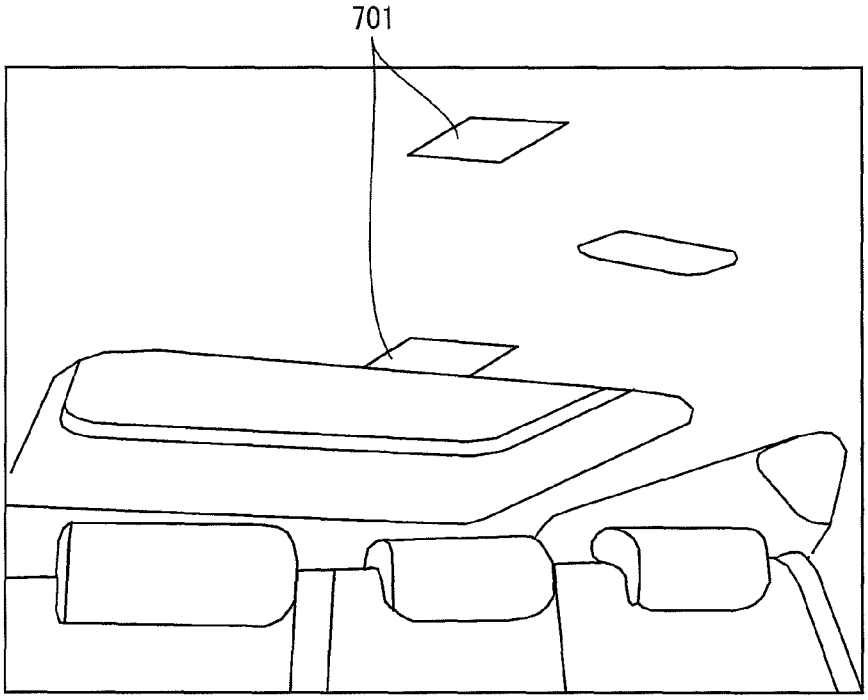
FIG. 35 is a perspective view illustrating how antenna devices of the present embodiment are provided inside a vehicle. Each of the antenna devices is provided, on a back surface of a roof (ceiling of a vehicle), in the vicinity of the center of the roof in a direction of width of the vehicle.
Figure 36:
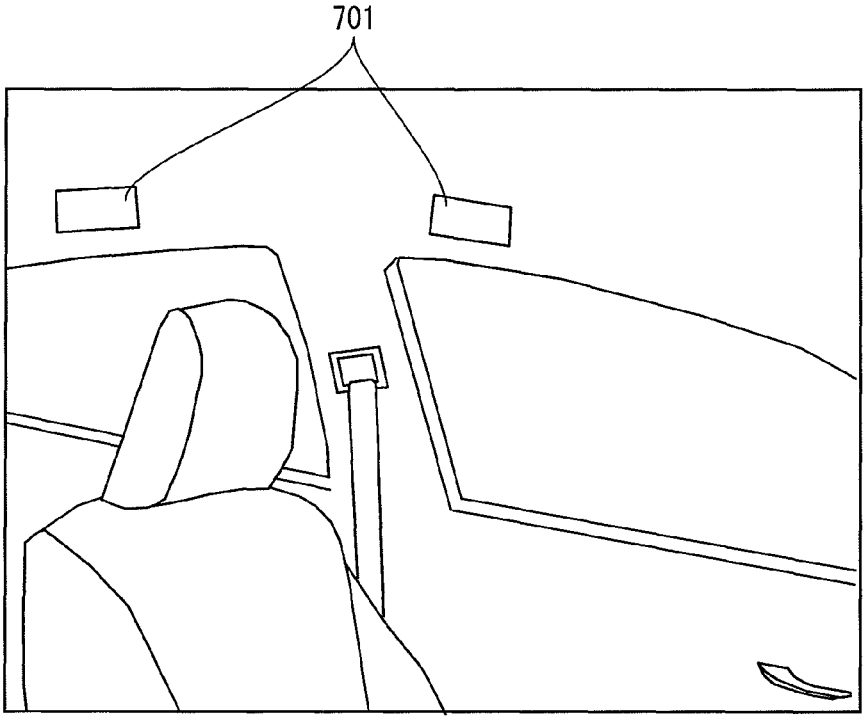
FIG. 36 is a perspective view illustrating how antenna devices of the present embodiment are provided inside a vehicle. Each of the antenna devices is provided, on a back surface of a roof, in the vicinity of a window.
Figure 37:
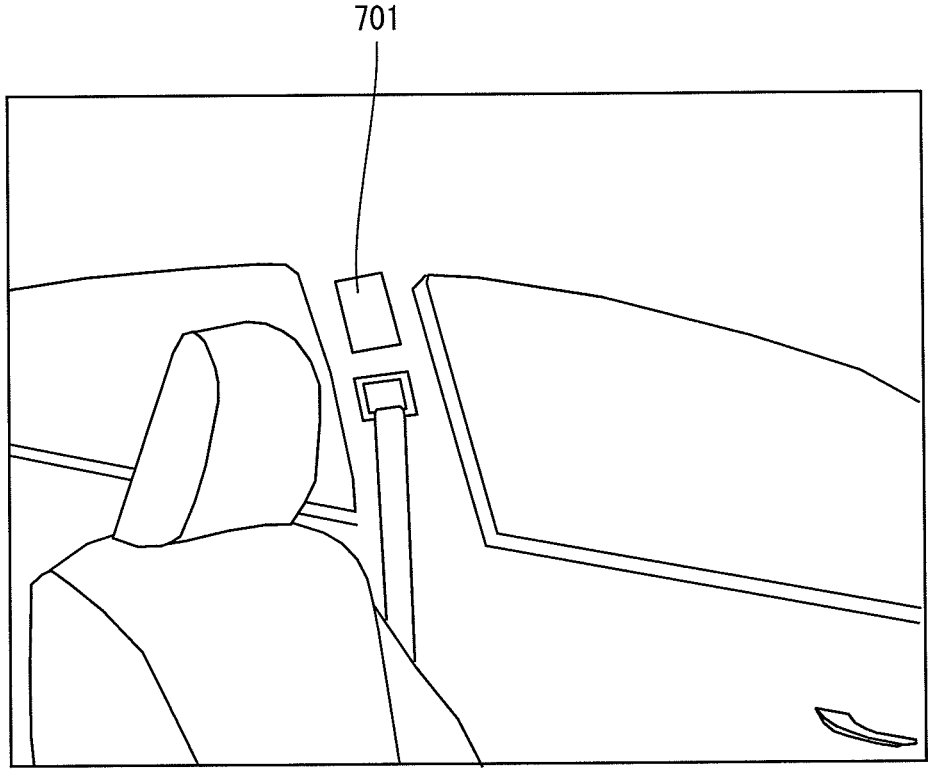
FIG. 37 is perspective view illustrating how an antenna device of the present embodiment is provided on a center pillar inside a vehicle.
Figure 38:
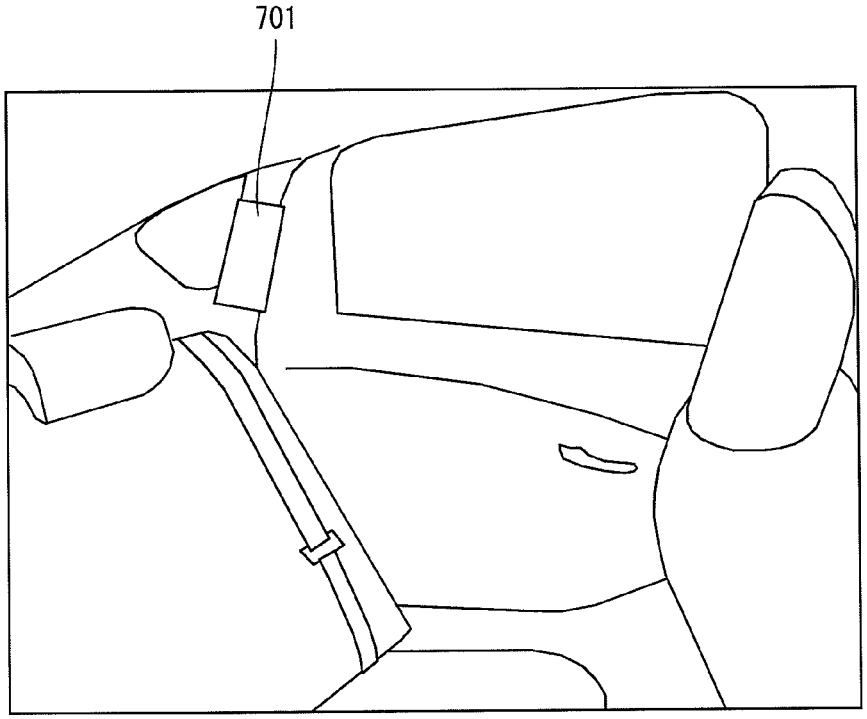
FIG. 38 is a perspective view illustrating how an antenna device of the present embodiment is provided on a rear pillar inside a vehicle.
Figure 39:
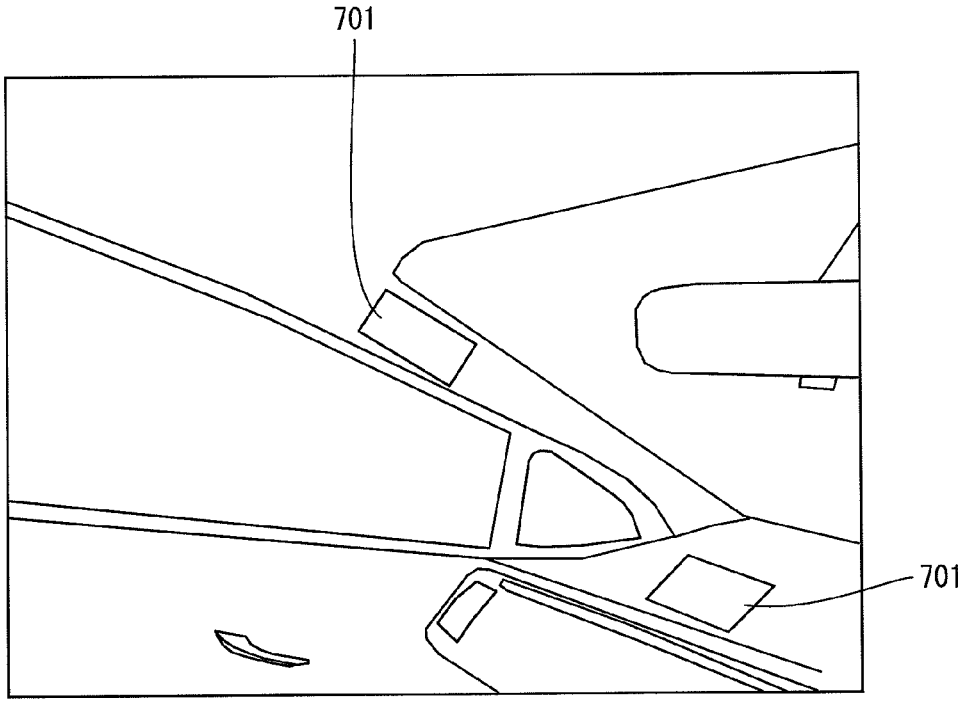
FIG. 39 is a perspective view illustrating how antenna devices of the present embodiment are provided on a front pillar and a dashboard inside a vehicle.

FIG. 35 illustrates antenna devices 701 provided inside a vehicle. The antenna devices 701 are provided, on a back surface of a roof (ceiling of a vehicle), in the vicinity of the center of the roof in a direction of width of a vehicle. FIG. 36 illustrates antenna devices 701 provided inside a vehicle. The antenna devices 701 are provided, on a back surface of a roof, in the vicinities of windows. FIG. 37 illustrates an antenna device 701 provided on a center pillar inside a vehicle. FIG. 38 illustrates an antenna device 701 provided on a rear pillar inside a vehicle. FIG. 39 illustrates antenna devices 701 provided on a front pillar and on a dashboard inside a vehicle.

Each of the antenna devices 701 shown in FIGS. 35 to 39 may be provided either (i) on an outer surface of an interior material inside a vehicle or (ii) inside the interior material, i.e., between a metal constituting a body of a vehicle and the interior material.

In a case where an antenna device 701 is provided on an outer surface of an interior material inside a vehicle, the antenna device 701 is attached to a surface of the interior material with use of for example an adhesion bond. In this case, it is possible to easily secure a distance of 2 mm or greater between the antenna device 701 and a metal constituting a body of the vehicle, because there exists the interior material between them. It should be noted that the "outer surface" and the "surface" of the interior material each denote an outside surface of the interior material, i.e., a surface of the interior material which surface is opposite to a surface that faces a vehicle body material (body of a vehicle).

Figure 40:
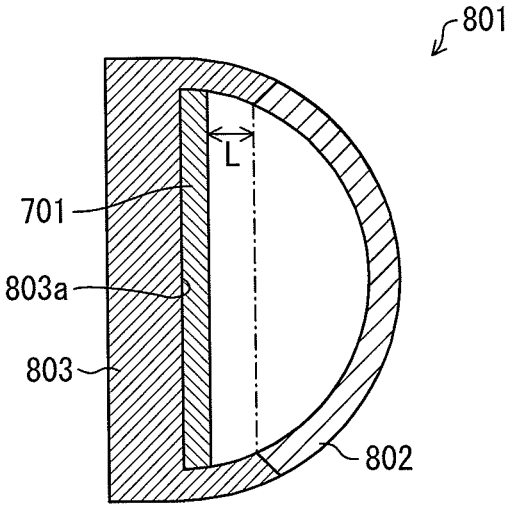
FIG. 40, which is a horizontal cross-sectional view of a pillar, illustrates how an antenna device of the present embodiment is provided between a metal and an interior material in the pillar.

In a case where an antenna device 701 is provided inside an interior material, i.e., provided between the vehicle body material and the interior material, the antenna device 701 is arranged for example as illustrated in FIG. 40. FIG. 40 is a horizontal cross-sectional view illustrating a pillar in which an antenna device 701 is provided between a metal 802 and an interior material 803.

As illustrated in FIG. 40, a pillar 801 has the metal 802 which is a conductor and the interior material 803 which is made from synthetic resin. There is a space between the metal 802 and the interior material 803. The metal 802 has a cross-sectional surface in the form of circular curve, and the interior material 803 has a cross-sectional surface in the form of a straight line or a circular curve. The antenna device 701 is provided in the space and is attached to an inner surface 803*a* of the interior material 803. Further, a minimum distance L between the metal 802-side surface of the antenna device 701 and an inner surface of the metal 802 is 2 mm or greater.

Figure 41:
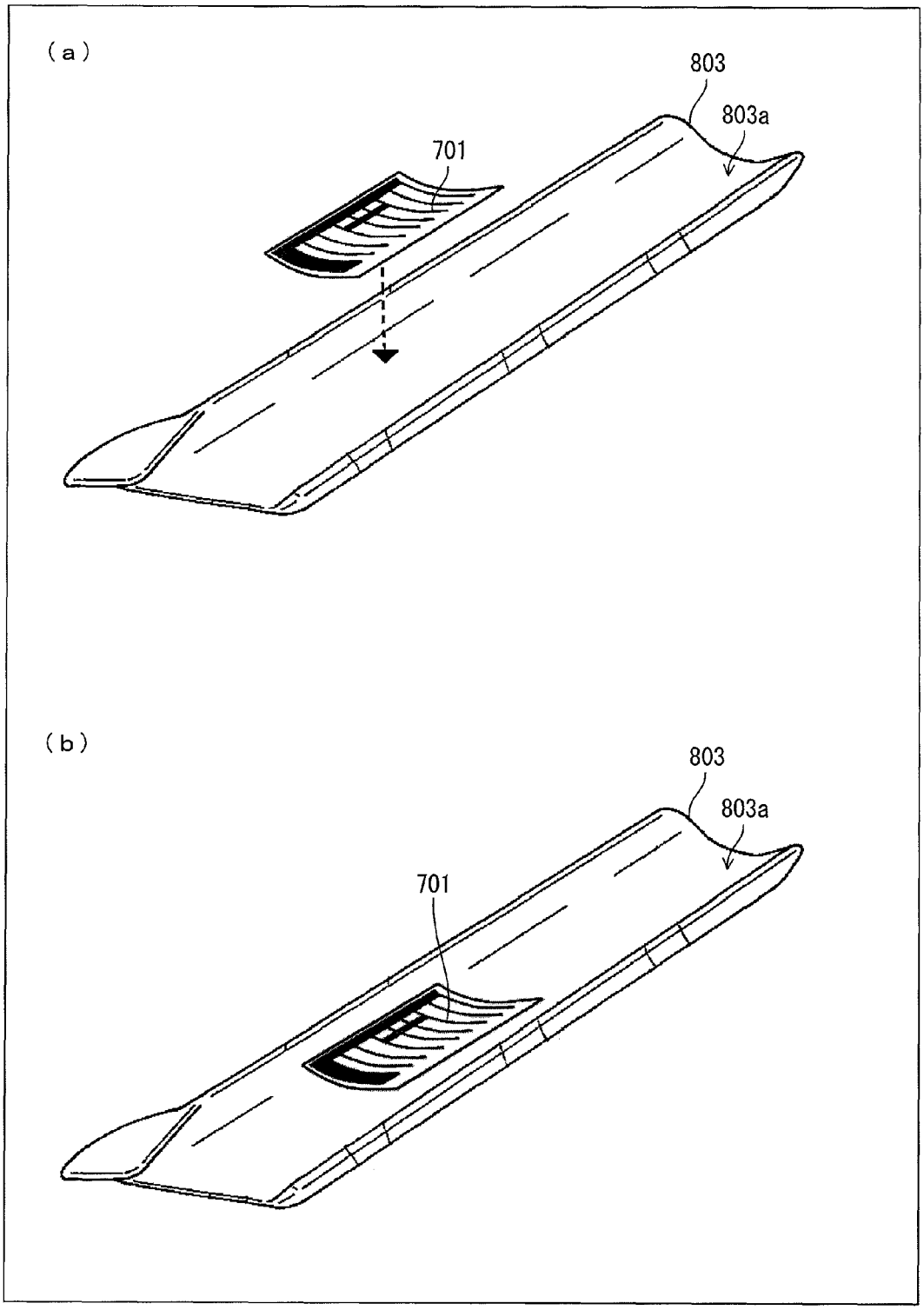
FIG. 41 shows perspective views illustrating how an antenna device of the present embodiment is provided to an interior material inside a vehicle. (*a*) of FIG. 41 is a perspective view illustrating the antenna device which is about to be attached to an inner surface of the interior material inside the vehicle. (*b*) of FIG. 41 is a perspective view illustrating the antenna device which is attached to the inner surface of the interior material inside the vehicle.

(*a*) and (*b*) of FIG. 41 illustrate, in more detail, how the antenna device 701 is arranged with respect to the interior material 803. (*a*) of FIG. 41 is a perspective view illustrating the antenna device 701 which is about to be attached to the inner surface 803*a* of the interior material 803 inside a vehicle. (*b*) of FIG. 41 is a perspective view illustrating the antenna device 701 which is attached to the inner surface 803*a* of the interior material 803 inside the vehicle. As illustrated in (*b*) of FIG. 41, the antenna device 701 has flexibility. Therefore, the antenna device 701 changes in shape to conform to the inner surface 803*a* of the interior material 803, and can therefore be easily attached to the interior material 803.

The above arrangement is not limited to a pillar. The antenna device 701 can be provided inside a vehicle or on an outer surface of the body of the vehicle, which vehicle has the metal 802 constituting the body and the interior material 803, in a plurality of different manners. FIGS. 42 to 45 summarize how the antenna device 701 is arranged with respect to the metal 802 constituting the body of the vehicle and to the interior material 803.

Figure 42:
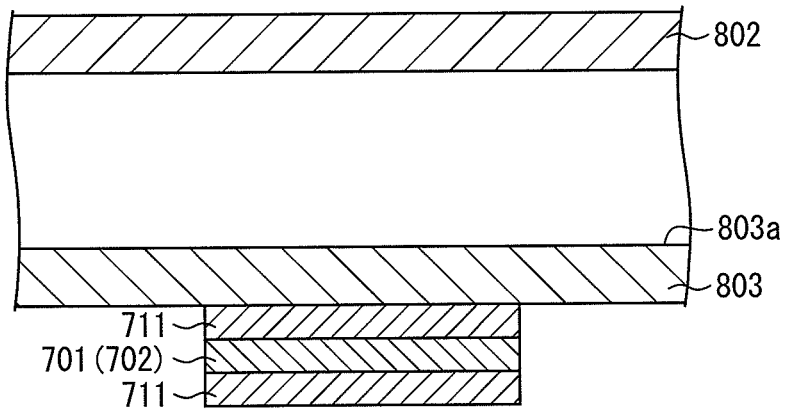
FIG. 42 is a vertical cross-sectional view illustrating how an antenna device of the present embodiment is provided on an outer surface of an interior material inside a vehicle.
Figure 43:
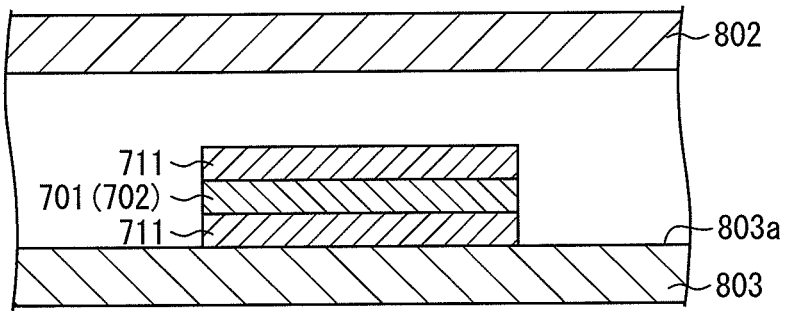
FIG. 43 is a vertical cross-sectional view illustrating how an antenna device of the present embodiment is provided on an inner surface of an interior material inside a vehicle.
Figure 44:
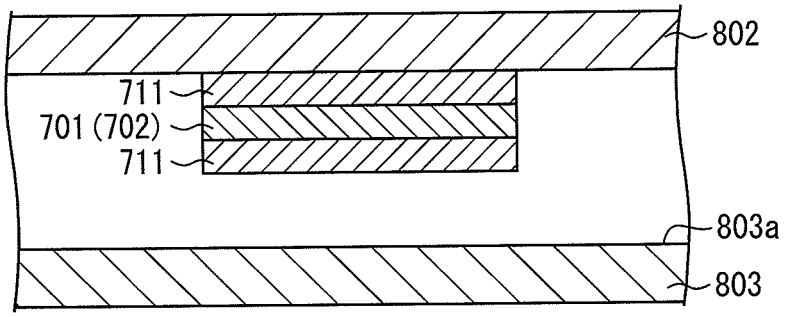
FIG. 44 is a vertical cross-sectional view illustrating how an antenna device of the present embodiment is provided, inside a vehicle, on an inner surface of a metal constituting a body of a vehicle.
Figure 45:
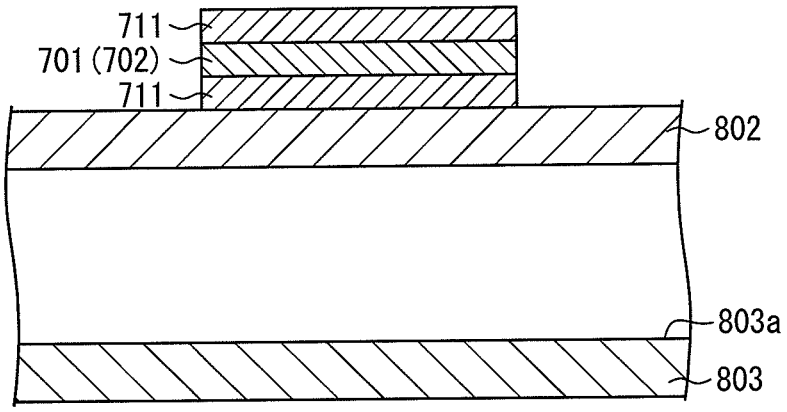
FIG. 45 is a vertical cross-sectional view illustrating how an antenna device of the present embodiment is provided, outside a vehicle, on an outer surface of a metal constituting a body of a vehicle.

FIG. 42 is a vertical cross-sectional view illustrating how the antenna device 701 is provided inside a vehicle on an outer surface of the interior material 803. FIG. 43 is a vertical cross-sectional view illustrating how the antenna device 701 is provided inside a vehicle on the inner surface 803*a* of the interior material 803. FIG. 44 is a vertical cross-sectional view illustrating how the antenna device 701 is provided inside a vehicle on an inner surface of the metal 802 of the body of the vehicle. FIG. 45 is a vertical cross-sectional view illustrating how the antenna device 701 is provided outside a vehicle on an outer surface of the metal 802 of the body of the vehicle.

According to each of examples shown in FIGS. 42 to 45, the antenna device 701 is configured such that both surfaces of an antenna element 702 of the antenna device 701 are coated with a dielectric film serving as a dielectric layer 711. The dielectric film is made of for example PET. In this case, the antenna device 701 can be regarded as having a configuration including the dielectric layer 711. According to such a configuration in which the antenna element 702 of the antenna device 701 is coated with the dielectric layer 711, the dielectric layer 711 provides an antirust function of the antenna element 702. Further, by configuring the dielectric layer 711 such that the dielectric layer 711 has a thickness of equal to or greater than a predetermined thickness (2 mm or greater), it is possible, by virtue of the dielectric layer 711, to secure a predetermined distance (2 mm or greater) between the antenna element 702 and the metal 802 when providing the antenna element 702 on a surface of the metal 802.

It should be noted that, only from the viewpoint of securing a predetermined distance (2 mm or greater) between the antenna element 702 and the metal 802, each of the configurations shown in FIGS. 42 and 43 can omit dielectric layers 711 on both sides of the antenna element 702. Further, the configuration shown in FIG. 44 can omit a dielectric layer 711 on the interior material 803-side of the antenna element 702, whereas the configuration shown in FIG. 45 can omit a dielectric layer 711 on a side opposite to the metal 802-side of the antenna element 702.

As has been described, the present embodiment describes the configurations in which the antenna device 701 is provided inside a vehicle. According to such a configuration in which the antenna device 701 is provided inside a vehicle, for example in a case where a plurality of antenna devices 701 are provided to a vehicle, it is possible to prevent external appearance of the vehicle from being impaired by the antenna devices 701 provided.

Further, in a case where the antenna device 701 is provided inside a vehicle, the antenna device 701 is preferably provided within a predetermined distance D from an aperture passing through the body of the vehicle, such as a window or an aperture in a roof. The predetermined distance D is equal to the longest wavelength (λ) of a frequency in the usable band for the antenna device 701, and more preferably ½λ.

Figure 46:
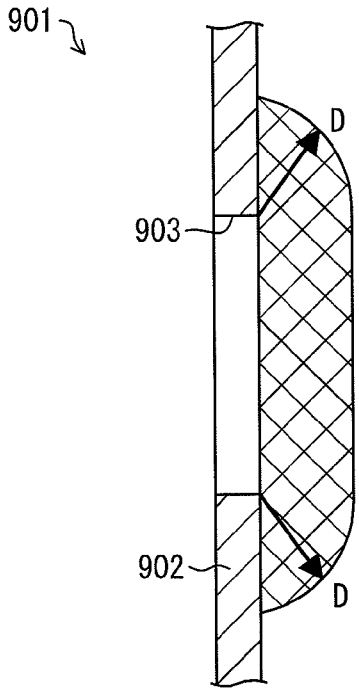
FIG. 46 is a horizontal cross-sectional view illustrating a relevant part of a body of a vehicle, and shows a certain distance D from a window within which distance an antenna device of the present embodiment is to be provided when it is provided inside a vehicle.

FIG. 46, showing the predetermined distance D from a window 903 serving as the aperture in a vehicle 901, is a horizontal cross-sectional view illustrating a relevant part of a body 902. In FIG. 46, a meshed part represents an area within the predetermined distance D.

By providing the antenna device 701 within the predetermined distance D from an aperture passing through a body of a vehicle as described above, it is possible to cause the antenna device 701 to operate under receiving condition with good electric field intensity. In particular, radio waves of the terrestrial digital broadcasting enter the vehicle from a lateral direction. Therefore, providing the antenna device 701 within the predetermined distance D from a window on a lateral side of a body of a vehicle makes it possible to achieve good receiving condition of the terrestrial digital broadcasting.

Embodiment 5

The following description discusses still a further embodiment of the present invention with reference to the drawings. An antenna system of the present embodiment employs, out of the antenna devices 701 described in the foregoing embodiments, a plurality of antenna devices 701 to form a diversity configuration. According to the present embodiment, the plurality of antenna devices 701 for use in the antenna system may have the same configurations or have respective different configurations. Alternatively, at least one of the plurality of antenna devices 701 may have a different configuration.

Generally-known diversity methods of antenna systems are an antenna selection method and a maximum rate synthesizing method. The antenna system of the present embodiment may employ either the antenna selection method or the maximum rate synthesis method.

Figure 47:
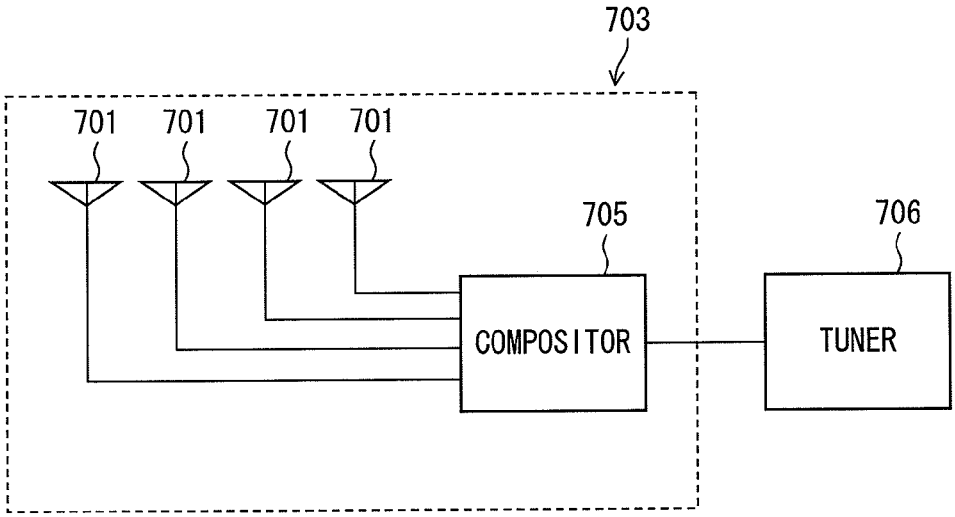
FIG. 47 is a block diagram schematically illustrating a configuration of an antenna system of the present embodiment.

FIG. 47 is a block diagram schematically illustrating an antenna system 703 of the present embodiment. As illustrated in FIG. 47, the antenna system 703 includes for example four antenna devices 701. It should be noted that the number of the antenna devices 701 is not limited to four, and may be any number provided that the number is two or greater. According to the present embodiment, the antenna system 703 employs the maximum rate synthesizing method. Accordingly, each of the antenna devices 701 is connected to a compositor 705. The compositor 705 obtains and synthesizes output signals from the antenna devices 701, and supplies them to for example a tuner 706.

Figure 48:
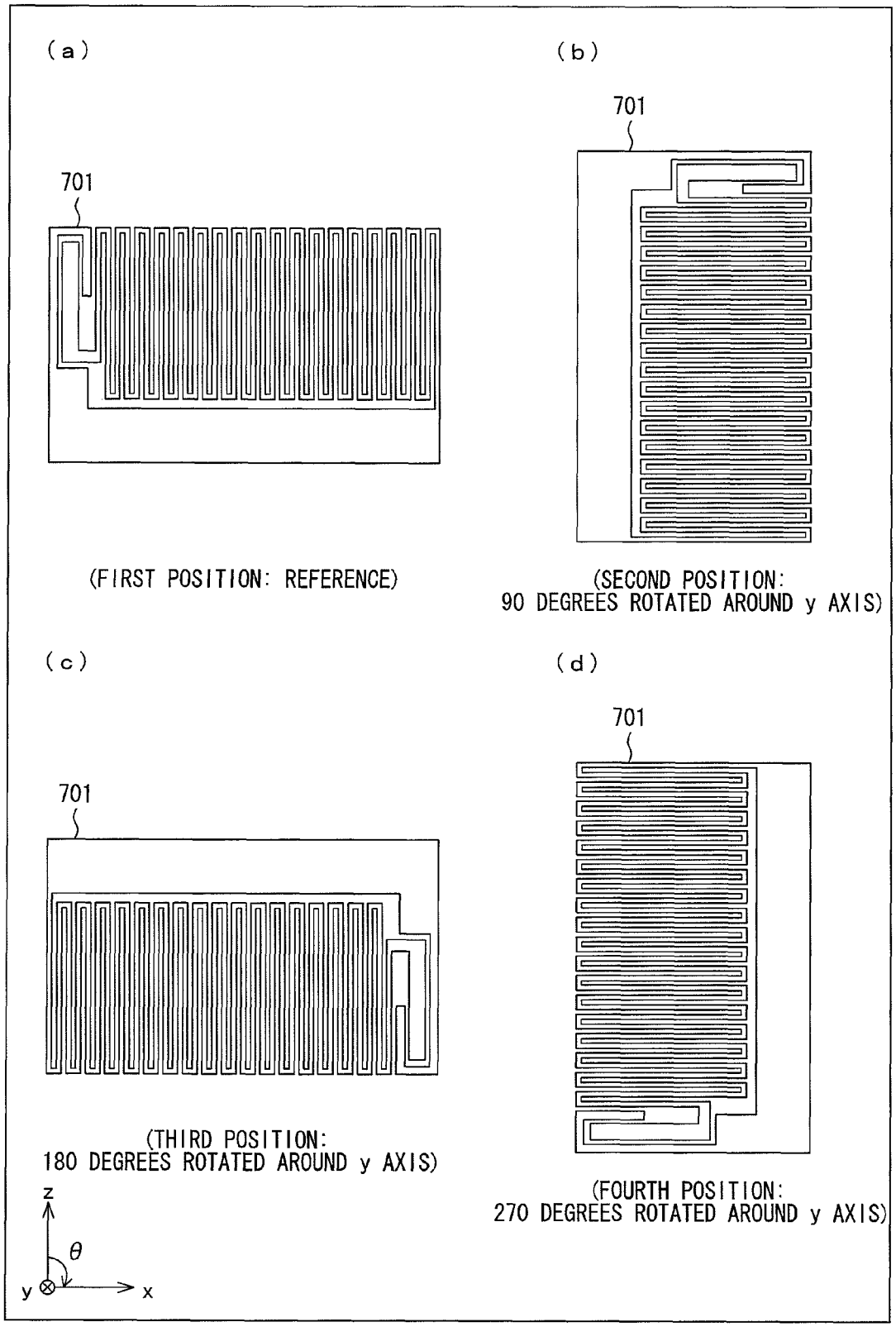
FIG. 48 shows explanatory views illustrating how antenna devices are arranged in a case where four antenna devices of the antenna system shown in FIG. 47 are to be arranged in a single plane to form a diversity configuration. (*a*) of FIG. 48 illustrates an antenna device provided in a first position which serves as a reference. (*b*) of FIG. 48 illustrates an antenna device which is rotated by 90 degrees clockwise from the first position (rotated by 90 degrees around the y axis) so as to be provided in a second position. (*c*) of FIG. 48 illustrates an antenna device which is rotated by 180 degrees clockwise from the first position (rotated by 180 degrees around the y axis) so as to be provided in a third position. (*d*) of FIG. 48 illustrates an antenna device which is rotated by 270 degrees clockwise from the first position (rotated by 270 degrees around the y axis) so as to be provided in a fourth position.

According to the antenna system 703, for example in a case where the four antenna devices 701 are arranged in a single plane to form a diversity configuration, these antenna devices 701 can be arranged for example as illustrated in (*a*) to (*d*) of FIG. 48. (*a*) of FIG. 48 illustrates an antenna device 701 provided in a first position which serves as a reference. (*b*) of FIG. 48 illustrates an antenna device 701 which is rotated by 90 degrees clockwise from the first position (rotated by 90 degrees around the y axis) so as to be provided in a second position. (*c*) of FIG. 48 illustrates an antenna device 701 which is rotated by 180 degrees clockwise from the first position (rotated by 180 degrees around the y axis) so as to be provided in a third position. (*d*) of FIG. 48 illustrates an antenna device 701 which is rotated by 270 degrees clockwise from the first position (rotated by 270 degrees around the y axis) so as to be provided in a fourth position.

Figure 49:
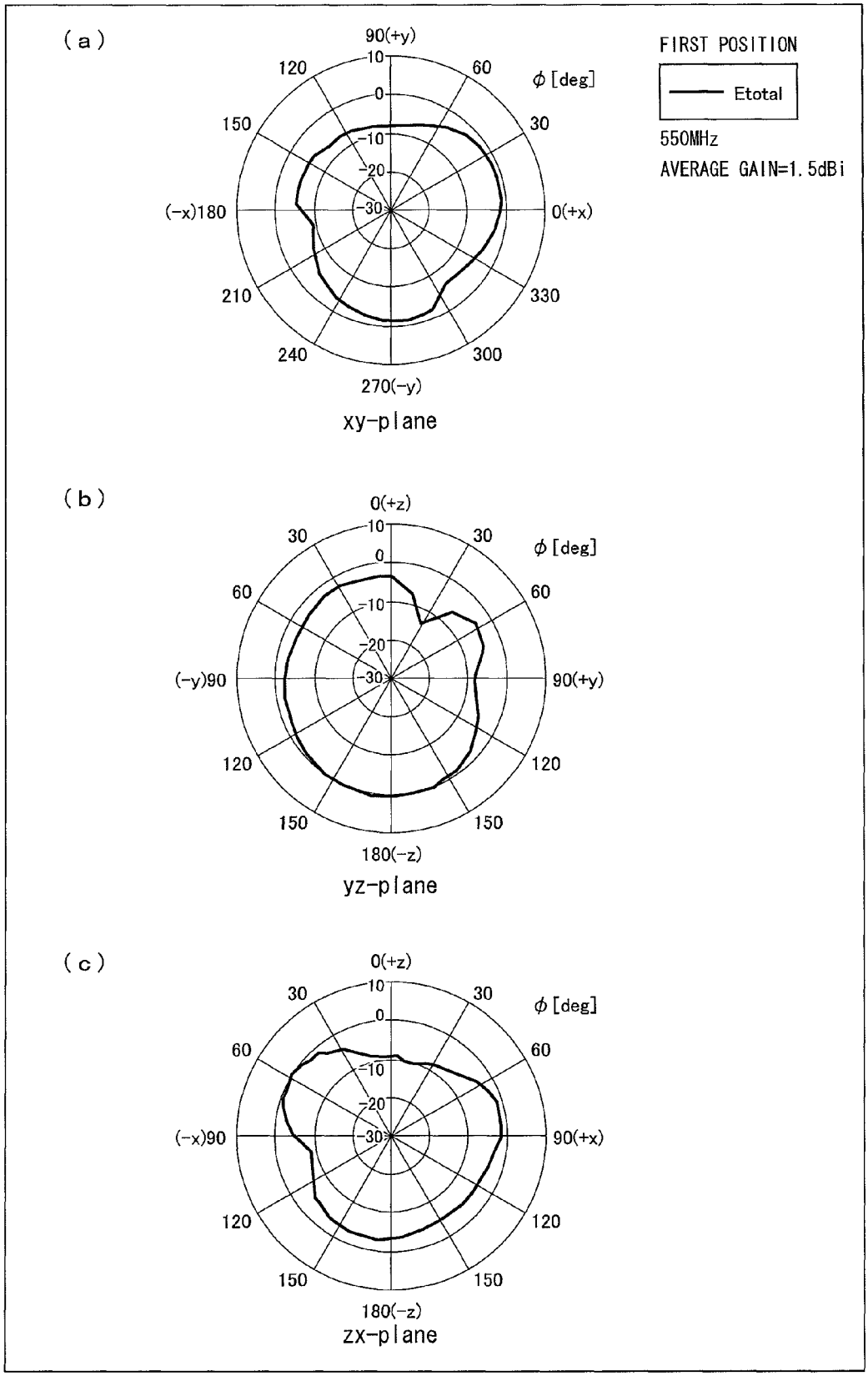
FIG. 49 shows graphs illustrating in-xy-plane, in-yz-plane, and in-zx-plane radiation patterns in a 550 MHz band of the antenna device in the first position shown in (*a*) of FIG. 48. (*a*) of FIG. 49 is a graph illustrating the in-xy-plane radiation pattern. (*b*) of FIG. 49 is a graph illustrating the in-yz-plane radiation pattern. (*c*) of FIG. 49 is a graph illustrating the in-zx-plane radiation pattern.

FIG. 49 illustrates in-xy-plane, in-yz-plane, and in-zx-plane radiation patterns of an antenna device 701 in a 550 MHz band, which are observed when the antenna device 701 is provided in the first position. (*a*) of FIG. 49 is a graph illustrating the in-xy-plane radiation pattern of the antenna device 701. (*b*) of FIG. 49 is a graph illustrating the in-yz-plane radiation pattern of the antenna device 701. (*c*) of FIG. 49 is a graph illustrating the in-zx-plane radiation pattern of the antenna device 701.

Figure 50:
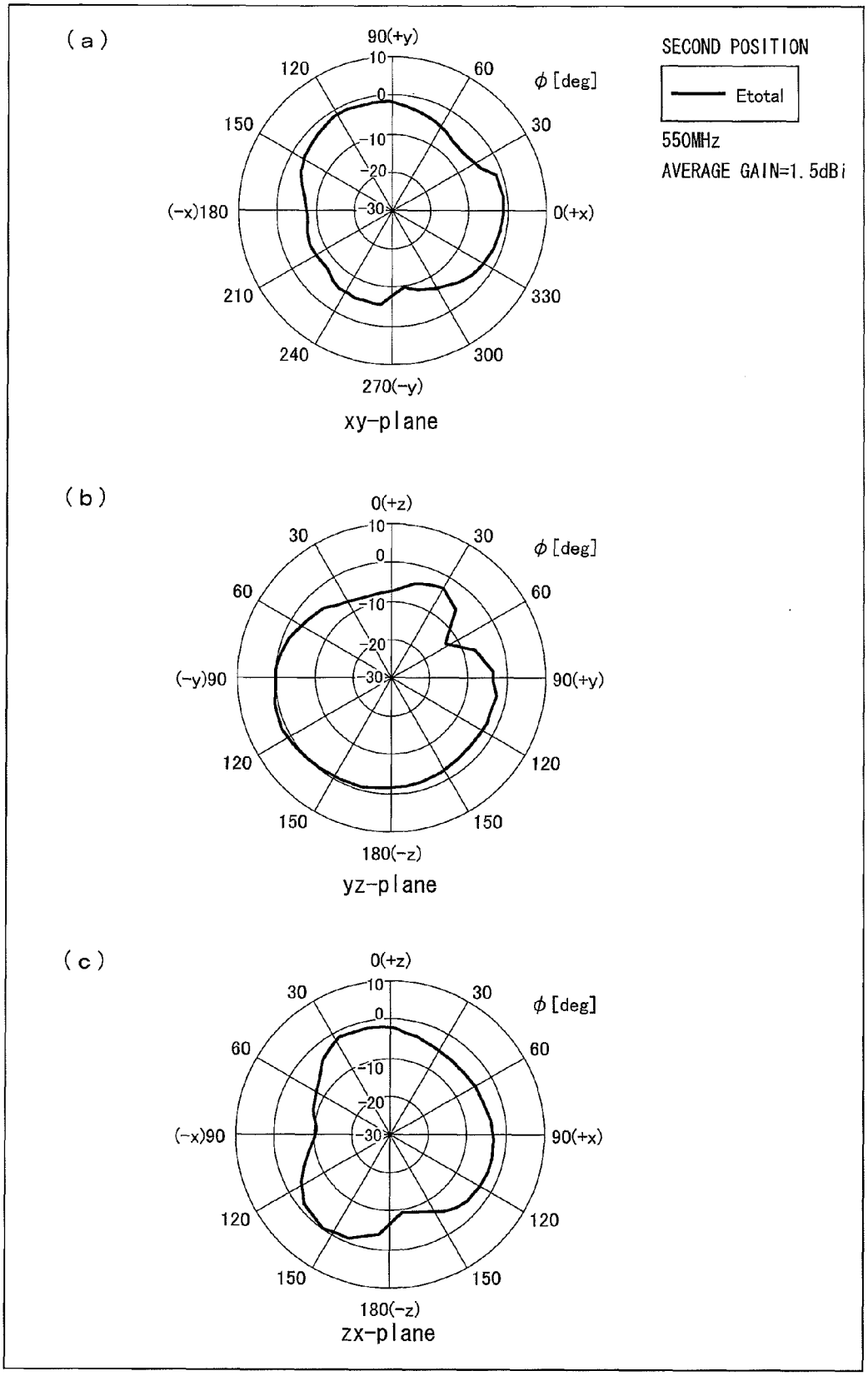
FIG. 50 shows graphs illustrating in-xy-plane, in-yz-plane, and in-zx-plane radiation patterns in a 550 MHz band of the antenna device in the second position shown in (*b*) of FIG. 48. (*a*) of FIG. 50 is a graph illustrating the in-xy-plane radiation pattern. (*b*) of FIG. 50 is a graph illustrating the in-yz-plane radiation pattern. (*c*) of FIG. 50 is a graph illustrating the in-zx-plane radiation pattern.

FIG. 50 illustrates in-xy-plane, in-yz-plane, and in-zx-plane radiation patterns of an antenna device 701 in the 550 MHz band, which are observed when the antenna device 701 is provided in the second position. (*a*) of FIG. 50 is a graph illustrating the in-xy-plane radiation pattern of the antenna device 701. (*b*) of FIG. 50 is a graph illustrating the in-yz-plane radiation pattern of the antenna device 701. (*c*) of FIG. 50 is a graph illustrating the in-zx-plane radiation pattern of the antenna device 701.

Figure 51:
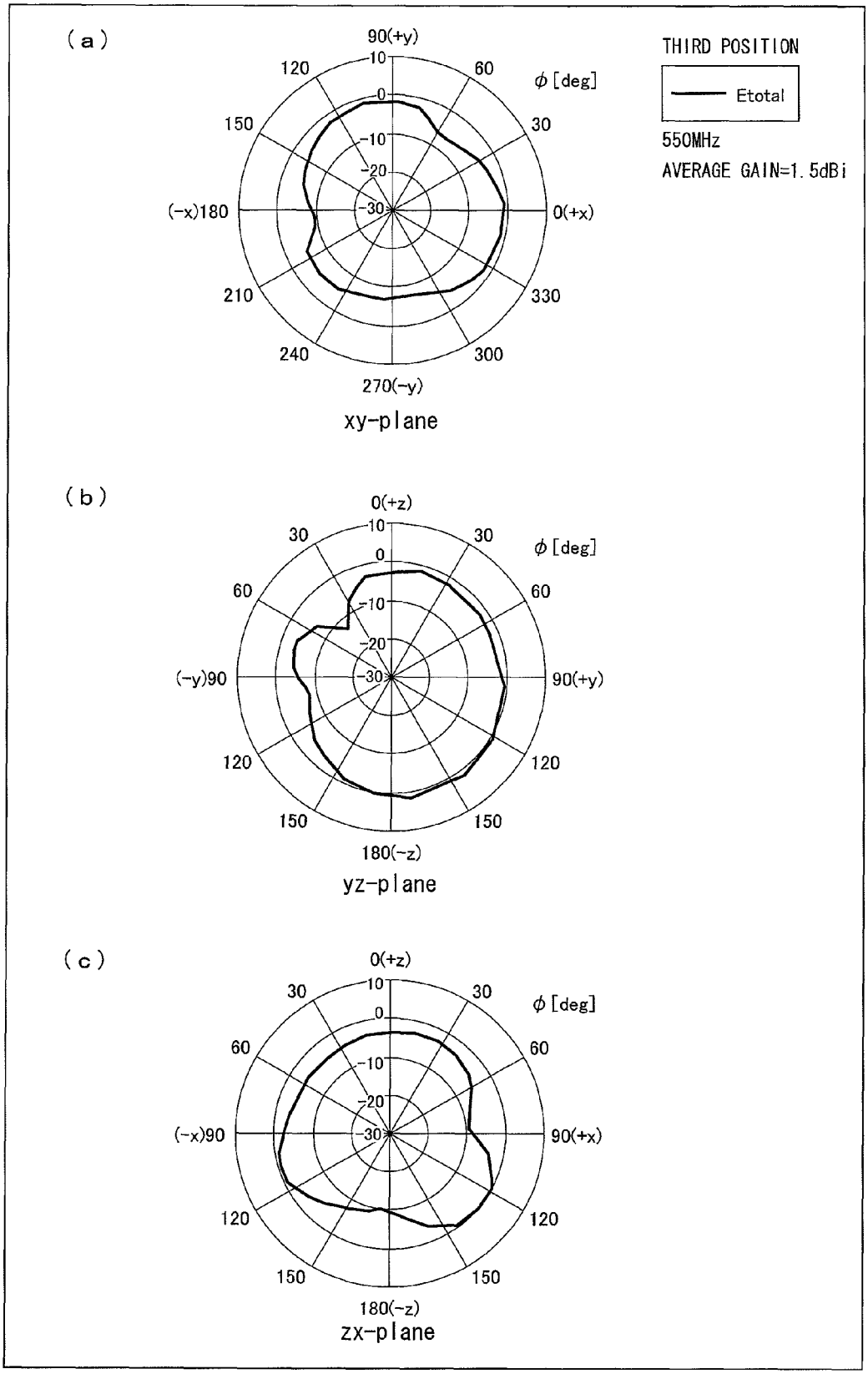
FIG. 51 shows graphs illustrating in-xy-plane, in-yz-plane, and in-zx-plane radiation patterns in a 550 MHz band of the antenna device in the third position shown in (*c*) of FIG. 48. (*a*) of FIG. 51 is a graph illustrating the in-xy-plane radiation pattern. (*b*) of FIG. 51 is a graph illustrating the in-yz-plane radiation pattern. (*c*) of FIG. 51 is a graph illustrating the in-zx-plane radiation pattern.

FIG. 51 illustrates in-xy-plane, in-yz-plane, and in-zy-plane radiation patterns of an antenna device 701 in the 550 MHz band, which are observed when the antenna device 701 is provided in the third position. (*a*) of FIG. 51 is a graph illustrating the in-xy-plane radiation pattern of the antenna device 701. (*b*) of FIG. 51 is a graph illustrating the in-yz-plane radiation pattern of the antenna device 701. (*c*) of FIG. 51 is a graph illustrating the in-zx-plane radiation pattern of the antenna device 701.

Figure 52:
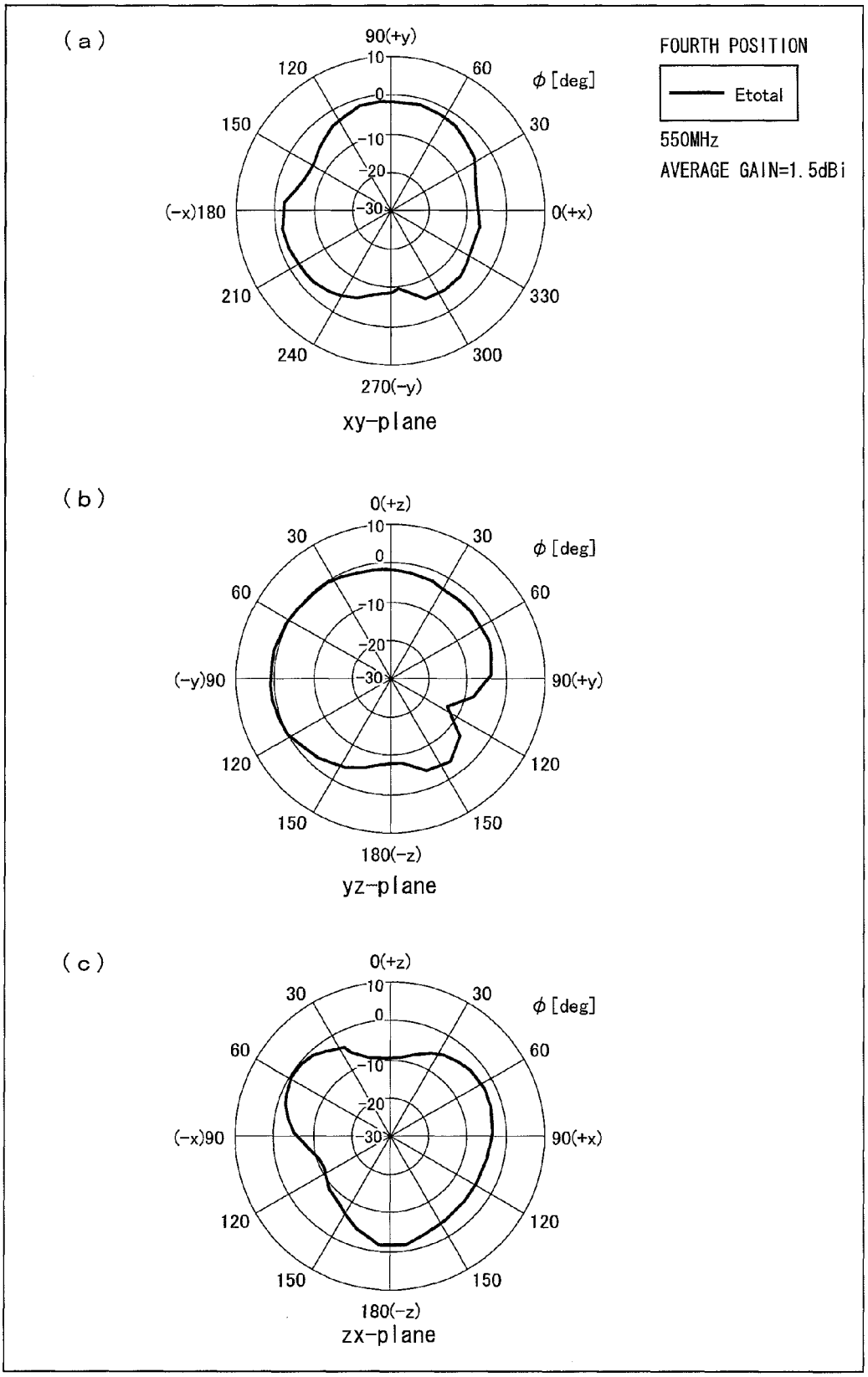
FIG. 52 shows graphs illustrating in-xy-plane, in-yz-plane, and in-zx-plane radiation patterns in a 550 MHz band of the antenna device in the fourth position shown in (*d*) of FIG. 48. (*a*) of FIG. 52 is a graph illustrating the in-xy-plane radiation pattern. (*b*) of FIG. 52 is a graph illustrating the in-yz-plane radiation pattern. (*c*) of FIG. 52 is a graph illustrating the in-zx-plane radiation pattern.

FIG. 52 illustrates in-xy-plane, in-yz-plane, and in-zx-plane radiation patterns of an antenna device 701 in the 550 MHz band, which are observed when the antenna device 701 is provided in the fourth position. (*a*) of FIG. 52 is a graph illustrating the in-xy-plane radiation pattern of the antenna device 701. (*b*) of FIG. 52 is a graph illustrating the in-yz-plane radiation pattern of the antenna device 701. (*c*) of FIG. 52 is a graph illustrating the in-zx-plane radiation pattern of the antenna device 701.

Figure 53:
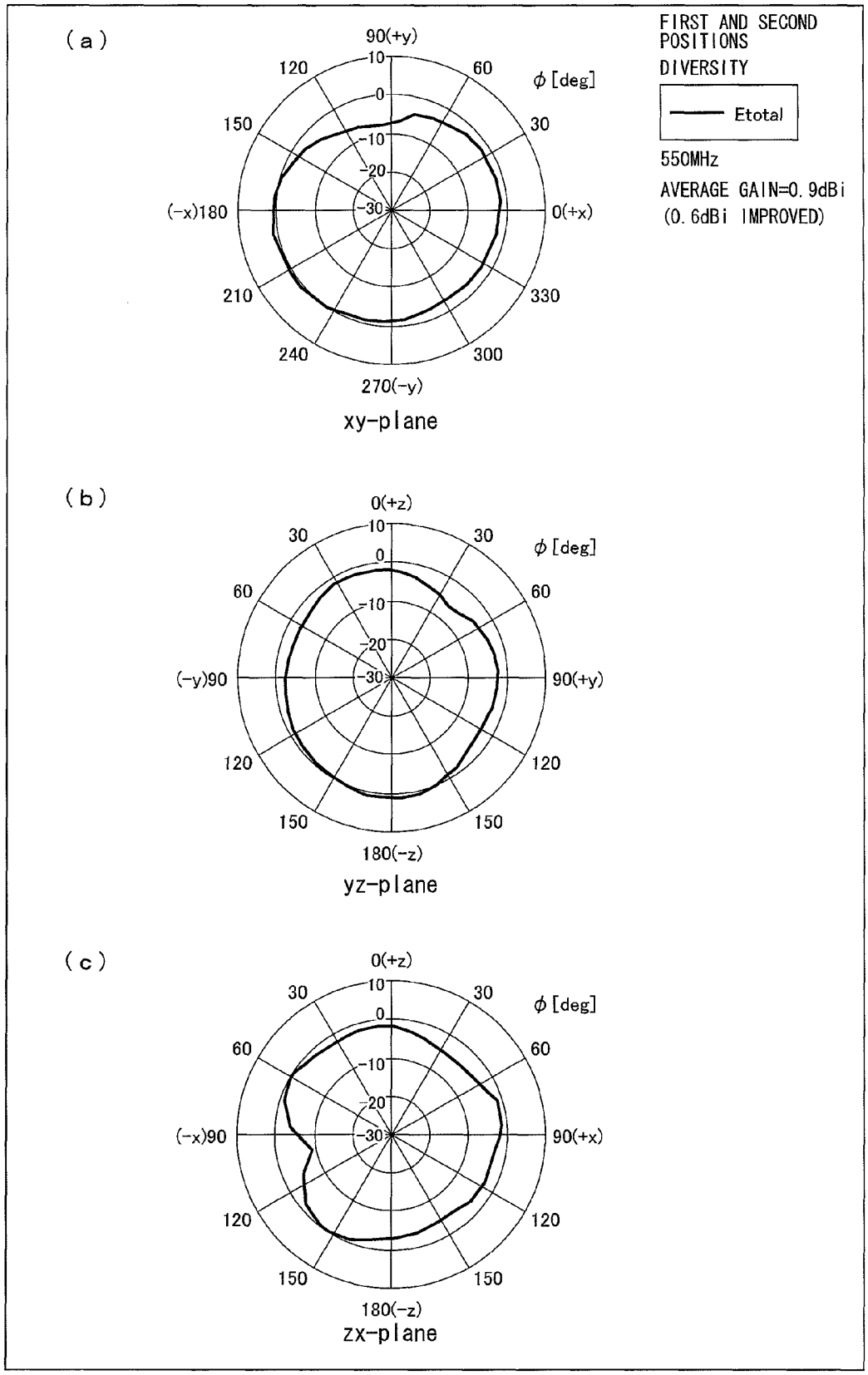
FIG. 53 shows graphs illustrating in-xy-plane, in-yz-plane, and in-zx-plane radiation patterns in a 550 MHz band observed when diversity is carried out by using the antenna devices in the first and second positions shown in (a) and (*b*) of FIG. 48. (*a*) of FIG. 53 is a graph illustrating the in-xy-plane radiation pattern. (*b*) of FIG. 53 is a graph illustrating the in-yz-plane radiation pattern. (*c*) of FIG. 53 is a graph illustrating the in-zx-plane radiation pattern.

Accordingly, in a case where diversity is carried out by using the antenna devices 701 in the first and second positions, the in-xy-plane, in-yz-plane, and in-zx-plane radiation patterns in the 550 MHz band of the antenna devices 701 obtained from the compositor 705 of the antenna system 703 are those shown in FIG. 53. (*a*) of FIG. 53 is a graph illustrating the in-xy-plane radiation pattern of the antenna devices 701 in the first and second positions. (*b*) of FIG. 53 is a graph illustrating the in-yz-plane radiation pattern of the antenna devices 701 in the first and second positions. (*c*) of FIG. 53 is a graph illustrating the in-zx-plane radiation pattern of the antenna devices 701 in the first and second positions.

Figure 54:
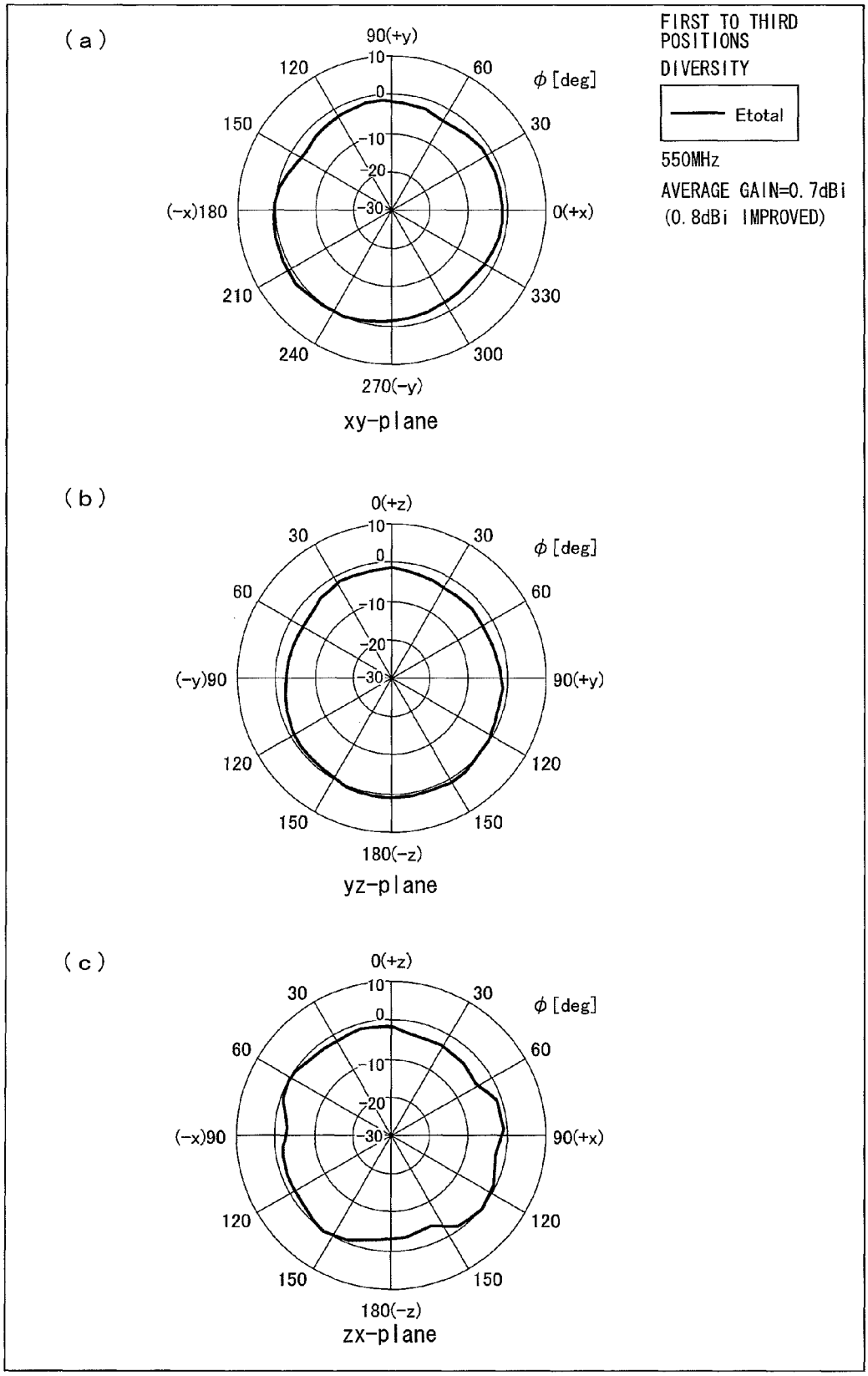
FIG. 54 shows graphs illustrating in-xy-plane, in-yz-plane, and in-zx-plane radiation patterns in a 550 MHz band observed when diversity is carried out by using the antenna devices in the first to third positions shown in (a) to (*c*) of FIG. 48. (*a*) of FIG. 54 is a graph illustrating the in-xy-plane radiation pattern. (*b*) of FIG. 54 is a graph illustrating the in-yz-plane radiation pattern. (*c*) of FIG. 54 is a graph illustrating the in-zx-plane radiation pattern.

Further, in a case where diversity is carried out by using the antenna devices 701 in the first to third positions, the in-xy-plane, in-yz-plane, and in-zx-plane radiation patterns in the 550 MHz band of the antenna devices 701 obtained from the compositor 705 of the antenna system 703 are those shown in FIG. 54. (*a*) of FIG. 54 is a graph illustrating the in-xy-plane radiation pattern of the antenna devices 701 in the first to third positions. (*b*) of FIG. 54 is a graph illustrating the in-yz-plane radiation pattern of the antenna devices 701 in the first to third positions. (*c*) of FIG. 54 is a graph illustrating the in-zx-plane radiation pattern of the antenna devices 701 in the first to third positions.

Figure 55:
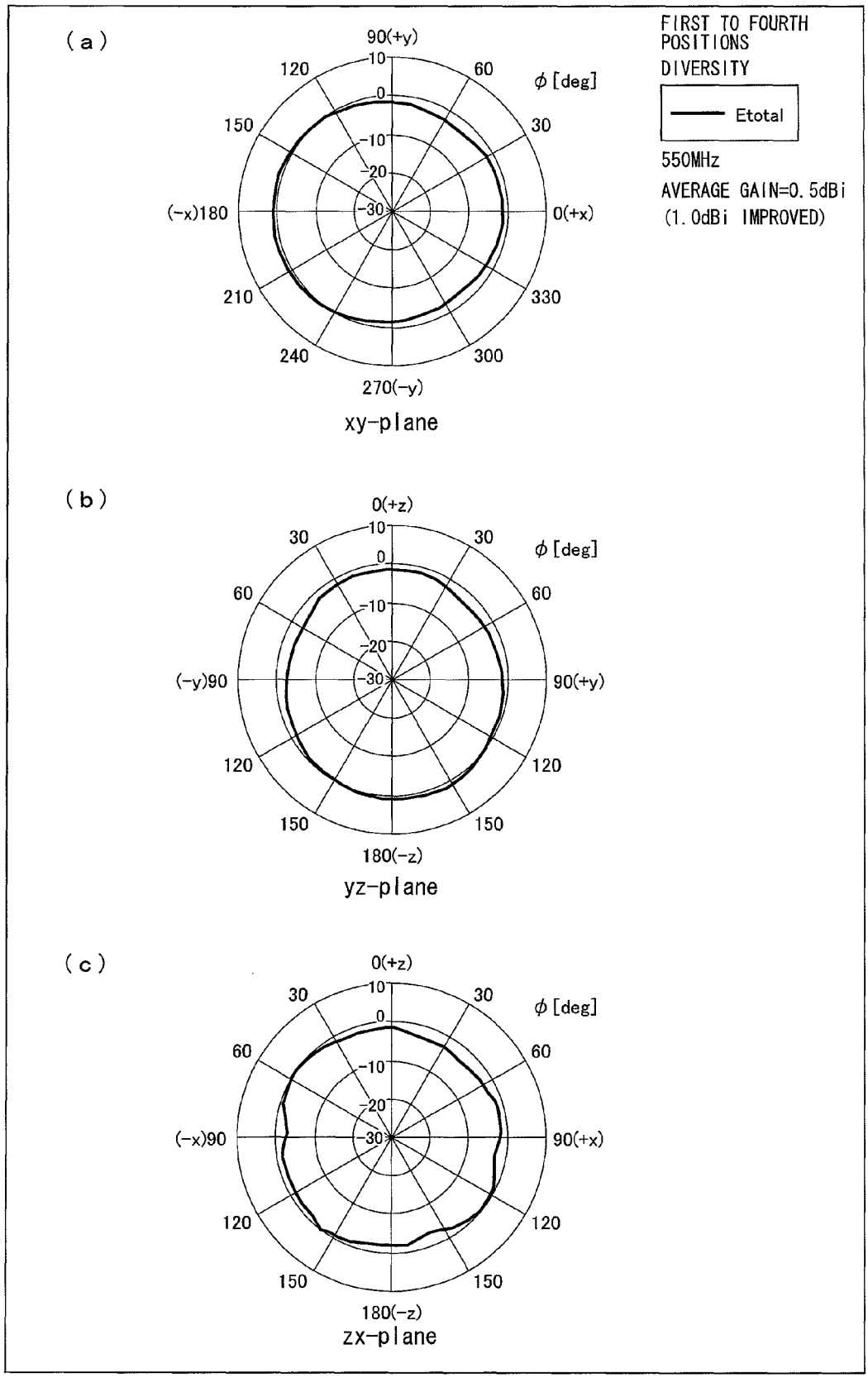
FIG. 55 shows graphs illustrating in-xy-plane, in-yz-plane, and in-zx-plane radiation patterns in a 550 MHz band observed when diversity is carried out by using the antenna devices in the first to fourth positions shown in (a) to (*d*) of FIG. 48. (*a*) of FIG. 55 is a graph illustrating the in-xy-plane radiation pattern. (*b*) of FIG. 55 is a graph illustrating the in-yz-plane radiation pattern. (*c*) of FIG. 55 is a graph illustrating the in-zx-plane radiation pattern.

Further, in a case where diversity is carried out by using the antenna devices 701 in the first to fourth positions, the in-xy-plane, in-yz-plane, and in-zx-plane radiation patterns in the 550 MHz band of the antenna devices 701 obtained from the compositor 705 of the antenna system 703 are those shown in FIG. 55. (*a*) of FIG. 55 is a graph illustrating the in-xy-plane radiation pattern of the antenna devices 701 in the first to fourth positions. (*b*) of FIG. 55 is a graph illustrating the in-yz-plane radiation pattern of the antenna devices 701 in the first to fourth positions. (*c*) of FIG. 55 is a graph illustrating the in-zx-plane radiation pattern of the antenna devices 701 in the first to fourth positions.

As illustrated in FIG. 55, in a case where diversity is carried out by using the antenna devices 701 in the first to fourth positions, it is possible for the antenna system 703 to obtain good and uniform gain in each of the x, y and z axis directions even if each of the antenna devices 701 is provided on the body 902 of the vehicle 901.

Figure 56:
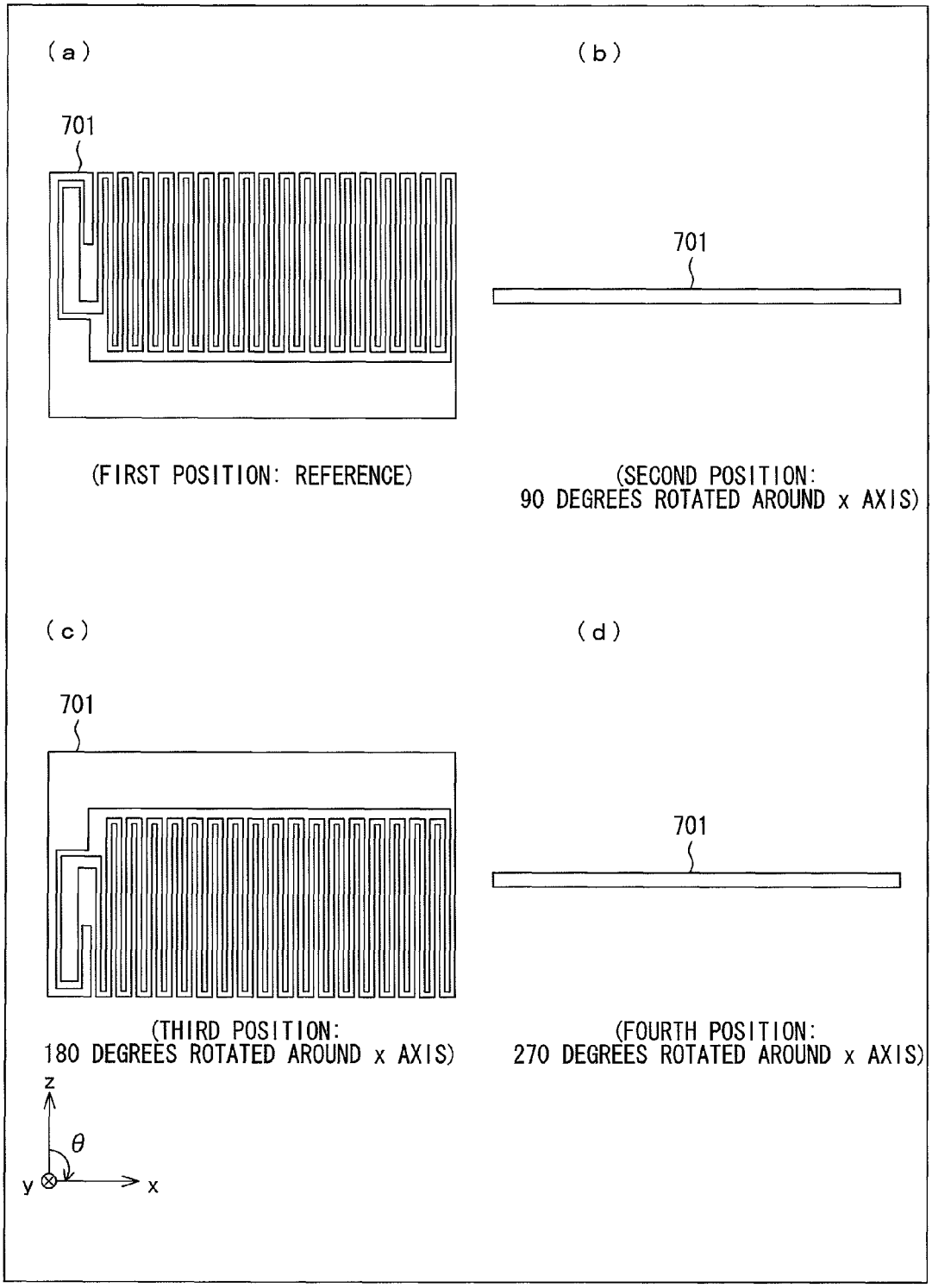
FIG. 56 shows explanatory views illustrating how antenna devices are arranged in a case where four antenna devices of the antenna system shown in FIG. 47 are arranged so as to be rotated around the x axis from each other to form a diversity configuration. (*a*) of FIG. 56 illustrates an antenna device provided in a first position which serves as a reference. (*b*) of FIG. 56 illustrates an antenna device which is rotated by 90 degrees from the first position around the x axis so as to be provided in a second position. (*c*) of FIG. 56 illustrates an antenna device which is rotated by 180 degrees from the first position around the x axis so as to be provided in a third position. (*d*) of FIG. 56 illustrates an antenna device which is rotated by 270 degrees from the first position around the x axis so as to be provided in a fourth position.

Further, in a case where for example the four antenna devices 701 of the antenna system 703 are to be arranged so as to be rotated around the x axis from each other to form a diversity configuration, these antenna devices 701 can be arranged for example as illustrated in (*a*) to (*d*) of FIG. 56. (*a*) of FIG. 56 illustrates an antenna device 701 provided in a first position which serves as a reference. (*b*) of FIG. 56 illustrates an antenna device 701 which is rotated by 90 degrees from the first position around the x axis so as to be provided in a second position. (*c*) of FIG. 56 illustrates an antenna device 701 which is rotated by 180 degrees from the first position around the x axis so as to be provided in a third position. (*d*) of FIG. 56 illustrates an antenna device 701 which is rotated by 270 degrees from the first position around the x axis so as to be provided in a fourth position.

Figure 57:
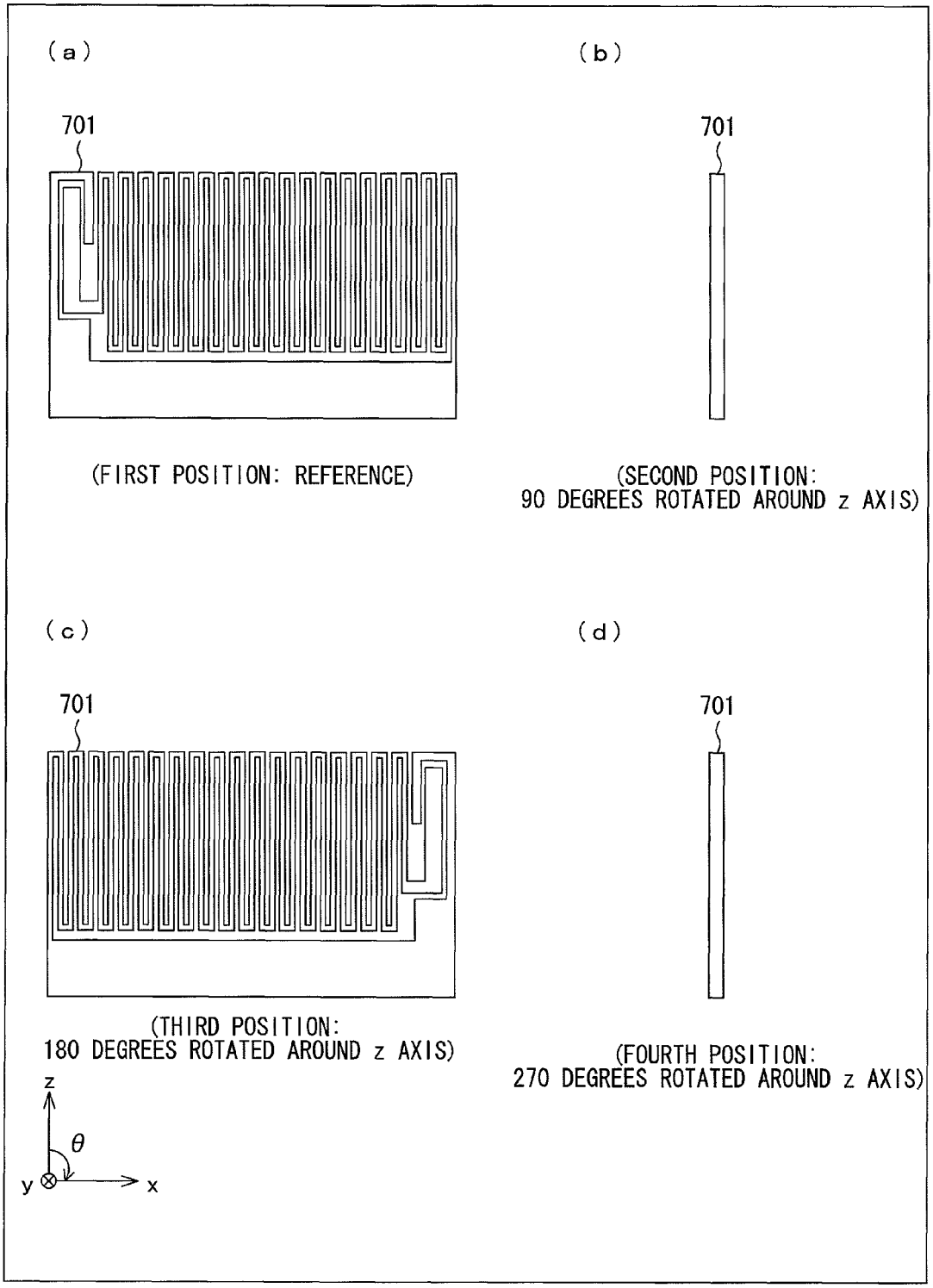
FIG. 57 shows explanatory views illustrating how antenna devices are arranged in a case where four antenna devices of the antenna system shown in FIG. 47 are arranged so as to be rotated around the z axis from each other to form a diversity configuration. (*a*) of FIG. 57 illustrates an antenna device provided in a first position which serves as a reference. (*b*) of FIG. 57 illustrates an antenna device which is rotated by 90 degrees from the first position around the z axis so as to be provided in a second position. (*c*) of FIG. 57 illustrates an antenna device which is rotated by 180 degrees from the first position around the z axis so as to be provided in a third position. (*d*) of FIG. 57 illustrates an antenna device which is rotated by 270 degrees from the first position around the z axis so as to be provided in a fourth position.

Further, in a case where for example the four antenna devices 701 of the antenna system 703 are to be arranged so as to be rotated around the z axis to form a diversity configuration, these antenna devices 701 can be arranged for example as illustrated in (*a*) to (*d*) of FIG. 57. (*a*) of FIG. 57 illustrates an antenna device 701 provided in a first position which serves as a reference. (*b*) of FIG. 57 illustrates an antenna device 701 which is rotated by 90 degrees from the first position around z axis so as to be provided in a second position. (*c*) of FIG. 57 illustrates an antenna device 701 which is rotated by 180 degrees from the first position around the z axis so as to be provided in a third position. (*d*) of FIG. 57 illustrates an antenna device 701 which is rotated by 270 degrees from the first position around the z axis so as to be provided in a fourth position.

It should be noted that, according to examples shown in FIGS. 48 to 57, diversity is carried out by arranging a plurality of antenna devices 701 of the antenna system 703 in respective different directions. Note, however, that this does not imply any limitation. A configuration in which the plurality of antenna devices 701 are arranged in an identical direction also can bring about the effect of improving a gain.

Figure 58:
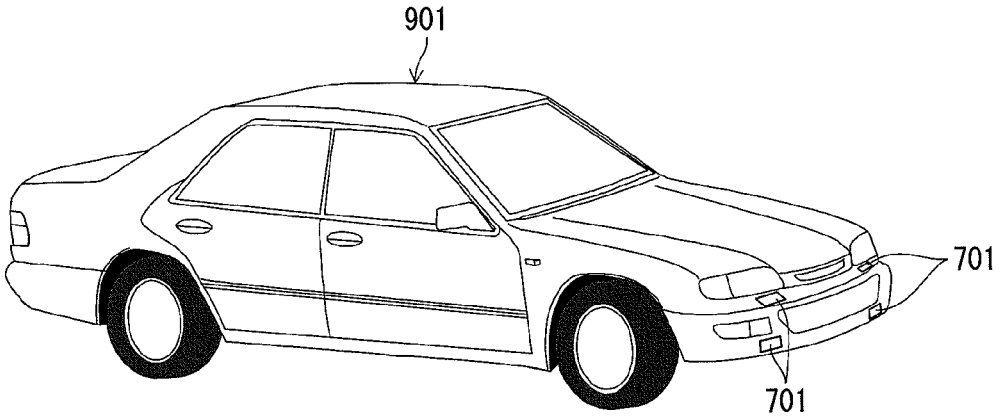
FIG. 58 is a perspective view illustrating how four antenna devices of the antenna system shown in FIG. 47 are provided in respective planes, of a bumper of a vehicle, which are at respective different angles.

In a case where a plurality of antenna devices 701 of the antenna system 703 are arranged so as to be rotated around the x axis or around the z axis from each other, the antenna devices 701 can be provided on surfaces, of a bumper of the vehicle 901, which are at different angles (for example, see FIG. 58). FIG. 58 is a perspective view illustrating how the four antenna devices 701 of the antenna system 703 shown in FIG. 47 are provided on surfaces, of the bumper of the vehicle 901, which are at different angles.

The following description discusses another example of how a plurality of antenna devices 701 included in the antenna system 703 are provided (mounted) on the body 902 of the vehicle 901.

Figure 59:
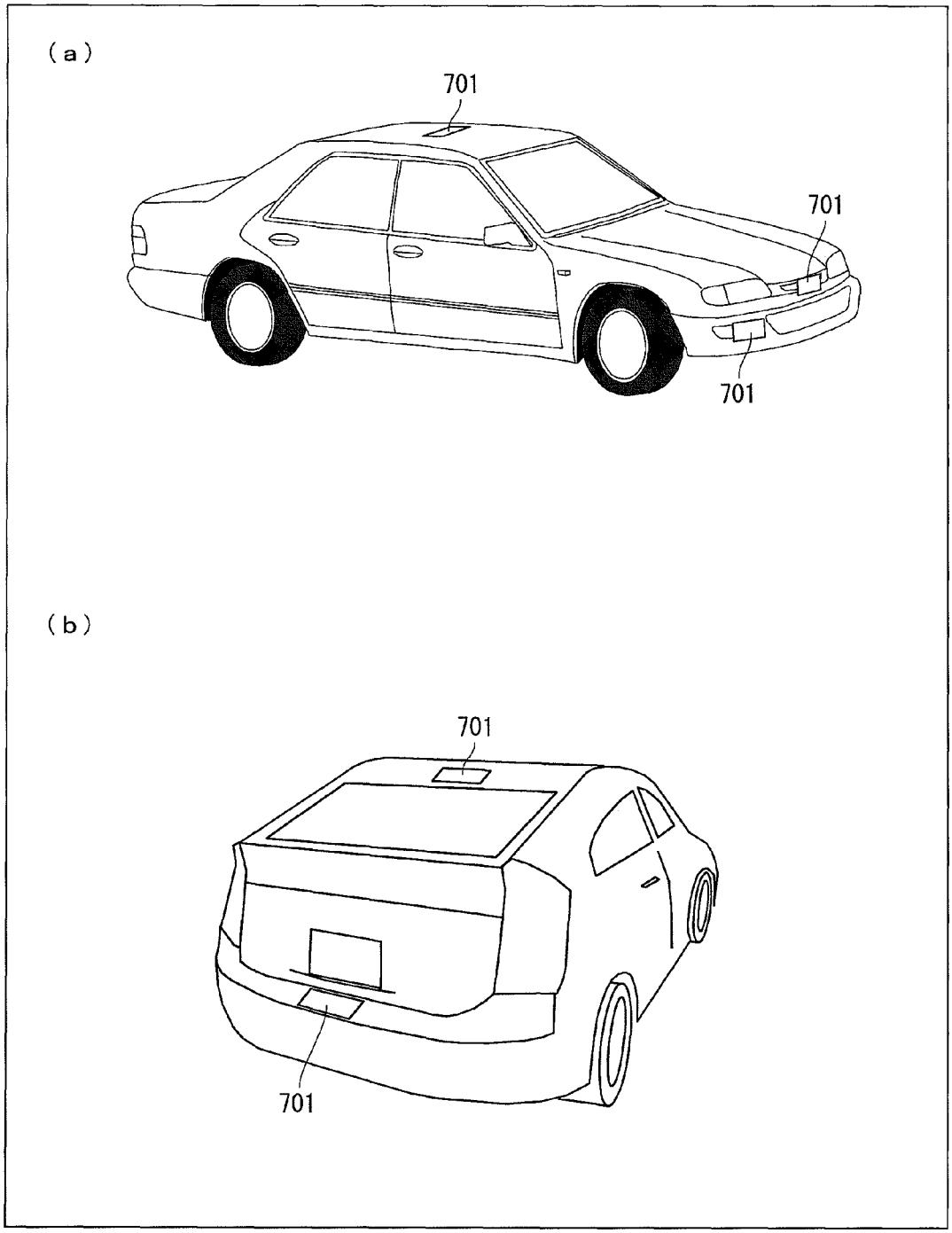
FIG. 59 shows perspective views illustrating how a plurality of antenna devices of the antenna system shown in FIG. 47 are provided on an outer surface of a body of a vehicle. (*a*) of FIG. 59 is a perspective view illustrating antenna devices provided on a rooftop, a hood and a front bumper of the vehicle. (*b*) of FIG. 59 is a perspective view illustrating antenna devices provided on a rooftop and a rear bumper of the vehicle.

FIG. 59 is a perspective view illustrating how a plurality of antenna devices 701 of the antenna system 703 are provided on an outer surface of the body 902 of the vehicle 901. Specifically, (*a*) of FIG. 59 is a perspective view illustrating antenna devices 701 provided on a rooftop, a hood, and on a front bumper of the vehicle 901. (*b*) of FIG. 59 is a perspective view illustrating antenna devices 701 provided on a rooftop and on a rear bumper of the vehicle 901. It should be noted that, according to the antenna system 703, at least four antenna devices 701 are needed to obtain desired gain in each of the x, y and z axis directions. Examples of positions on an outer surface of the body 902 in which positions the antenna devices 701 can be provided include a rear wing, a door, a side mirror and a trunk.

Figure 60:
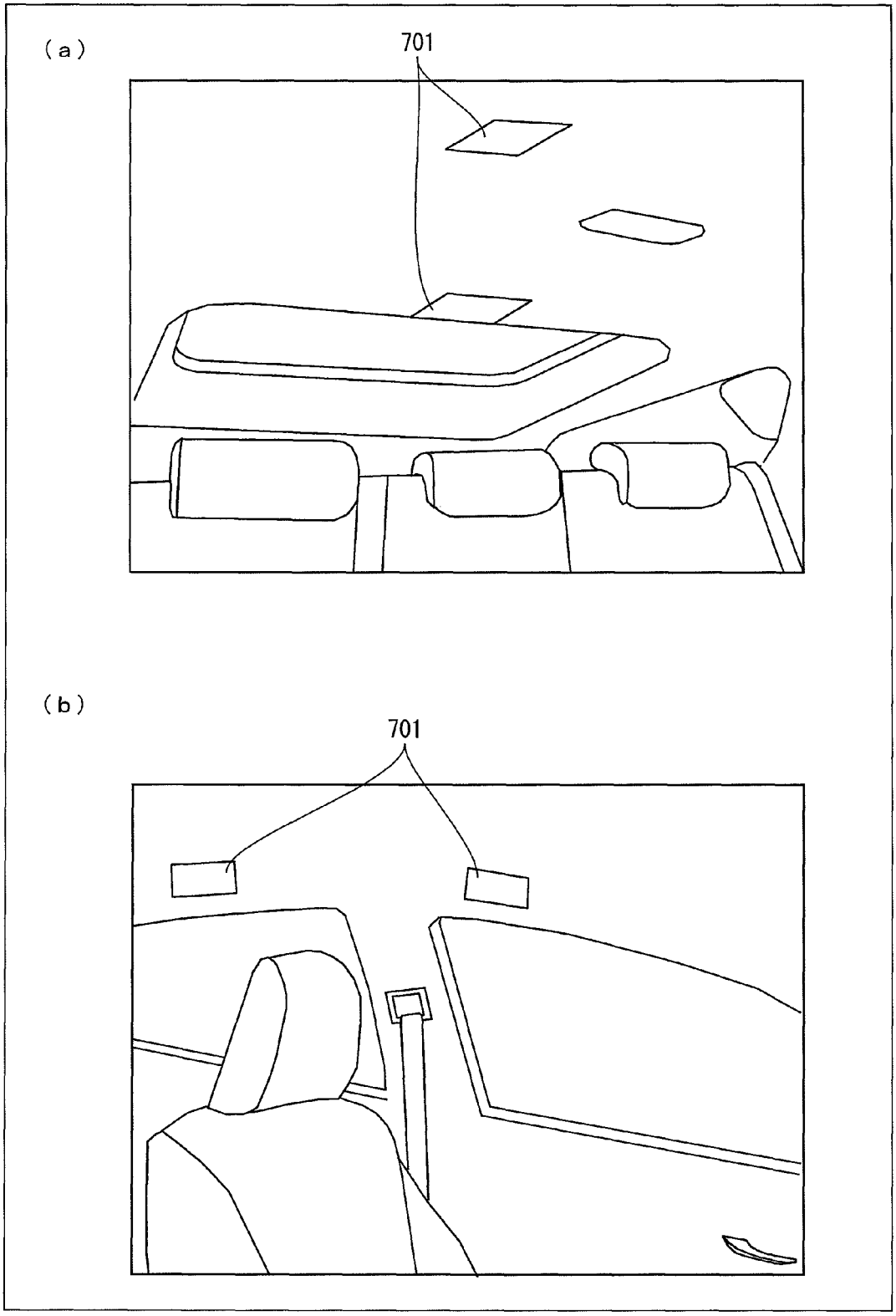
FIG. 60 shows perspective views illustrating how a plurality of antenna devices of the antenna system shown in FIG. 47 are provided inside a vehicle. (*a*) of FIG. 60 is a perspective view illustrating antenna devices provided in two positions on a back surface of a roof (ceiling of the vehicle) of a vehicle. (*b*) of FIG. 60 is a perspective view illustrating antenna devices provided in two positions on the roof inside the vehicle, which positions are in the vicinities of windows.

FIG. 60 is a perspective view illustrating how a plurality of antenna devices 701 of the antenna system 703 are provided inside the vehicle 901. Specifically, (*a*) of FIG. 60 is a perspective view illustrating antenna devices 701 provided in two positions on a back surface of a roof (ceiling of the vehicle) of the vehicle 901. (b) of FIG. 60 is a perspective view illustrating antenna devices 701 provided in two positions on the roof inside the vehicle, in the vicinities of windows.

Figure 61:
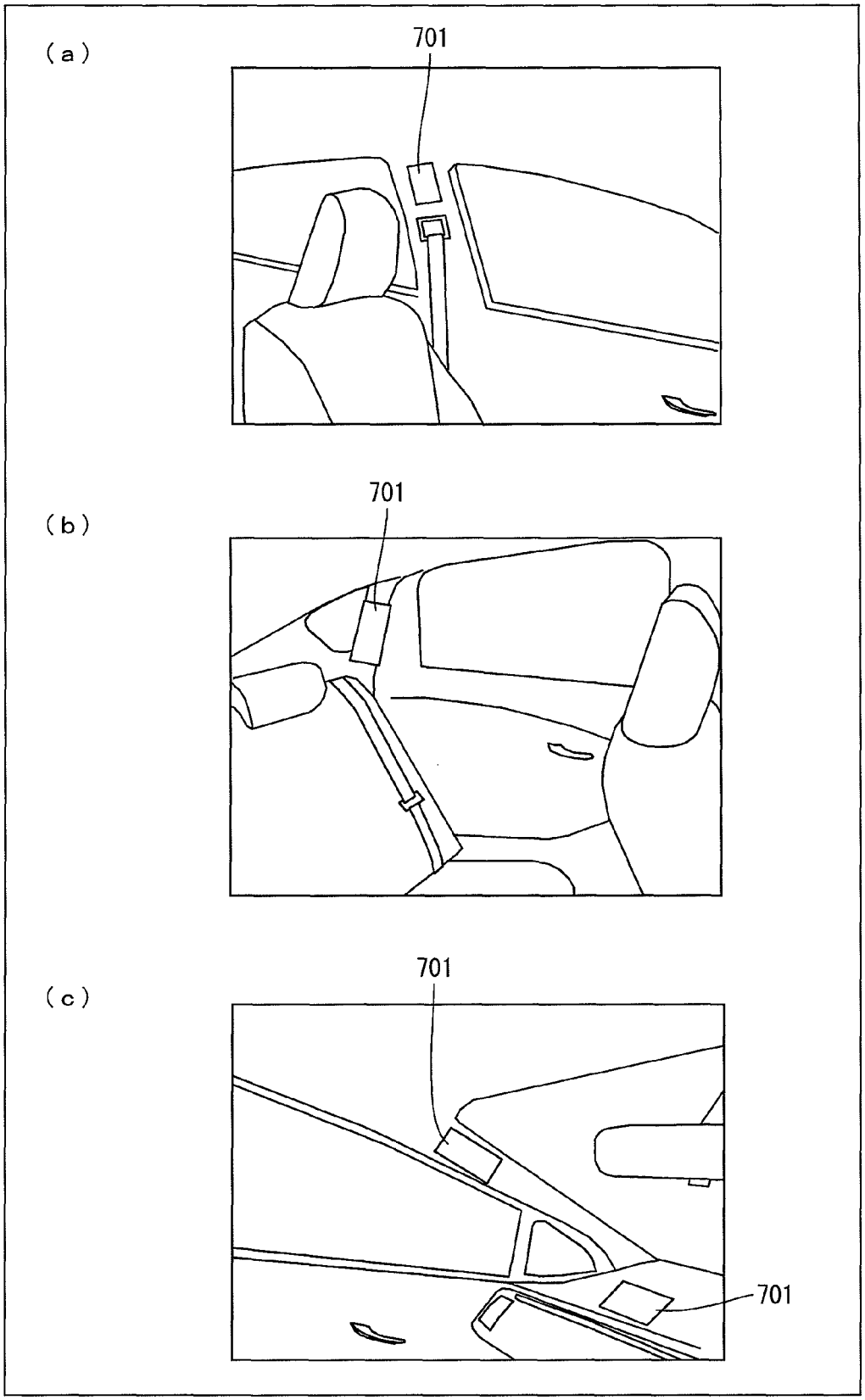
FIG. 61 shows perspective views illustrating how a plurality of antenna devices of the antenna system shown in FIG. 47 are provided in positions different from those shown in FIG. 60 inside a vehicle. (*a*) of FIG. 61 is a perspective view illustrating an antenna device provided on a center pillar. (*b*) of FIG. 61 is a perspective view illustrating an antenna device provided on a rear pillar. (*c*) of FIG. 61 is a perspective view illustrating antenna devices provided on a front pillar and on a dashboard.

FIG. 61 is a perspective view illustrating how a plurality of antenna devices 701 of the antenna system 703 are provided in positions inside the vehicle 901, which positions are different from those shown in FIG. 60. Specifically, (*a*) of FIG. 61 is a perspective view illustrating an antenna device 701 provided on a center pillar inside the vehicle 901.

(*b*) of FIG. 61 is a perspective view illustrating an antenna device 701 provided on a rear pillar inside the vehicle 901. (*c*) of FIG. 61 is a perspective view illustrating antenna devices 701 provided on a front pillar and on a dashboard inside the vehicle 901.

Examples of how to arrange the antenna devices 701 of the antenna system 703 when diversity is carried out include not only the foregoing arrangements, but also the following arrangements.

Figure 62:
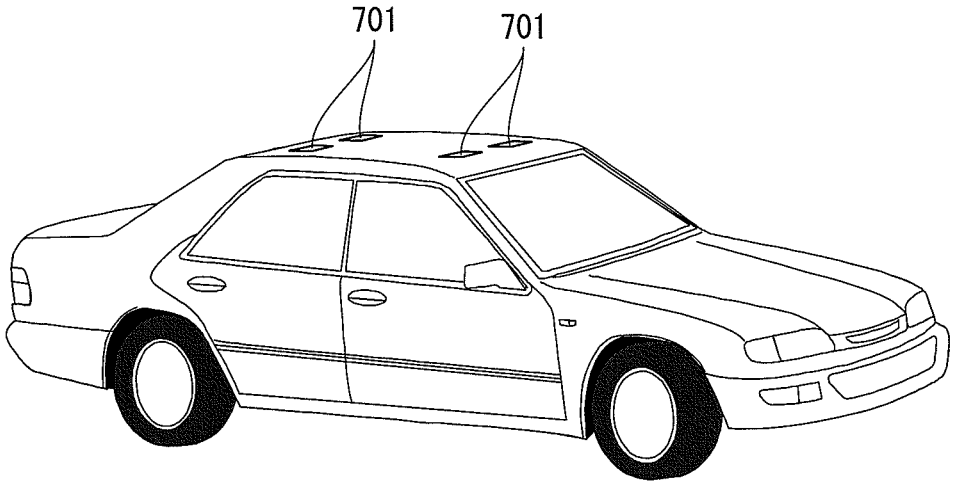
FIG. 62 is a perspective view illustrating how four antenna devices of the antenna system shown in FIG. 47 are provided on an outer surface (on a rooftop) of a body of a vehicle.

FIG. 62 is a perspective view illustrating how the four antenna devices 701 of the antenna system 703 shown in FIG. 47 are provided on an outer surface of the body, i.e., on a rooftop, of the vehicle 901. In this case, the four antenna devices 701 may be provided in the first to fourth positions as shown in FIG. 48. It should be noted that, according to the antenna system 703, the number of antenna devices 701 used to carry out diversity is not limited to four, and is preferably not less than two but not more than four. The lower limit of the number is two, because two or more antenna devices 701 are essential to carry out diversity. The upper limit of the number is four, because, even if more than four antenna devices 701 are provided, this does not so much improve effect of the diversity configuration as compared to a configuration in which four antenna devices 701 are provided.

Figure 63:
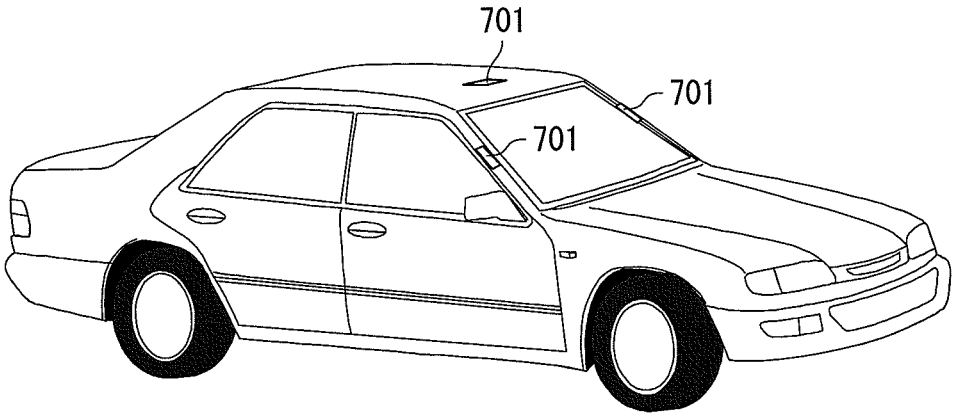
FIG. 63 is a perspective view illustrating how a total of three antenna devices of the antenna system shown in FIG. 47 are provided on an outer surface (on a rooftop and on right and left front pillars) of a body of a vehicle.

FIG. 63 is a perspective view illustrating how a total of three antenna devices 701 of the antenna system 703 shown in FIG. 47 are provided on an outer surface of the body, i.e., on a rooftop and on right and left front pillars, of the vehicle 901. It should be noted that a similar configuration is also available, in which a total of three antenna devices 701 are provided on a rooftop (e.g., on a rear side) and on right and left rear pillars.

Figure 64:
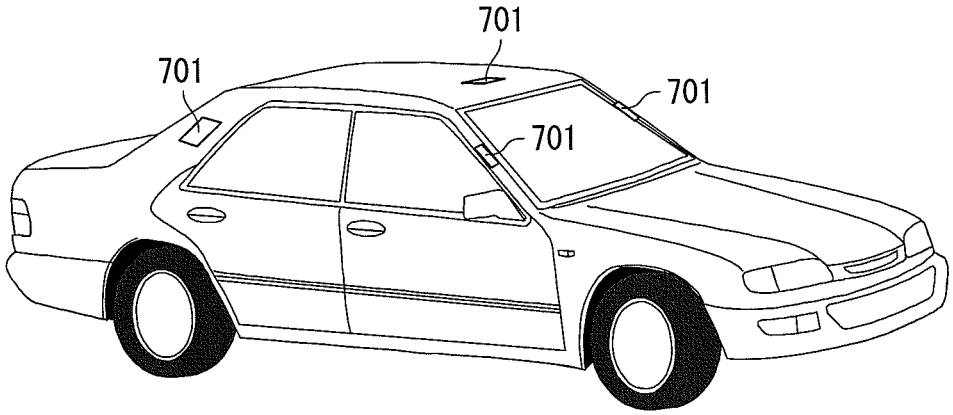
FIG. 64 is a perspective view illustrating an example of how two to four antenna devices of the antenna system shown in FIG. 47 are dispersedly provided on an outer surface of a body of a vehicle, i.e., dispersedly provided on any of the following: a rooftop, right and left front pillars, and right and left rear pillars.

FIG. 64 is a perspective view illustrating an example of how two to four antenna devices of the antenna system 703 shown in FIG. 47 are provided on an outer surface of the body of the vehicle 901. The two to four antenna devices are dispersedly provided on a rooftop, a right front pillar, a left front pillar, a right rear pillar and/or a left rear pillar.

Figure 65:
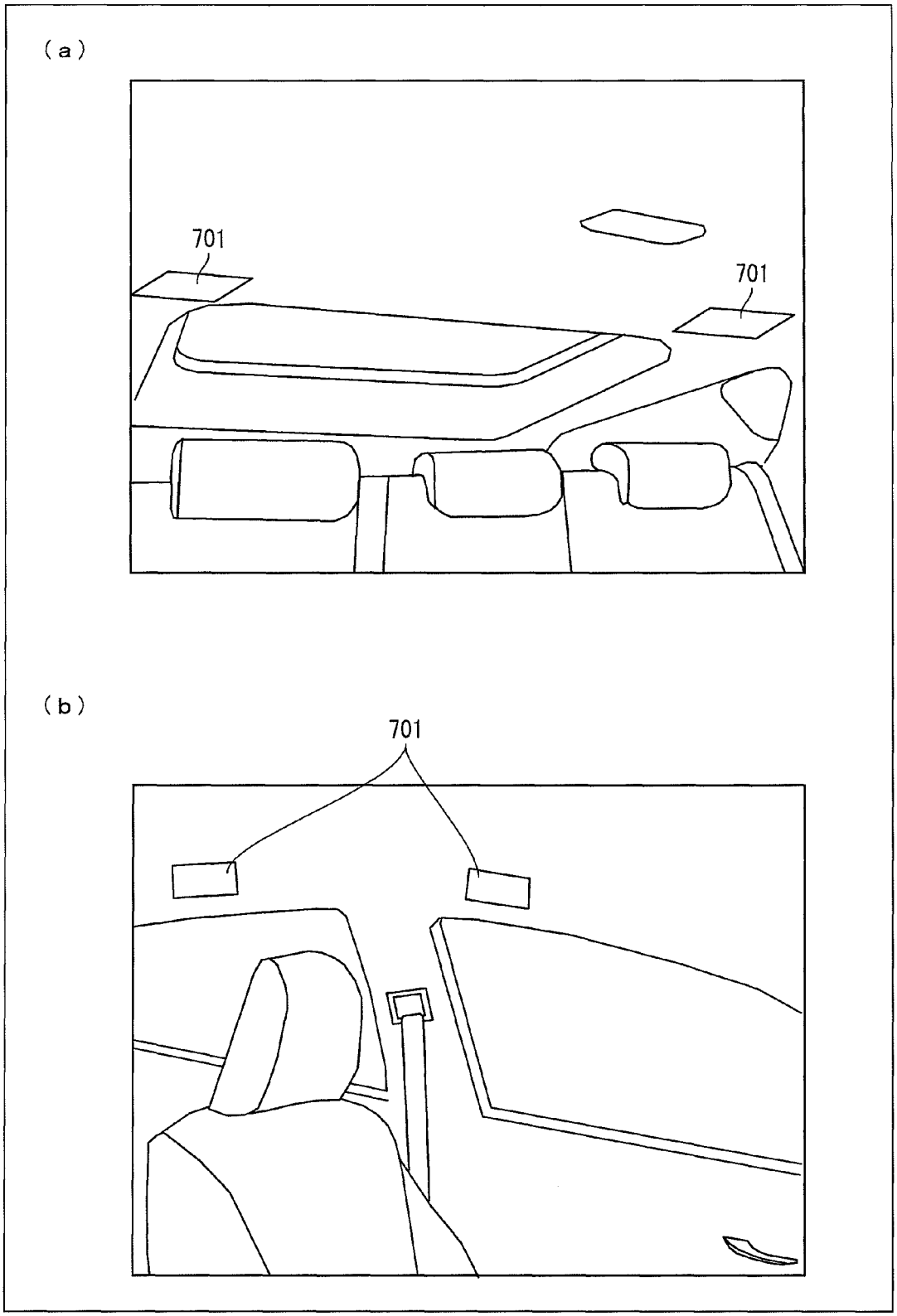
FIG. 65 shows perspective views illustrating how a plurality of antenna devices of the antenna system shown in FIG. 47 are provided in the vicinities of windows inside a vehicle. (*a*) of FIG. 65 is a perspective view illustrating a plurality of antenna devices provided on a back surface of a roof in the vicinity of a roof window. (*b*) of FIG. 65 is a perspective view illustrating a plurality of antenna devices provided on a back surface of a roof in the vicinities of windows on a lateral side of a body of a vehicle.

FIG. 65 is a perspective view illustrating how a plurality of antenna devices 701 of the antenna system 703 shown in FIG. 47 are provided in the vicinities of windows inside the vehicle 901. Specifically, (*a*) of FIG. 65 is a perspective view illustrating a plurality of antenna devices 701 provided on a back surface of a roof in the vicinity of a roof window. (*b*) of FIG. 65 is a perspective view illustrating a plurality of antenna devices 701 provided on a back surface of the roof in the vicinities of windows on a lateral side of the body of the vehicle. The antenna system 703 may be configured such that (i) an antenna device(s) 701 shown in (*a*) of FIG. 65 and an antenna device(s) 701 shown in (*b*) of FIG. 65 are mixedly employed so the total number of them is two to four and (ii) diversity is carried out by using these two to four antenna devices 701.

Figure 66:
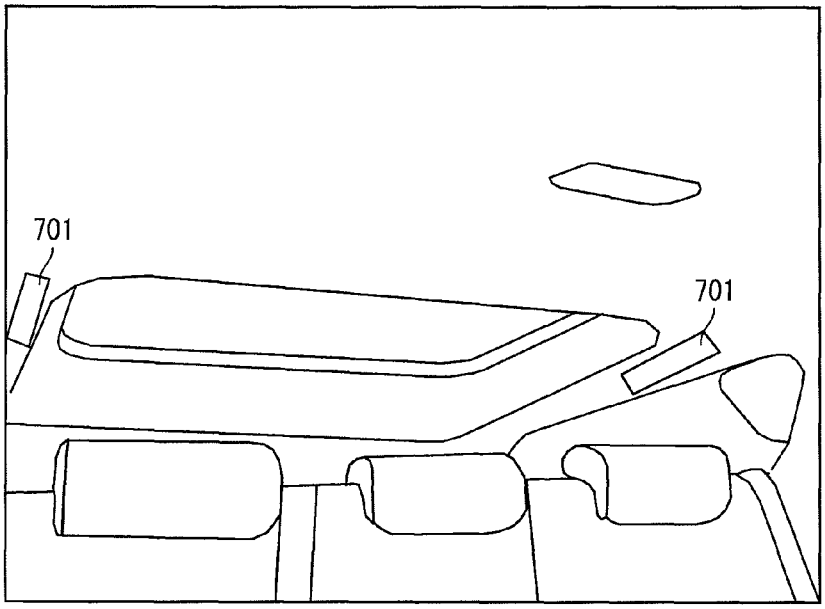
FIG. 66 shows perspective views illustrating how a plurality of antenna devices of the antenna system shown in FIG. 47 are provided on pillars inside a vehicle. (*a*) of FIG. 66 is a perspective view illustrating antenna devices provided on respective right and left rear pillars. (*b*) of FIG. 66 is a perspective view illustrating antenna devices provided on a center pillar and on a front pillar, respectively.
Figure 66:
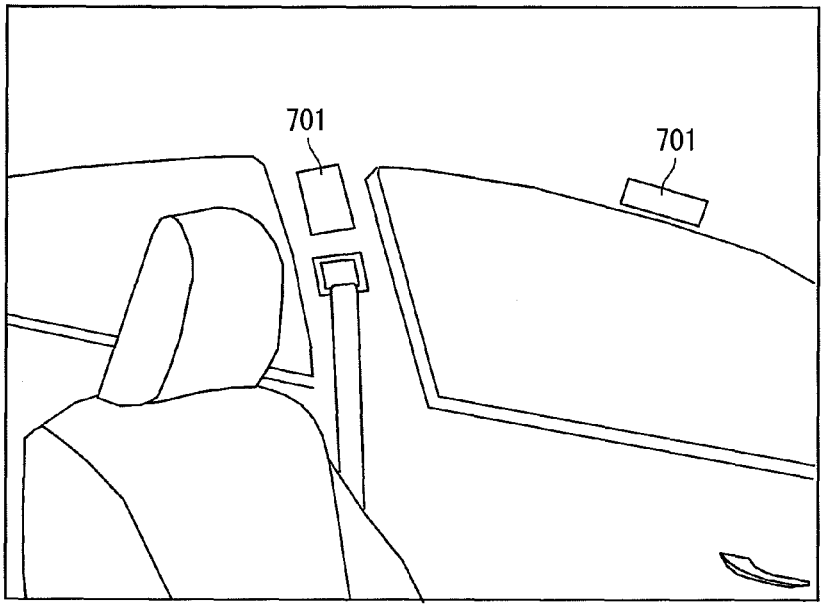

FIG. 66 is a perspective view illustrating how a plurality of antenna devices 701 of the antenna system 703 shown in FIG. 47 are provided on pillars inside the vehicle 901. Specifically, (*a*) of FIG. 66 is a perspective view illustrating antenna devices 701 provided on respective right and left rear pillars. (*b*) of FIG. 66 is a perspective view illustrating antenna devices 701 provided on a center pillar and on a front pillar, respectively. The antenna system 703 may be configured such that (i) an antenna device(s) 701 shown in (*a*) of FIG. 66 and an antenna device(s) 701 shown in (*b*) of FIG. 66 are mixedly employed so the total number of them is two to four and (ii) diversity is carried out by using these two to four antenna devices 701.

Figure 67:
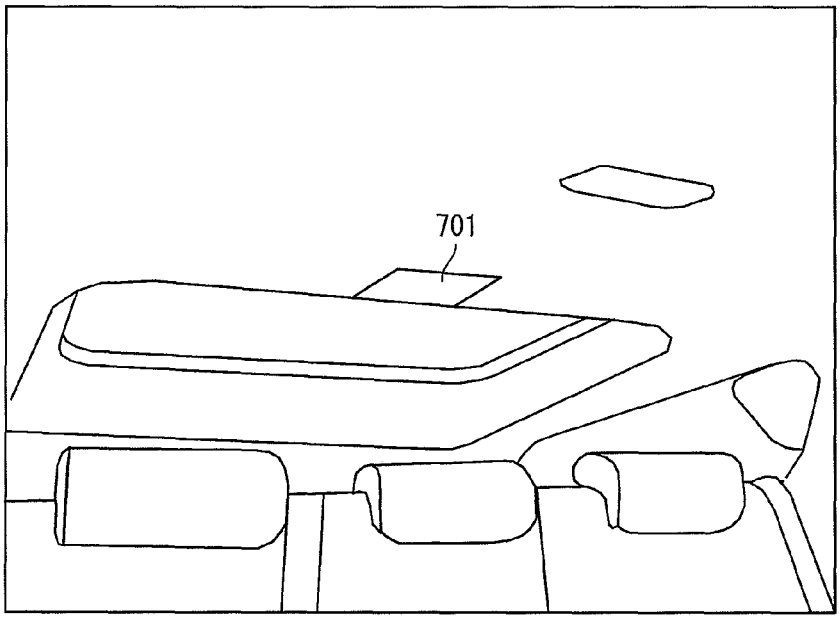
FIG. 67 shows perspective views illustrating how a plurality of antenna devices of the antenna system shown in FIG. 47 are provided, inside a vehicle, on a back surface of a roof and on a center pillar. (*a*) of FIG. 67 is a perspective view illustrating an antenna device provided, on the back surface of a roof, in the vicinity of the center of the roof in a direction of width of the vehicle. (*b*) of FIG. 67 is a perspective view illustrating antenna devices provided on the back surface of the roof in the vicinity of a window and on a center pillar, respectively.
Figure 67:
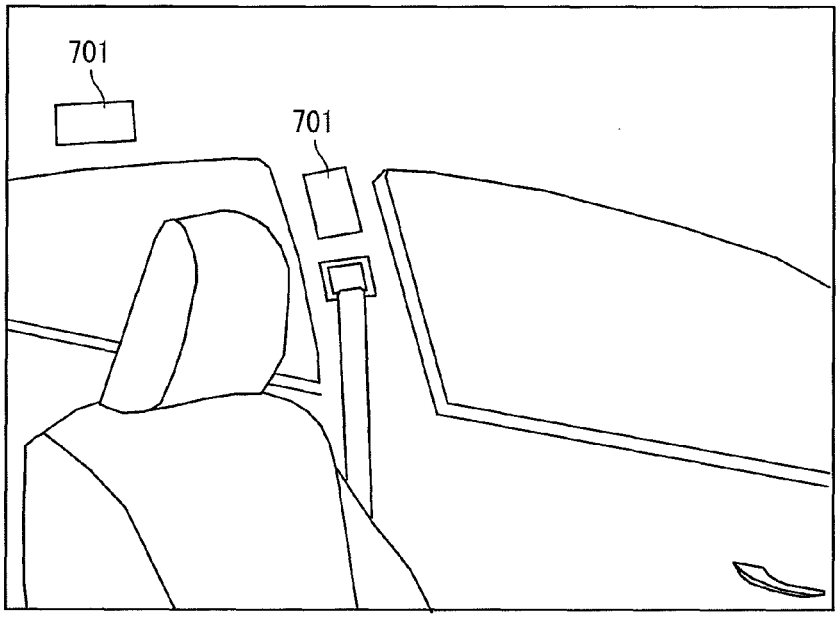

FIG. 67 is a perspective view illustrating how a plurality of antenna devices 701 of the antenna system 703 shown in FIG. 47 are provided on a back surface of the roof and on a center pillar inside the vehicle 901. Specifically, (*a*) of FIG. 67 is a perspective view illustrating an antenna device 701 provided in the vicinity of the center, in a direction of width of a vehicle, of a back surface of a roof. (*b*) of FIG. 67 is a perspective view illustrating antenna devices 701 provided on the back surface of a roof in the vicinity of a window and on a center pillar, respectively. The antenna system 703 may be configured such that (i) an antenna device(s) 701 shown in (*a*) of FIG. 67 and an antenna device(s) 701 shown in (*b*) of FIG. 67 are mixedly employed so the total number of them is two to four and (ii) diversity is carried out by sing these two to four antenna devices 701.

Figure 68:
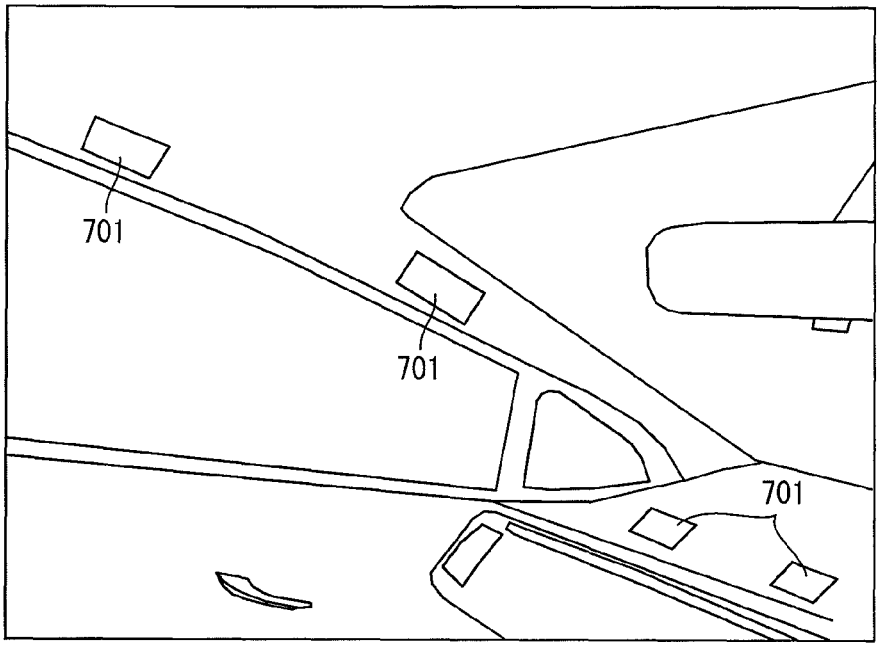
FIG. 68 is a perspective view illustrating how antenna devices of the antenna system shown in FIG. 47 are provided inside a vehicle, which antenna devices are provided on a back surface of a roof in the vicinity of a window, on a front pillar, and on a dashboard.

FIG. 68 is a perspective view illustrating how antenna devices 701 of the antenna system 703 shown in FIG. 47 are provided inside the vehicle 901 on a back surface of a roof in the vicinity of a window, on a front pillar and on a dashboard. The antenna system 703 is configured such that (i) antenna devices 701 in these positions are mixedly employed so that the number of them is two to four and (ii) diversity is carried out by using these two to four antenna devices 701.

Figure 69:
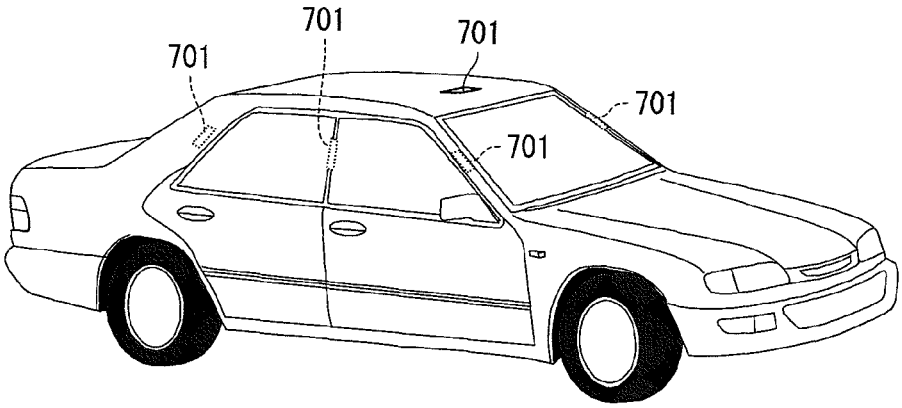
FIG. 69 is a perspective view illustrating how antenna devices are arranged in a case where diversity is carried out by using a plurality of antenna devices of the antenna system shown in FIG. 47 provided on an outer surface of a body of a vehicle and inside the vehicle.

FIG. 69 is a perspective view illustrating how a plurality of antenna devices 701 are provided on an outer surface of the body 902 of the vehicle 901 and inside (on an inner surface of the body 902) the vehicle 901 when diversity is carried out by using these antenna devices 701 of the antenna system 703 shown in FIG. 47. Specifically, the antenna devices 701 are provided on a rooftop, a front pillar, a center pillar and a rear pillar of the vehicle 901. Out of these, for example the antenna devices 701 on the front pillar, center pillar and on the rear pillar are provided inside the vehicle 901, and the antenna device 701 on the rooftop is provided outside the vehicle 901. The antenna system 703 mixedly employs an antenna device(s) 701 provided inside the vehicle and an antenna device(s) 701 provided outside the vehicle so that the number of antenna devices is two to four, and diversity is carried out by using these two to four antenna devices 701.

According to the arrangement of the antenna devices 701 shown in FIG. 69, some of the antenna devices 701 that form a diversity configuration are provided inside the vehicle and the other is provided outside the vehicle. This makes it possible, while keeping good receiving condition by virtue of the antenna device 701 provided outside the vehicle, to prevent external appearance of the vehicle from being impaired, which external appearance is likely to be impaired when all the antenna devices 701 are provided outside the vehicle. Further, since the number of antenna devices 701 provided outside the vehicle (on an outer surface of the body 902) is reduced, it is possible to increase a degree of freedom in positions outside the vehicle in which positions the antenna devices 701 are to be provided.

It is preferable that, in the antenna device, the antenna element further include an intermediate section lying between the two root sections, and that the intermediate section be constituted by (i) a first part having a meander shape made up of at least one return pattern and (ii) a second part having a linear shape or having a meander shape made up of at least one return pattern; and the first part and the second part are arranged such that (a) a return direction of the meander shape of the first part and (b) a direction in which the linear shape of the second part extends or a return direction of the meander shape of the second part are perpendicular to each other.

In this case, the first part and the second part of the intermediate section of the antenna element are arranged such that (i) a return direction in the meander shape of the first part and (ii) a direction in which the linear shape of the second part extends or a return direction in the meander shape of the second part are perpendicular to each other. Therefore, it is possible to improve a non-directivity radiation characteristic for each radio wave in both the case of transmitting/receiving radio wave on a low frequency band side and the case of transmitting/receiving radio wave on a high frequency band side.

The antenna device is preferably configured such that, in the antenna element, the first root section has (i) a first linear part that extends in a first direction from one end part of the antenna element and (ii) a second linear part that is connected with the first linear part via a first bending part and extends from the first bending part in a second direction that is opposite to the first direction, the second linear part being a tail end linear part, and the second root section has (a) a third linear part that extends in the second direction from the other end part of the antenna element and (b) a fourth linear part that is connected with the third linear part via a second bending part and extends from the second bending part in the first direction, the fourth linear part being a tail end linear part.

In this case, both of the directions in which the two respective root sections of the antenna element extend are rotated by 180 degrees so as to surround the feed section.

Therefore, it is possible to obtain high radiant gain for each radio wave in both the case of transmitting/receiving radio wave on a low frequency band side and the case of transmitting/receiving radio wave on a high frequency band side.

The antenna device is preferably configured such that, in the antenna element, the first root section has (i) a first linear part that extends in a first direction from one end part of the antenna element, (ii) a second linear part that is connected with the first linear part via a first bending part and extends from the first bending part in a second direction that is opposite to the first direction, and (iii) a third linear part that is connected with the second linear part via a second bending part and extends from the second bending part in the first direction, the third linear part being a tail end linear part, and the second root section has (a) a fourth linear part that extends in the second direction from the other end part of the antenna element, (b) a fifth linear part that is connected with the fourth linear part via a third bending part and extends from the third bending part in the first direction, and (c) a sixth linear part that is connected with the fifth linear part via a fourth bending part and extends from the third bending part in the second direction, the sixth linear part being a tail end linear part.

In this case, both of the directions in which the two respective root sections of the antenna element extend are rotated by 360 degrees so as to surround the feed section.

Therefore, it is possible to obtain high radiant gain for each radio wave in both the case of transmitting/receiving radio wave on a low frequency band side and the case of transmitting/receiving radio wave on a high frequency band side.

The antenna device is preferably configured such that at least one of the first and second parts has one of or a plurality of short-circuit material(s) provided on the meander shape of said at least one of the first and second parts, the short-circuit material(s) being configured to cause a short circuit(s) in the meander shape of said at least one of the first and second parts.

In this case, when providing in a meander shape the short-circuit material(s) configured to cause a short circuit(s), it is possible to determine a position and a portion in which the short-circuit material(s) is to be provided so that the number of resonance points in the antenna element becomes large.

Accordingly, it is possible to increase the number of resonance points in the antenna element, and thus possible to further expand a usable band for the antenna device.

The antenna device is preferably configured such that the intermediate section of the antenna element has a meander-shaped part made up of a plurality of return patterns of the electrically conductive path; and in the meander-shaped part, a short-circuit section short-circuiting two different points in the return patterns is provided so as to reduce a VSWR value in a usable band for the antenna device.

According to the configuration, the short-circuit section short-circuiting two different points in the return patterns is provided in the meander-shaped part of the intermediate section of the antenna element so as to reduce a VSWR value in a usable band for the antenna device. This makes it possible to easily obtain, by employing a simple configuration in which a short-circuit section is provided in a meander-shaped part, an antenna device which is good in VSWR characteristic in a usable band.

The antenna device is preferably configured such that the short-circuit section short-circuits the two different points in the return patterns so as to reduce the VSWR value to 3.5 or less.

According to the configuration, it is possible, by employing a simple configuration in which two different points in return patterns are short-circuited by a short-circuit section, to obtain an antenna device having a good VSWR characteristic in which a VSWR value in a usable band is not more than 3.5.

It is preferable that the antenna device further include a dielectric layer made from a dielectric material on one surface-side of the antenna element.

According to the configuration, the antenna device includes, on one surface side of the antenna element, the dielectric layer made from a dielectric material. Therefore, in a case where the antenna device is provided on a metal such as for example a body of a vehicle, it is possible to suppress an adverse effect of the metal by virtue of the dielectric layer. This makes it possible to keep a good VSWR characteristic even in a case where the antenna device is provided for example on a body of a vehicle.

The antenna device is preferably configured such that the dielectric material is not less than 2 mm in thickness.

According to the configuration, even when the antenna device is mounted in the vicinity of a conductor, it is possible to prevent the VSWR value in a usable band from being greater than 3.5, except for some band(s).

An antenna system in accordance with the present invention includes: the antenna device configured such that (i) the intermediate section of the antenna element has a meander-shaped part made up of a plurality of return patterns of the electrically conductive path and (ii) in the meander-shaped part, a short-circuit section short-circuiting two different points in the return patterns is provided so as to reduce a VSWR value in a usable band for the antenna device, the antenna device being provided inside a vehicle.

According to the configuration, an antenna device provided to a vehicle is the antenna device which has achieved a good VSWR characteristic in the usable band by employing a simple configuration in which the short-circuit section is provided in the meander-shaped part. Therefore, it is possible to obtain good receiving conditions also in the vehicle. Further, since the antenna device is provided inside the vehicle, it is possible to prevent external appearance of the vehicle from being impaired by the antenna device provided.

The antenna system may be configured such that the antenna device is provided within a distance from an aperture in a body of the vehicle, i.e., a window, the distance being not greater than one half a wavelength of a lowest frequency in a usable band for the antenna device.

According to the configuration, it is possible to cause the antenna device to operate under receiving condition with good electric field intensity. In particular, since radio waves of the terrestrial digital broadcasting enter the body of the vehicle from a lateral direction, it is possible to achieve good receiving condition for the terrestrial digital broadcasting.

The antenna system may be configured such that the antenna device is provided on a pillar of the vehicle, on a back surface of a rooftop of the vehicle, on a back surface of a door of the vehicle, or on a dashboard of the vehicle.

According to the configuration, it is possible to appropriately arrange the antenna device inside the vehicle.

The antenna system includes: a plurality of antenna devices; and received signal outputting means, each of the plurality of antenna devices being configured such that (i) the intermediate section of the antenna element has a meander-shaped part made up of a plurality of return patterns of the electrically conductive path and (ii) in the meander-shaped part, a short-circuit section short-circuiting two different points in the return patterns is provided so as to reduce a VSWR value in a usable band for the antenna device, the plurality of antenna devices being provided on a body of a vehicle, the received signal outputting means being connected to the plurality of antenna devices, and diversity being carried out by using the plurality of antenna devices.

According to the configuration, antenna devices provided to the vehicle are a plurality of antenna devices each of which has achieved a good VSWR characteristic in a usable band by employing a simple configuration in which the short-circuit section is provided in the meander-shaped part. Therefore, it is possible to obtain good receiving conditions of radio waves of each of the antenna devices even in the vehicle. Further, since diversity is carried out by providing such a plurality of antenna devices on a body of the vehicle, it is possible to carry out good diversity.

The antenna system may be configured such that at least one of the plurality of antenna devices is provided inside the vehicle and at least one of the plurality of antenna devices is provided outside the vehicle.

According to the configuration, it is possible, while keeping good receiving conditions by virtue of the antenna device(s) outside the vehicle, to prevent external appearance of the vehicle from being impaired, which external appearance is likely to be impaired when all of the antenna devices are provided outside the vehicle. Further, since the number of antenna devices provided outside the vehicle is reduced, it is possible to increase a degree of freedom in positions outside the vehicle in which positions the antenna devices are to be provided.

The antenna system may be configured such that the total number of the plurality of antenna devices is not less than two but not more than four.

According to the configuration, since the lower limit of the total number of the antenna devices is two, it is possible to carry out diversity. Further, since the upper limit of the total number of the antenna devices is four, it is possible to prevent antenna device(s) that does not so much contribute to improvement in effect of the diversity configuration from being provided unnecessarily.

The present invention is not limited to the descriptions of the respective embodiments, but may be altered within the scope of the claims. An embodiment derived from a proper combination of technical means disclosed in different embodiments is encompassed in the technical scope of the invention.

INDUSTRIAL APPLICABILITY

The present invention is applicable to an antenna device for receiving broadcast waves. Specifically, the present invention is usable in for example an antenna device that is provided in a portable device or a personal computer etc. which has a display function and is capable of carrying out transmission and reception both in a VHF broadcast band and in a UHF terrestrial digital broadcast band.

More specifically, the present invention is applicable to an antenna device which (i) is provided in a portable device etc. which has a display function like above and (ii) solves a problem of its storage space when not in use. In particular, the present invention is usable in an antenna device which (a) is provided in a device that is portable and (b) is excellent in shock resistance and safety.

REFERENCE SIGNS LIST

101, 201, 201*a* Antenna device
111 First antenna section (first part)
112 Second antenna section (second part)
113, 113*a* to 113*g*, 211, 211*a* Wind section (first region)
114, 222, 222*a* Feed section
115, 215, 215*a* Antenna element
116, 116*a* to 116*d*, 116*f* to 116*h* Inductance matching pattern (wider width part)
117, 117*a*, 117*b*, 117*c*, 117*d* First root section
117*c*1 First linear part (wider width part)
117*c*3 Second linear part (tail end linear part)
117*d*3 Second linear part (tail end linear part)
117*o*1 First linear part
117*o*5 Third linear part (tail end linear part)
117*o*11, 117*a*11, 117*b*11, 117*c*11, 117*d*11 Protrusion part
118, 118*a*, 118*b*, 118*c*, 118*d* Second root section
118*a*1 Fourth linear part (wider width part)
118*b*1 Fourth linear part (wider width part)
118*d*2 Second bending part (wider width part)
118*c*3 Fourth linear part (tail end linear part)
118*d*3 Fourth linear part (tail end linear part)
118*o*1 Fourth linear part (wider width part)
118*o*5 Sixth linear part (tail end linear part)
118*o*11 Protrusion part (wider width part)
118*a*11, 118*b*11, 118*c*11, 118*d*11 Protrusion part
121, 221, 221*a* Coaxial cable
122 Outer conductor
123 Inner conductor
131*g*, 132*g*, 133*g*, 134*g*, 231, 231*a*, 232*a* Short-circuit material (short-circuit section)
212, 212*a* Antenna section
213, 213*a* First wider width part
214, 214*a* Second wider width part
402 Dielectric material
701 Antenna device
702 Antenna element
703 Antenna system
711 Dielectric layer
802 Metal

803 Interior material
901 Vehicle
902 Body
903 Window

The invention claimed is:

1. An antenna device comprising an antenna element which has an electrically conductive path continuing from one end part to the other end part and which has a feed section provided in the one and the other end parts of the electrically conductive path, the antenna element having a first root section which includes the one end part of the electrically conductive path, a second root section which includes the other end part of the electrically conductive path, and an intermediate section which lies between the first root section and the second root section, the feed section being provided in the first root section and the second root section, the first root section and the second root section being arranged such that respective end parts of the first root section and the second root section are adjacent to each other and the first root section and the second root section extend along each other from the respective end parts so as to form a single winding section in which the respective end parts are enwound and so as to surround the feed section, and the first root section and the second root section being arranged in a first region that is part of a region where the electrically conductive path is formed, in the first region, tail end linear parts of the winding section, which tail end linear parts are directly connected with the intermediate section, extending in respective opposite directions, and at least one of the first and second root sections having a wider width part, the wider width part being formed such that a portion that overlaps a feed line connected with the feed section is larger in width than other portions;

wherein the intermediate section is constituted by (i) a first part having a meander shape made up of at least one return pattern and (ii) a second part having a linear shape or having a meander shape made up of at least one return pattern;

wherein the first part and the second part are arranged such that (a) a return direction of the meander shape of the first part and (b) a direction in which the linear shape of the second part extends or a return direction of the meander shape of the second part are perpendicular to each other; and wherein, in the antenna element, the first root section has (i) a first linear part that extends in a first direction from one end part of the antenna element and (ii) a second linear part that is connected with the first linear part via a first bending part and extends from the first bending part in a second direction that is opposite to the first direction, the second linear part being a tail end linear part, and the second root section has (a) a third linear part that extends in the second direction from the other end part of the antenna element and (b) a fourth linear part that is connected with the third linear party via a second bending part and extends from the second bending part in the first direction, the fourth linear part being a tail end linear part.

2. The antenna device as set forth in claim 1, wherein at least one of the first and second parts has one of or a plurality of short-circuit material(s) provided on the meander shape of said at least one of the first and second parts, the short-circuit material(s) being configured to cause a short circuit(s) in the meander shape of said at least one of the first and second parts.

3. The antenna device as set forth in claim 1, wherein:

the intermediate section of the antenna element has a meander-shaped part made up of a plurality of return patterns of the electrically conductive path; and in the meander-shaped part, a short-circuit section short-circuiting two different points in the return patterns is provided so as to reduce a VSWR value in a usable band for the antenna device.

4. The antenna device as set forth in claim 3, wherein the short-circuit section short-circuits the two different points in the return patterns so as to reduce the VSWR value to 3.5 or less.

5. The antenna device as set forth in claim 1, further comprising a dielectric layer made from a dielectric material on one surface-side of the antenna element.

6. The antenna device as set forth in claim 5, wherein the dielectric material is not less than 2 mm in thickness.

7. The antenna system comprising an antenna device recited in claim 3, the antenna device being provided inside a vehicle.

8. The antenna system as set forth in claim 7, wherein the antenna device is provided within a distance from an aperture in a body of the vehicle, the distance being not greater than one half a wavelength of a lowest frequency in a usable band for the antenna device.

9. The antenna system as set forth in claim 7, wherein the antenna device is provided on a pillar of the vehicle, on a back surface of a rooftop inside the vehicle, on a back surface of a door of the vehicle, or on a dashboard of the vehicle.

10. An antenna system, comprising:

a plurality of antenna devices each recited in claim 3; and received signal outputting means, the plurality of antenna devices being provided on a body of a vehicle, the received signal outputting means being connected to the plurality of antenna devices, and diversity being carried out by using the plurality of antenna devices.

11. The antenna system as set forth in claim 10, wherein at least one of the plurality of antenna devices is provided inside the vehicle and at least one of the plurality of antenna devices is provided outside the vehicle.

12. The antenna system as set forth in claim 10, wherein the total number of the plurality of antenna devices is not less than two but not more than four.

13. An antenna device comprising an antenna element which has an electrically conductive path continuing from one end part to the other end part and which has a feed section provided in the one and the other end parts of the electrically conductive path, the antenna element having a first root section which includes the one end part of the electrically conductive path, a second root section which includes the other end part of the electrically conductive path, and an intermediate section which lies between the first root section and the second root section, the feed section being provided in the first root section and the second root section, the first root section and the second root section being arranged such that respective end parts of the first root section and the second root section are adjacent to each other and the first root section and the second root section extend along each other from the respective end parts so as to form a single winding section in which the respective end parts are enwound and so as to surround the feed section, and the first root section and the second root section being arranged in a first region that is part of a region where the electrically conductive path is formed, in the first region, tail end linear parts of the winding section, which tail end linear parts are directly connected with the intermediate section, extending in respective opposite directions, and at least one of the first and second root sections having a wider width part, the wider width part being formed such that a portion that overlaps a feed line connected with the feed section is larger in width than other portions;

wherein the intermediate section is constituted by (i) a first part having a meander shape made up of at least one return pattern and (ii) a second part having a linear shape or having a meander shape made up of at least one return pattern;

wherein the first part and the second part are arranged such that (a) a return direction of the meander shape of the first part and (b) a direction in which the linear shape of the second part extends or a return direction of the meander shape of the second part are perpendicular to each other; and wherein, in the antenna element, the first root section has (i) a first linear part that extends in a first direction from one end part of the antenna element, (ii) a second linear part that is connected with the first linear part via a first bending part and extends from the first bending part in a second direction that is opposite to the first direction, and (iii) a third linear part that is connected with the second linear part via a second bending part and extends from the second bending part in the first direction, the third linear part being a tail end linear part, and the second root section has (a) a fourth linear part that extends in the second direction from the other end part of the antenna element, (b) a fifth linear part that is connected with the fourth linear part via a third bending part and extends from the third bending part in the first direction, and (c) a sixth linear part that is connected with the fifth linear part via a fourth bending part and extends from the fourth bending part in the second direction, the sixth linear part being a tail end linear part.

* * * * *